United States Patent [19]

Suzuki

[11] Patent Number: 4,841,828

[45] Date of Patent: Jun. 27, 1989

[54] ELECTRONIC MUSICAL INSTRUMENT WITH DIGITAL FILTER

[75] Inventor: Hideo Suzuki, Hamamatsu, Japan

[73] Assignee: Yamaha Corporation, Hamaamtsu, Japan

[21] Appl. No.: 934,781

[22] Filed: Nov. 25, 1986

[30] Foreign Application Priority Data

| | | | |
|---|---|---|---|
| Nov. 29, 1985 | [JP] | Japan | 60-267542 |
| Dec. 4, 1985 | [JP] | Japan | 60-271659 |
| May 23, 1986 | [JP] | Japan | 61-117522 |
| May 28, 1986 | [JP] | Japan | 61-121315 |
| Jul. 3, 1986 | [JP] | Japan | 61-155066 |
| Jul. 3, 1986 | [JP] | Japan | 61-155067 |

[51] Int. Cl.[4] ..... G10H 1/12; G10H 7/00

[52] U.S. Cl. ..... 84/1.19; 84/DIG. 9; 364/419; 364/724.19; 364/724.01

[58] Field of Search ..... 84/1.11–1.13, 84/1.19–1.23, DIG. 9; 364/419, 724

[56] References Cited

U.S. PATENT DOCUMENTS

| | | | |
|---|---|---|---|
| 4,377,960 | 3/1983 | Okumura | 84/1.01 |
| 4,383,462 | 5/1983 | Nagai et al. | 84/1.26 |
| 4,416,179 | 11/1983 | Wachi | 84/1.19 |
| 4,433,604 | 2/1984 | Ott | 84/1.19 |
| 4,548,119 | 10/1985 | Wachi et al. | 84/1.19 |
| 4,554,858 | 11/1985 | Wachi et al. | 84/1.19 |
| 4,700,603 | 10/1987 | Takauji et al. | 84/1.19 |
| 4,701,956 | 10/1987 | Katoh | 84/1.19 X |

FOREIGN PATENT DOCUMENTS

| | | |
|---|---|---|
| 0150736 | 7/1985 | European Pat. Off. . |
| 58-142396 | 8/1983 | Japan . |
| 59-44096 | 3/1984 | Japan . |

*Primary Examiner*—S. J. Witkowski

*Attorney, Agent, or Firm*—Spensley Horn Jubas & Lubitz

[57] ABSTRACT

A pitch synchronizing signal snychronized with the pitch of a digital tone signal to be filtered is generated by a pitch synchronizing signal generation circuit. A digital filter circuit which receives the digital tone signal and imparts it with a desired tone color by subjecting it to a proper filter operation executes this filter operation with a sampling period synchronized with the pitch synchronizing signal. A moving formant thereby is realized which is suitable for control of a tone. A pitch synchronization output circuit for sampling and outputting the output of the digital filter circuit in accordance with the pitch synchronizing signal may be provided and this will prevent occurrence of a sampling noise. A switching circuit is provided for enabling switching order of the digital filter circuit between an even number and an odd number. By this switching of order, a desired filter characteristic can be realized with high fidelity. The filter coefficient may be used commonly for two orders positioned at symmetrical positions. Filter coefficients which do not undergo timewise change and those which undergo timewise change may be selectively supplied in separate channels.

29 Claims, No Drawings

PITCH SYNC. SIGNAL GENERATION CKT.

DETERMINATION OF FILTER COEFFICIENTS

INPUT INTERFACE 38

ADAPTIVE DIGITAL FILTER DEVICE (ADF) 21

EVEN NUMBER (32) ORDER "FIR" TYPE FILTER

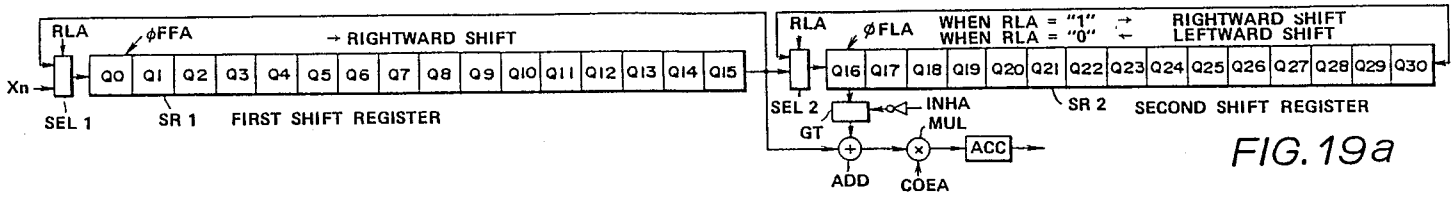

FIG. 19a

| OPE. TIMING | Q0 | Q1 | Q2 | Q3 | Q4 | Q5 | Q6 | Q7 | Q8 | Q9 | Q10 | Q11 | Q12 | Q13 | Q14 | Q15 | SR 1 SHIFT | SR 2 SHIFT | Q16 | Q17 | Q18 | Q19 | Q20 | Q21 | Q22 | Q23 | Q24 | Q25 | Q26 | Q27 | Q28 | Q29 | Q30 |
|---|---|---|---|---|---|---|---|---|---|---|---|---|---|---|---|---|---|---|---|---|---|---|---|---|---|---|---|---|---|---|---|---|---|
| 1 | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n-15}$ | | | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-30}$ |
| 2 | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | → | → | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ |
| 3 | ↑ | ↑ | ↑ | ↑ | ↑ | ↑ | ↑ | ↑ | ↑ | ↑ | ↑ | ↑ | ↑ | ↑ | ↑ | ↑ | | INHA | ↑ | ↑ | ↑ | ↑ | ↑ | ↑ | ↑ | ↑ | ↑ | ↑ | ↑ | ↑ | ↑ | ↑ | ↑ |
| 4 | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | → | | ↑ | ↑ | ↑ | ↑ | ↑ | ↑ | ↑ | ↑ | ↑ | ↑ | ↑ | ↑ | ↑ | ↑ | ↑ |
| 5 | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | → | → | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ |
| 6 | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | → | → | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ |
| 7 | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | → | → | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ |
| 8 | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | → | → | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ |
| 9 | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | → | → | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ |
| 10 | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | → | → | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ |
| 11 | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | $X_{n-6}$ | → | → | $X_{n-22}$ | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ |
| 12 | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | $X_{n-5}$ | → | → | $X_{n-23}$ | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ |
| 13 | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | $X_{n-4}$ | → | → | $X_{n-24}$ | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ |
| 14 | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | $X_{n-3}$ | → | → | $X_{n-25}$ | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ |
| 15 | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | $X_{n-2}$ | → | → | $X_{n-26}$ | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ |
| 16 | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | $X_{n-1}$ | → | → | $X_{n-27}$ | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ |
| 17 | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | $X_n$ | → | → | $X_{n-28}$ | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ |
| 18 | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | $X_{n+1}$ | → | → | $X_{n-29}$ | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ |
| 19 | $X_{n+1}$ | $X_n$ | $X_{n-1}$ | $X_{n-2}$ | $X_{n-3}$ | $X_{n-4}$ | $X_{n-5}$ | $X_{n-6}$ | $X_{n-7}$ | $X_{n-8}$ | $X_{n-9}$ | $X_{n-10}$ | $X_{n-11}$ | $X_{n-12}$ | $X_{n-13}$ | $X_{n-14}$ | → | → | $X_{n-15}$ | $X_{n-16}$ | $X_{n-17}$ | $X_{n-18}$ | $X_{n-19}$ | $X_{n-20}$ | $X_{n-21}$ | $X_{n-22}$ | $X_{n-23}$ | $X_{n-24}$ | $X_{n-25}$ | $X_{n-26}$ | $X_{n-27}$ | $X_{n-28}$ | $X_{n-29}$ |

ADDITION, MULTIPLICATION AND ACCUMULATION

ODD NUMBER (31) ORDER "FIR" TYPE FILTER

FIG. 19b

EXAMPLE OF FILTER CHARACTERISTICS CHANGING WITH LAPSE OF TIME

ELECTRONIC MUSICAL INSTRUMENT WITH DIGITAL FILTER

BACKGROUND OF THE INVENTION

This invention relates to a tone signal processing device utilizing a digital filter and, more particularly, to a device of this type used in an electronic musical instrument or other instrument having a tone generation function or a digital voice processing device. Further, this invention relates to a tone signal processing device used in an electronic musical instrument of a type which generates a digital tone signal in plural channels on a time shared basis and, more particularly, to a device of this type controlling a generated digital tone signal with a digital filter and resampling it in synchronization with the pitch of the tone.

Use of a digital filter in a tone color circuit in an electronic musical instrument is disclosed, for example, in Japanese Preliminary Patent Publication No. 59-44096. The prior art digital filter carries out a filter operation with a regular sampling period which is determined depending upon the system in which the digital filter is used and filter characteristic obtained thereby is a fixed formant.

If a filter characteristic of a moving formant is to be realized in the tone color circuit using such digital filter, filter coefficient must be changed in accordance with the pitch of a tone signal applied to the circuit. This requires a large number of filter coefficients with a result that filter coefficient memory means of a large capacity is required and hence the device becomes of a large and complicated construction.

Further, in the prior art tone color circuit using the digital filter, means as shown in FIG. 33 for example is adopted as another means for realizing the moving formant filter characteristic. In this device, digital filters DF1–DFn realizing mutually different fixed formant characteristics for a plurality of tone pitches are provided in parallel, a digital tone signal is applied to a distributor DSTRB and the tone signal is distributed to one of the digital filters DF1–DFn in accordance with the pitch of the applied tone signal. The characteristic of each of the digital filters DF1–DFn is a fixed formant characteristic which is different depending upon the corresponding pitch so that these digital filters DF1–Dfn are used selectively in accordance with the pitch of the tone to be generated and filtering of a moving formant characteristic can be realized in effect by combining these digital filters DF1–DFn. This construction, however, requires a large number of digital filters so that this device also requires a large and complicated construction.

In an electronic musical instrument generating a tone signal in a digital fashion, the sampling frequency is not necessarily harmonized with the pitch of the tone and this gives rise to a problem of aliasing noise. For eliminating the problem of aliasing noise, a pitch synchronization technique is employed in which the sampling frequency is harmonized with the pitch of the tone. As an example of such prior art using the pitch synchronization technique, it is practiced to resample, with a sampling period which is synchronized with the pitch, a digital tone signal generated with a sampling period which is not synchronized with the pitch (U.S. Pat. No. 4,377,960).

On the other hand, to employ a digital filter in a tone color circuit of an electronic musical instrument is disclosed in, for example, the above mentioned Preliminary Patent Publication No. 59-4409. In employing a digital filter in a tone color circuit, however, it has not been conceived how the pitch synchronization should be realized.

If the prior art digital filter is simply applied to an electronic musical instrument of a pitch synchronizing type, a device realized will be one as shown in FIG. 34. In this device, digital tone signals of plural channels (n) generated on a time shared basis from a tone generation circuit 140 are latched by first latch circuits **1411–141*n* provided for the respective channels in response to timings signals CH1–CHn corresponding to the respective channels whereby the tone signals are released from the time division multiplexed state. Then outputs of the first latch circuits 1411–141*n* are latched by second latch circuits 1421–142*n* in response to pitch synchronizing pulses PSP1–PSPn synchronized with pitches of tones assigned to the respective channels whereby resampling synchronized with the pitches of the tones is performed. The digital filters DF1–DFn are provided in parallel for the respective channels so as to perform filtering channel by channel independently from one another and digital tone signals in a pitch synchronized state provided by the second latch circuits 1421–142*n* are respectively applied to these digital filters DF1–DFn. The operation speed of each circuit in such device will now be considered taking an example. Assume, for example, that the sampling frequency of a tone signal in the tone generation circuit 140 is a fixed rate in the order of 50 kHz. Since resolution of timing of generation of the pitch synchronizing pulses PSP1–PSPn is common multiple of the sampling frequency 50 kHz and the pitch of a tone, it becomes for example a high rate in the order of 400 kHz. Accordingly, the operation rate of the digital filters DF1–DFn must be one which is matched with the resolution 400 kHz of the sampling rate of the second latch circuits 1421–142*n*. If operation of respective filter orders for the digital filters DF1–DFn is to be performed in these digital filters DF1–DFn, the filter operation must be performed with an even higher rate which is 400** kHz multiplied by the order.

In the conventional digital filter, if a filter order is fixed to a predetermined order for reasons of circuit design, the order of the filter circuit is fixed to this order in terms of hardware construction. For this reason, there has been the problem that a filter characteristic (i.e., amplitude-frequency characteristic) realizable is limited depending upon the order fixed in terms of hardware construction. For example, frequency response characteristic of a filter of an odd number order having an impulse response shown in FIG. 6 is as shown in FIG. 8 whereas frequency response characteristic of a filter of an even number order having an impulse response shown in FIG. 7 is as shown in FIG. 9. When the order N is an odd number, level at $\omega=\pi$ (where $\pi$ corresponds to $\frac{1}{2}$ of sampling frequency fs) is not fixed to 0 but can be set at any desired value as shown in FIG. 8. When N is an even number, the level at $\omega=\pi$ becomes always 0. As will be apparent from this, when the order N is an odd number, a high-pass filter characteristic can be realized by establishing a filter coefficient suitably but when the order N is an even number, it is difficult to realize a high-pass filter characteristic. Thus, the prior art device has the problem that there is a filter characteristic which it is impossible or difficult to realize with a order fixed in terms of hardware construction. For overcoming this problem, it is conceivable to provide plural filters of different characteristics in parallel or in series but this gives rise to another problem that hardware construction becomes enlarged.

Further, in the conventional digital filter, filter coefficients must be prepared individually in correspondence to all orders (i.e., in correspondence to all orders from 0-th to N−1-th in the case of a filter of N-th orders). This causes the problem that a filer coefficient supply device (e.g., a coefficient memory) becomes large. Besides, in designing a desired filter characteristic, values of filter coefficients of all orders must be considered and this involves a troublesome calculation. Particularly in a filter for a tone signal, the filter characteristic should preferably be established at a linear phase characteristic (i.e., phases of input and output waveshapes corresponding in complete linear characteristic), for such linear characteristic is not likely to produce distortion in the output waveshape.

Further, in the conventional digital filter, supply of filter parameters is performed in a single channel. For example, sets of parameters corresponding to various tone colors are stored in a filter parameter memory and a set of parameters corresponding to a selected tone color are read out and supplied to the filter. In this case, timewise change of the tone color can be effected by timewise changing parameters. Since, however, values of one set of parameters must be changed continuously, plural sets of parameters must be prepared in correspondence to one selectable tone color. Since the memory capacity of a memory is limited, the number of tone colors for which parameters can be stored is limited. Moreover, if parameters corresponding to tone colors which do not undergo timewise change and tone colors which undergo timewise change are to be stored together in a memory of a single channel, readout control must be made separately for these two types of tone colors which involves a troublesome operation. Besides, since the number of sets of parameters corresponding to the tone color is different one tone color from another, distribution of the number of addresses is troublesome and there is also likelihood that some addresses are wasted without being used.

Further, in a prior art tone color circuit of an electronic musical instrument using a digital filter, a set of filter parameters are supplied to digital filter and a filter characteristic (amplitude-frequency characteristic) is established in accordance with the supplied filter parameters. Filter parameters of plural sets are prestored in a memory in accordance with contents of tone color determining factors and a set of filter parameters are read out in accordance with contents of selected tone color determining factors.

In the prior art tone color circuit, if different tone color control is to be performed depending upon plural tone color determining factors (e.g., key touch, tone range, constant tone color selection information, information according to lapse of time, an amount of operation of a manual operator such as a brilliance operator etc.), plural sets of filter parameters must be stored in the memory with one-to-one correspondence to respective combinations of tone color determining factors. For example, in a case where filter parameters are stored individually in one-to-one correspondence to all combinations (22528 combinations) of forty-four tone ranges, sixteen key touch groups and thirty-two kinds of constant tone colors, the parameter memory is required to have a large capacity capable of storing 22528 sets of parameters.

SUMMARY OF THE INVENTION

It is, therefore, the first object of the invention to provide a tone signal processing device having a digital filter capable of realizing a filter characteristic of a moving formant with a simple construction.

It is another object of the invention to provide a tone signal processing device capable of performing pitch synchronization of a tone signal without imposing an excessive burden upon the operation speed of a digital filter.

It is another object of the invention to provide a tone signal processing device having a digital filter capable of realizing many filter characteristics with simple hardware construction.

It is another object of the invention to provide a tone signal processing device having a digital filter in which a device for supplying filter coefficients is simplified, establishing of filter coefficients is facilitated and a linear phase characteristic which is desirable for a filter for a tone signal is readily obtainable.

It is another object of the invention to provide a tone signal processing device having a digital filter capable of efficiently supplying both parameters corresponding to tone colors which do not undergo timewise change and tone colors which undergo timewise change by selectively supplying either of them thereby effectively realizing any of tone colors which do not change during sounding of a tone and tone colors which change during sounding of the tone.

It is still another object of the invention to provide a tone signal processing device having a filter parameter supply device capable of saving capacity of a filter parameter memory in a case where a set of filter parameters are supplied to a digital filter in accordance with a combination of tone color determining factors (parameter determining factors).

For achieving the above described objects, the tone signal processing device according to the invention comprises pitch synchronizing signal generation means for generating a pitch synchronizing signal synchronized with the pitch of a digital tone signal to be filtered and digital filter means for receiving the digital tone signal and performing a filter operation on the digital tone signal with a sampling period synchronized with the pitch synchronizing signal generated by the pitch synchronizing signal generation means.

According to the invention, designating means for designating either one of synchronization/non-synchronization may further be provided and the digital filter means may perform the filter operation on the digital tone signal every predetermined period irrelevant to the pitch of the digital tone signal in place of the pitch predetermined by the pitch synchronizing signal when the non-synchronization is designated by said designatiion means.

According to the invention, the sampling period with which the filter operation is performed in the digital filter means is not a fixed period but a period synchronized with the pitch of the applied digital tone signal. The position of formant in the digital filter is determined on the basis of the sampling frequency. Accordingly, if the sampling frequency of the filter operation is changed in synchronism with the pitch, filter characteristic obtained becomes a moving formant in which formant position moves in synchronism with the pitch.

By switching a filter operation period between a period synchronized with the pitch and a predetermined common period in response to the pitch synchronization/non-synchronization designation signal, the moving formant is realized during the pitch synchronized operation whereas the fixed formant is realized during the pitch non-synchronized operation. Accordingly, selection between the moving formant and the fixed formant can be readily made in accordance with a feature of a tone to be sounded (e.g., tone color). For the means for generating a pitch synchronization/non-synchronization designation signal, suitable means such as a tone color selection switch, an effect selection switch, an exclusively used switch and data of playing supplied from outside may be used and the synchronization/non-synchronization switching of the filter operation can be made in association with selection of the tone color, effect etc. or in response to application of data from outside.

According to the invention, therefore, the moving formant can be realized with the very simple construction that the filter operation is performed with a sampling period synchronized with the pitch so that the device can be made simply and at a low cost.

Further, since the pitch synchronization/non-synchronization of the filter operation can be performed in a simple manner, switching between the moving formant and the fixed formant can be made as desired in accordance with a feature of a tone color to be realized by the digital filter or a feature of an effect imparted to the tone.

The tone signal processing device achieving the other object of the invention is characterized in that it comprises tone generation means for generating digital tone signals in plural channels on a time shared basis, digital filter means for receiving the digital tone signals of plural channels generated by the tone generation means and performing a filter operation channel by channel on a time shared basis, pitch synchronization signal generation means for generating pitch synchronizing signals synchronized with pitches of the tone signals of the respective channels and pitch synchronized output means for sampling and outputting the tone signals of the respective channels provided by the digital filter means in response to the pitch synchronizing signals generated in correspondence to the respective channels.

According to the invention, the pitch synchronization output means is provided on the output side of a digital filter circuit and the pitch synchronizing processing, i.e., resampling processing by the pitch synchronizing signal, is performed for a filter output signal. Accordingly, the operation rate in the digital filter means has only to correspond to a time division rate of the tone signal generated by the tone generation means and need not correspond to a time division rate of the tone signal generated by the tone generation means. For this reason, the operation speed of the digital filter circuit need not be such a high one so that the burden imposed on the circuit is alleviated. Assuming, for example, that the sampling frequency of the tone signal generated by the tone generation means is 50 kHz, the operation period of the digital filter circuit has only to be one whose one period is 50 kHz.

According to the invention, therefore, an aliasing noise can be eliminated by causing the sampling frequency of the tone signal to be harmonized with the pitch of the tone by the pitch synchronizing processing and moreover such a high speed as the resolution of the pitch synchronizing signal is not required for the operation speed of the digital filter circuit and, accordingly, the burden on the circuit is alleviated and the circuit can be made compact and manufactured at a lower cost. Further, since the digital filter circuit can be constructed in such a manner that processing for a plurality of channels can be performed on a time shared basis, the circuit can be made compact and manufactured at a lower cost in this respect also. For comparison, according to the construction as shown in FIG. 36, a high speed operation is required for the digital filter circuit so that it is difficult to cause it to be operated in plural channels on a time shared basis so that the parallel type circuit as shown in the figure has to be adopted. In the present invention, such disadvantage in the prior art has been eliminated.

For achieving the other object of the invention, the tone signal processing device according to the invention is characterized in that it comprises digital filter means to which digital sampled value data of a tone signal, parameter generation means for generating an odd/even parameter which establishes order of a filter operation to either an even number or an odd number and switching means for switching order of delay in the sampled value data used in the filter operation in the digital filter circuit between a predetermined even number order and a predetermined odd number order in response to the even/odd parameter.

According to the invention, the digital filter means selectively operates either as a filter of an even number order or one of an odd number order in accordance with the delay order switching operation by the switching means in response to the even/odd parameter. By this arrangement, the operation of the digital filter circuit can be switched either to the filter of an even number order or that of an odd number order depending upon a tone color to be realized so that a desired filter characteristic suited to that tone color can be realized. For example, the operation is established to the filter of the odd number order when a tone color suitable for a control by a high-pass filter characteristic is to be realized whereas it is established to the filter of the even number order when a control by a band-pass or low-pass filter characteristic is suitable is to be realized.

According to the invention, therefore, by switching the order of delay in the sampled value data used in the filter operation in the digital filter circuit between an even number order and an odd number order in response to the even/odd parameter so that filter characteristics of both the even and odd number orders can be realized without enlarging the hardware construction of the filter circuit whereby a tone color control with richer variety can be achieved by a filter circuit which is saved both in its construction and cost.

For achieving the other object of the invention, the tone signal processing device according to the invention is characterized in that it comprises coefficient supply means for supplying, for filter operation of N-th order, filter coefficients for N/2 orders when N is an even number and filter coefficients for $(N+1)/2$ orders when N is an odd number, delay means for successively delaying digital tone signal sampled value data and thereby providing sampled value data of N-th order, and operation means for performing a predetermined filter operation including multiplying respective two sampled value data positioned at symmetrical positions with respect to the center of N degrees among the sampled value data of N orders in the delay means with a common one of the filter coefficients and multiplying respective sampled value data of plural sets of the two sampled value data (N/2 sets when N is an even number and (N−1) sets when n is an odd number) with said filter coefficients while multiplying the sampled value data positioned at the center of the symmetry with a sole filter coefficient when N is an odd number.

According to the invention, the input digital tone signal sampled value data is successively delayed by the delay means and sampled value data for N orders are thereby supplied. Filter coefficients k0–ki for N/2 orders or (N+1)/2 orders are supplied by the coefficient supply means depending upon whether N is an even number or an odd number. In the operation means, respective two sampled value data positioned at symmetrical positions with respect to the center of N orders in the sampled value data of N orders are multiplied with a common filter coefficient.

When N is an even number, the filter coefficients k0–ki for N/2 orders are supplied from the coefficient supply means and in this case i=(N−2)/2. The data of midway between the (N−2)/2-th order and the N/2 order becomes the center of symmetry and data of the 0-th to the i-th orders and data of the i+1-th to the N−1-th orders on either side of the central data are positioned at symmetrical positions. There are N/2 pairs of two sampled value data positioned at symmetrical positions. Accordingly, two sampled value data positioned at symmetrical positions are respectively multiplied with a common filter coefficient (one of k0–ki) which is common to the sampled value data of each pair in such a manner that, for example, tone signal sampled value data $S_0$ of the 0-th order and tone signal sampled value data $S_{N-1}$ of the N−1-th order are multiplied with a common filter coefficient k and tone signal sampled value data Si of the i-th order and tone signal sampled value data $S_{i+1}$ of the i+1-th order are multiplied with a common filter coefficient ki. By this arrangement, filter coefficients k0–ki, $ki_{+1}-k_{N-1}$ corresponding to the respective orders 0 to N−1 in the digital filter of N orders (N=an even number) are established in a symmetrical characteristic in effect. Besides, filter coefficients which must be actually prepared has only to be half of the number of orders required. An example of impulse response in the case where the filter coefficients of even number orders are established in a symmetrical characteristic is shown in FIG. 7.

When N is an odd number, filter coefficients k0−ki for (N+1)/2 orders are supplied by the coefficient supply means and in this case i=(N−1)/2. The sampled value data at i=(N−1)/2-th order becomes the central data and sampled value data of 0-th to i−1th orders and sampled value data of i+1-th to N−1-th orders on either side of the central data are positioned at symmetrical positions. There are (N−1)/2 pairs of sampled value data $S_0$ and $S_{N-1}$, $S_1$ and $S_{N-2}$ . . . , $Si_{+1}$ which are respectively positioned at symmetrical positions. Accordingly, two sampled value data positioned at the symmetrical positions are multiplied with a filter coefficient (one of $k0-k_{-1}$) which is common to sampled value data of each pair in such a manner that, for example, tone signal sampled value data $S_0$ of the 0-th order and tone signal sampled value data $S_{N-1}$ of the N−1-th order are multiplied with a common coefficient k0 and tone signal sampled value data $S_{i-1}$ of the i−1-th order and tone signal sampled value data $S_{i+1}$ of the i+1-th order are multiplied with a common coefficient $ki_{-1}$. However, tone signal sampled value data Si of the i=(N−1)/2-th order which is positioned at the central position of symmetry is multiplied with a sole filter coefficient ki. By this arrangement, filter coefficients k0–$ki_{-1}$, ki, $ki_{+1}$–$k_{N-1}$ corresponding to respective orders 0 to N−1 of the digital filter of the N-th order (N=an odd number) are established in a symmetrical characteristic in effect. Filter coefficients which must be actually prepared has only to be half plus one of the number of orders required. An example of impulse response in the case where the filter coefficients of odd number orders are established in a symmetrical characteristic is shown in FIG. 6.

As will be apparent from FIGS. 6 and 7, by establishing the filter coefficients in a symmetrical characteristic, the impulse response exhibits a symmetrical characteristic centered at n=(N−1)/2 (it is assumed that h(n) represents a filter coefficient and $0 \leqq n \leqq N-1$). When N is an odd number, the (N−1)/2-th order becomes the center and impulse responses on both sides thereof become symmetrical. When N is an even number, midway between the (N−2)/2-th and the N/2-th becomes the center and impulse response on both sides thereof become symmetrical. Such symmetrical characteristic of the impulse response is a necessary and sufficient condition for an FIR filter having a linear phase characteristic. According to the present invention, therefore, a filter of linear phase characteristic can be constructed with ease. By employing the linear phase characteristic, phases of input and output waveshapes of a filter correspond to each other in completer linearity with a result that the output waveshape is free from distortion. Accordingly, the invention is most suitable for filter processing of signals of musical tone, voice and audio devices.

According to the invention, therefore, it will be sufficient for filter operation of the N-th order to prepare filter coefficients for N/2 orders in the case where N is an even number and for (N+1)/2 orders in the case where N is an odd number so that construction of the filter coefficient supply means (e.g., a memory) can be simplified. Further, by multiplying two sampled value data positioned at symmetrical positions with a common filter coefficient, a filter characteristic whose impulse response exhibits a symmetrical characteristic can be realized so that a filter of linear phase characteristic suited for filter processing of signals of tone, voice and audio devices can be readily realized. Furthermore, the number of filter coefficients has only to be half the number of required orders and this facilitates establishment of filter coefficients.

For achieving the other object of the invention, the tone signal processing device according to the invention is characterized in that it comprises digital filter means to which digital sampled value data of a tone signal is applied, first filter parameter supply means for supplying a set of first filter parameters which do not undergo timewise change, second filter parameter supply means for supplying a set of second filter parameters which undergo timewise change and selection means for selecting either one of the first and second filter parameters and supplying the selected filter parameters to the digital filter means.

According to the invention, in a case where a tone color which does not undergo timewise change during sounding of the tone is to be selected, the selection means selects the first filter parameters supplied by the first filter parameter supply means. By the first filter parameters, the digital filter means is established to a characteristic which realizes a predetermined tone color which does not undergo timewise change during sounding of the tone. When a tone color which undergoes timewise change during sounding of the tone is to be selected, the selection means selects the second filter parameters supplied by the second filter parameter supply means. By timewise change of the second filter parameters, the characteristic of the digital filter means undergoes timewise change whereby the timewise change in the tone color is realized.

In carrying out the invention, the number of order of filter coefficients constituting a set of the second filter parameters are preferably made a smaller number than the number of order of filter coefficients constituting a set of the first filter parameters. In this case, the first and second filter parameter supply means should preferably provide filter coefficients of respective orders constituting a set of filter parameters serially on a time shared basis. By providing the filter coefficients of respective orders serially on a time shared basis, the circuit construction and wiring thereof can be simplified. Since, however, data transmission time is limited, the number of orders which can be transmitted during this time is also limited. When, particularly, filter parameters are to be changed in real time, ample time cannot be spared for data transmission and, for this reason, the number of orders filter coefficients constituting a set of filter parameters should preferably be decreased. Conversely, when the filter parameters are not to be changed timewise, more data transmission time can be spared than in the above described case so that the number of orders of filter coefficients constituting a set of filter parameters should preferably be increased to improve reproducibility of a desired tone color.

According to the invention, therefore, by supplying the first filter parameters which do not undergo timewise change and the second filter parameters which undergo timewise change by separate filter parameter supply means, the respective filter parameter supply means can perform storing and reading out of the parameters individually and independently from each other. This enables the filter parameters to be processed in a manner which is most suited to each type of parameters.

For achieving the other object of the invention, the filter parameter supply device according to the invention is characterized in that it comprises parameter memory means for storing plural sets of filter parameters, parameter address memory means for storing addresses in the parameter memory means for filter parameters to be read out from the parameter memory means in accordance with a combination of parameter determining factors and readout means for reading out address data from the parameter address memory means in accordance with the combination of the parameter determining factors and reading out a set of filter parameters from the parameter memory means in accordance with the read out address data. As data representing the parameter determining factors, such factors as, for example, a key code representing a depressed key, touch data representing the key touch a tone color code representing a selected constant tone color, information according to lapse of time and suitable manual operator output information.

According to the invention, the filter parameters are not directly read out from the parameter memory means in accordance with the combination of the parameter determining factors but the address data for accessing the parameter memory means is read out first from the parameter address memory means and a set of filter parameter are read out from the parameter memory means in accordance with this address data. Accordingly, it is the parameter address memory means and not the parameter memory means that stores data in one-to-one relation in correspondence to the combination of the parameter determining factors. The parameter address memory means which stores only the address data does not require a large memory capacity. The parameter memory means which stores plural sets of filter parameters each set of which consists of filter coefficients of plural orders requires a relatively large memory capacity. Since, however, the invention has adopted an indirect address system according to which the parameters are read out in response to the address data stored in correspondence to combinations of the parameter determining factors, it is not necessary to store filter parameters in one-to-one relation for all combinations of the parameter determining factors so that the parameter memory means has only to store fewer sets of parameters than the number of combinations. In other words, even in different combinations of the parameter determining factors, common filter parameters can be used in some cases so that the number of sets of parameters stored in the parameter memory means may be reduced and the memory capacity may thereby be saved. It is shown in an embodiment of the invention to be described later that, for example, only 2620 sets of parameters need to be stored in the parameter memory means to cope with 22528 combinations consisting of a tone range, key touch and tone color kind. In this case, address data read out from the parameter address memory means in accordance with a certain combination of the parameter factors can be the same as address data read out in accordance with another combination. In this case, the same address data is read out from the parameter memory means in correspondence to each of these different combinations.

According to the invention, therefore, the number of sets of parameters stored in the parameter memory means can be made smaller than a total number of combinations of the parameter determining factors with resulting saving in the memory capacity. When, particularly, a subtle tone color control is to be realized by various combinations of many types of parameter determining factors such as key touch, tone range and lapse of time, such tone color control can be realized with a reduced parameter memory construction.

Preferred embodiments of the invention will now be described with reference to the accompanying drawings.

BRIEF DESCRIPTION OF THE DRAWINGS

In the accompanying drawings,

FIGS. 19(*a*) and 19(*b*) are schematic diagrams for explaining the basic operation of the FIR type operation in a case where a filter characteristic consisting of odd number orders (31 orders) in the same digital filter circuit shown in FIG. 14;

DESCRIPTION OF PREFERRED EMBODIMENTS

Figure 1:
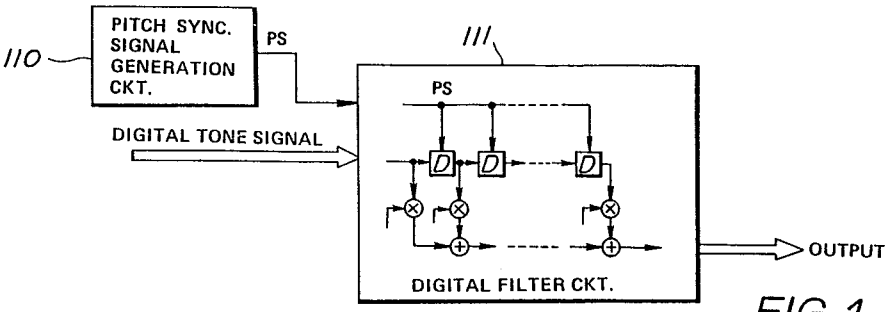
FIG. 1 is a block diagram schematically showing an embodiment of the tone signal processing device according to the invention.

FIG. 1 shows a most simplified embodiment in which a digital filter circuit 111 is assumed to receive a digital tone signal of a monophonic type. A pitch synchronizing signal generation circuit 110 generates a pitch synchronizing signal synchronized with the pitch of this digital tone signal. The digital filter circuit 111 performs a filter operation for this digital tone signal with a sampling period synchronized with a pitch synchronizing signal PS generated by the pitch synchronizing signal generation circuit 110. The digital filter circuit 111 consists of, for example, an FIR filter as generally shown in its block and performs the filter operation synchronized with the pitch by utilizing the pitch synchronizing signal PS as a sampling clock signal of unit delay D.

The sampling period with which the filter operation is performed in the digital filter circuit 111 is not a fixed period but a period synchronized with the pitch of the input digital tone signal. The position of formant in a digital filter is determined on the basis of the sampling frequency. If, accordingly, the sampling period of the filter operation is changed in synchronism with the pitch, a filter characteristic obtained becomes a moving formant in which the formant position moves in synchronism with the pitch.

[Description of overall construction of a specific embodiment]

Figure 2:
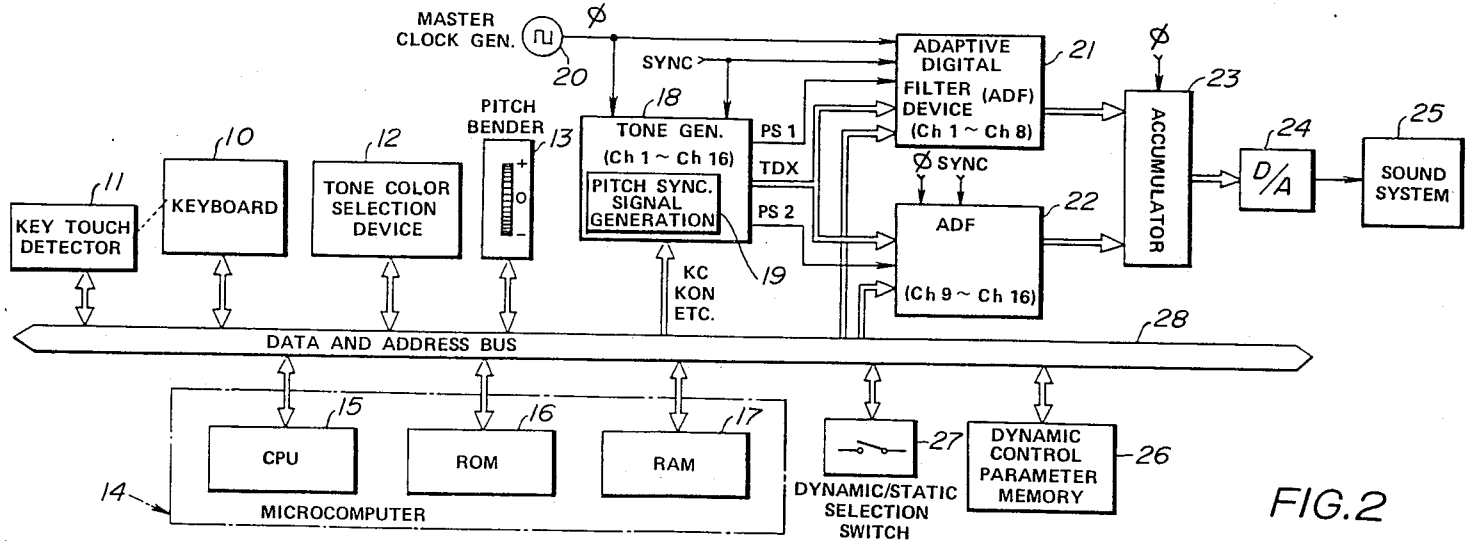
FIG. 2 is a block diagram showing an overall construction of a specific embodiment of an electronic musical instrument to which this invention has been applied.

FIG. 2 shows an overall construction of a specific embodiment of an electronic musical instrument to which the present invention has been applied. In the figure, an electronic musical instrument capable of polyphonic tone generation in plural tone generation channels is illustrated. Processing of signals or data corresponding to respective channels is performed on a time shared basis and a pitch synchronizing signal and a digital tone signal of a tone assigned to each channel are generated in synchronism with their corresponding channel timing.

Referring to FIG. 2, a keyboard 10 comprises keys for designating tone pitches of tones to be generated. A key touch detector 11 is provided for detecting touch applied to a key which has been depressed in the keyboard 10. The touch to be detected may either be an initial touch or an after touch. A tone color selection device 12 consists of an operator group for selecting tone colors of tones to be generated. A pitch bender 13 is provided for continuously modifying the pitch of a tone to be generated in accordance with the amount of manipulation of the operator and consists of, e.g., a dial type operator. A microcomputer 14 comprises a CPU (central processing unit) 15, a ROM (read-only memory) 16 for storing a program and other data and a RAM (random-access memory) 17 for working and storing data. The microcomputer 14 sends and receives data to and from various circuits in an electronic musical instrument through a data and address bus 28 and thereby performs various processings including detection of depressed keys in the keyboard 10 and assignment of the depressed keys to tone generation channels, detection of a tone color selection operation in the tone color selection device 12 and detection of the amount of manipulation of the pitch bender 13.

A tone generator 18 is capable of generating digital tone signals individually and independently in the respective tone generation channels. The tone generator 18 receives a key code KC representing keys which have been assigned to the respective channels, a key-on signal KON representing on-off of these keys and other necessary data from the microcomputer 14 through th bus 28 and, responsive to these data, generates digital tone signals in the respective channels. The tone generator 18 comprises a pitch synchronizing signal generation circuit 19 which generates, for each channel, a pitch synchronizing signal which is synchronized with the pitch of the tone signal generated in each channel.

Figure 3:
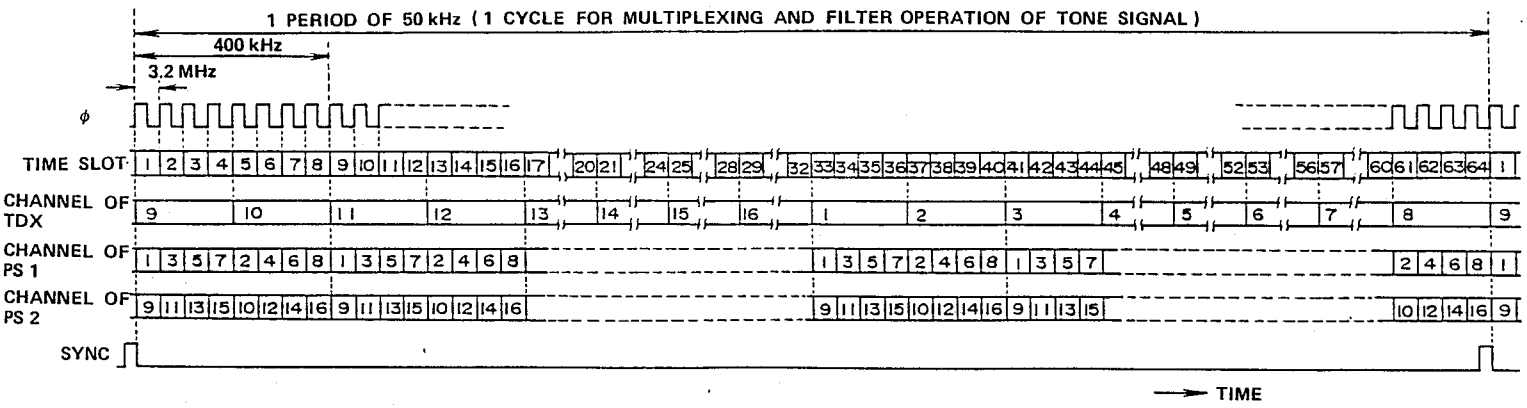
FIG. 3 is a time chart of principal signals in the embodiment shown in FIG. 2.

In this embodiment, the tone generator 18 generates digital tone signals on a time shared basis in sixteen channels of the first through sixteenth channels (Ch1–Ch16). Digital tone waveshape sampled value data produced by the tone generator 18 in a time division multiplexing fashion is represented by TDX. A master clock pulse $\phi$ generated by a master clock generator 20 is used for controlling a basic operation time of the tone generator 18. One cycle of time division multiplexing of the digital tone waveshape sampled value data TDX is 64 periods of the master clock pulse $\phi$ and time slots for respective periods of this one cycle-64 periods are shown in FIG. 3 with numbers 1–64 being affixed to these time slots. In FIG. 3, specification of channel timings 1–16 of the multiplexed digital tone waveshape sample value data TDX is also shown. For example, data TDX of the first channel is assigned to four slots of time slots 33–36.

In this embodiment, the tone waveshape sampled value data TDX is produced in such a manner that, as described above, data of the sixteen channels are multiplexed together. Pitch synchronizing signals PS1 and PS2 for the respective channels, however, are produced in two series such that they are time division multiplexed for eight channels in each of the two series. The pitch synchronizing signal PS1 consists of time division multiplexed pitch synchronizing signals of the first through eighth channels (Ch1–Ch8) and its channel timing is as shown in FIG. 3. The pitch synchronizing signal PS2 consists of time division multiplexed pitch synchronizing signals of the ninth through sixteenth channels (Ch9–Ch16) and its channel timing is as shown in FIG. 3. As will be apparent from FIG. 3, the pitch synchronizing signals PS1 and PS2 of the respective channels are generated with a width of one time slot and one cycle of its time division multiplexing is eight time slots.

Adaptive digital filter devices (hereinafter sometimes referred to as "ADF") 21 and 22 in two series are adapted for filtering of tone signals and, in the present embodiment, are respectively capable of filtering tone signals of eight channels, i.e., the ADF 21 filtering the tone signals of the first through eighth channels and the ADF 22 filtering the tone signals of the ninth through sixteenth channels. Each of the ADFs 21 and 22 comprises circuits of various functions including a digital filter circuit of a certain type, a filter parameter memory, various circuits for controlling supply of filter parameters, a control circuit for effecting a filter computation operation in synchronism with the pitch of a tone signal to be filtered and a pitch synchronized output circuit for producing a filtered tone signal in synchronism with the pitch of the tone signal whereby the ADF is of a construction suitable for filtering a tone signal.

The digital tone waveshape sampled value data TDX provided by the tone generator 18 is applied to the ADFs 21 and 22. The pitch synchronizing signal PS1 for the first through eighth channels is applied to the ADF 21 and the pitch synchronizing signal PS2 for the ninth through sixteenth channels is applied to the ADF 22. In the ADFs 21 and 22, data TDX of the channels corresponding to the time slots in which the pitch synchronizing signals PS1 and PS2 are generated (i.e., turned to a signal "1") is loaded therein and thereupon its filter operation is performed with respect to one sampled value data of that channel. Accordingly, in one ADF 21, filter operation for the tone signals of the first through eighth channels is performed in response to the pitch synchronizing signal PS1 whereas in the other ADF 22, filter operation for the tone signals of the ninth through sixteenth channels is performed in response to the pitch synchronizing signal PS2. In this manner, unit time of the filter operation signal delay time synchronized with the sampling period) in the ADFs 21 and 22 is synchronized with the pitch of the tone signal to be filtered with a result that filtering of moving formant characteristics is realized by change of the filter operation unit time in accordance with the pitch. For controlling the basic operation timing of the circuit, the master clock pulse $\phi$ and a system synchronizing pulse SYNC are applied to the ADFs 21 and 22. The system synchronizing pulse SYNC is a pulse generated at a period of 64 time slots as shown in FIG. 3 and is synchronized with one cycle of the time division multiplexing of the digital tone signal. To the ADFs 21 and 22 are also applied various data for controlling the filter operation through the bus 28 and under the control of the microcomputer 14.

In the ADFs 21 and 22, not only the actual filter operation is performed in synchronism with the pitch of the tone signal to be filtered but also filtered tone waveshape sampled value data is resampled in synchronism with the pitch so that the data is provided in a completely pitch synchronized state. The pitch synchronizing signals PS1 and PS2 are utilized also for resampling the filtered data in synchronism with the pitch. .

Digital tone waveshape sampled value data of the respective channels provided by the ADFs 21 and 22 are summed together by an accumulator 23 to obtain tone waveshape sampled value data which is a sum of sampled value data of sixteen channels. The output data of the accumulator 23 is converted to an analog tone signal by a digital-to-analog converter 24 and this analog tone signal is supplied to a sound system 25 for sounding of the tone.

In this embodiment, supply of a filter coefficient is controlled in two modes. One of the modes is "static mode" which is a mode in which the filter coefficient is not changed during sounding of a tone and the other mode is "dynamic mode" which is a mode in which the filter coefficient is changed timewise during sounding of the tone whereby timewise change of the tone color is realized by filtering. A filter coefficient for the static mode is stored in the filter parameter memory in each of the ADFs 21 and 22. A filter coefficient for the dynamic mode is stored in a dynamic control parameter memory 26 and a timewise changed filter coefficient is read out from this memory 26 under the control of the microcomputer 14 and supplied to the ADFs 21 and 22 through the bus 28. A dynamic/static selection switch 27 is a switch for controlling selection of the mode in supplying the filter coefficient.

The frequency of the master clock pulse $\phi$ is about 3.2 MHz, the repetition frequency of time division one cycle of the pitch synchronizing signals PS1 and PS2 is 400 kHz and the repetition frequency of time division one cycle (one operation cycle in the filter) of the digital tone waveshape sampled value data TDX is 50 kHz.

Specific examples of the circuits in FIG. 2 will now be described.

[Generation of the pitch synchronizing signals]

Figure 4:
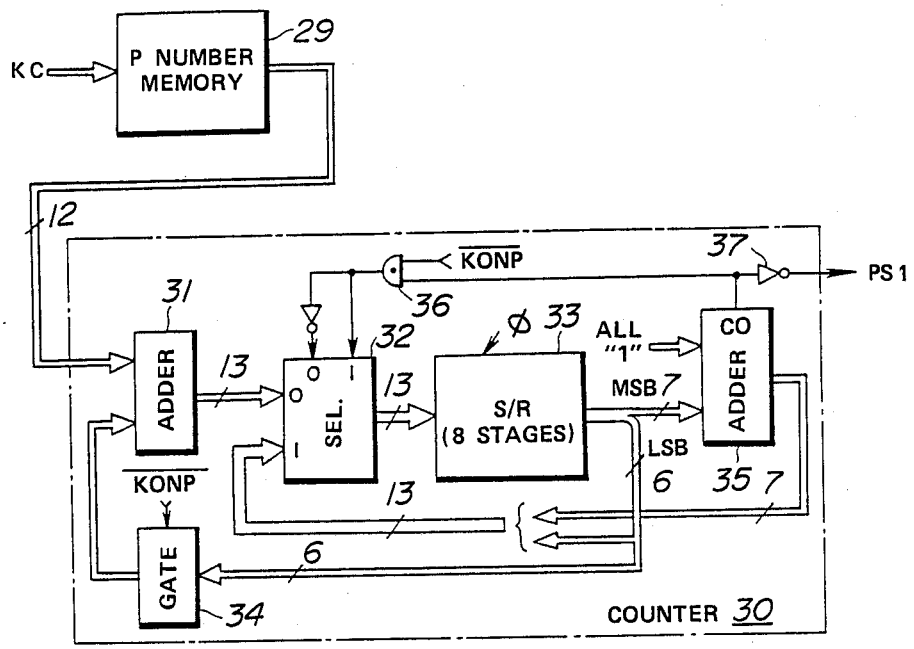
FIG. 4 is a block diagram showing an example of a pitch synchronizing signal generation circuit included in a tone generator in FIG. 2.

FIG. 4 shows an example of the pitch synchronizing signal generation circuit 19. This circuit 19 generates the pitch synchronizing signal PS1 of one series (the first through eighth channels). The pitch synchronizing signal PS2 of the other series is generated with a circuit of the same construction.

The pitch synchronizing signal PS1 is generated by counting a P number read out from a P number memory 29 for each channel on a time shared basis. The P number is a number representing the number of sample points of one cycle of a tone waveshape having a frequency corresponding to each of note names C-B in a certain standard octave. In a case where the pitch synchronizing signal PS1 is generated for eight channels on a time shared basis as shown in FIG. 3, the basic sampling frequency (in other words, resolution of the pitch synchronizing signal PS1) is a frequency of $\frac{1}{8}$ (e.g., 400 kHz) of the master clock pulse $\phi$ and this frequency is common through all note names. On the other hand, since the basic sampling frequency is common, the P number of each note name has a different value corresponding to its note name frequency. If the frequency of a certain note name in the standard octave is fn and the above described common sampling frequency (400 kHz) is fc, the P number corresponding to the note name is determined by the following equation:

$$\text{P number} = fc \div fn \quad (1)$$

If the common sampling frequency fc is 400 kHz and the frequency fn of a note name A is 440 Hz (i.e., A4 note), the P number of the note name A becomes P number of note name A = 400000 ÷ 440 = 909 from the above equation (1).

On the other hand, if the number of sample points for different sample point amplitude values for one cycle of a tone waveshape which can be generated in the tone generator 18 is 64, an effective sampling frequency fe of the frequency fn becomes $$fe = fn \times 64 \quad (2)$$

If fn is 440 Hz, the effective sampling frequency fe becomes $$fe = 440 \times 64 = 28160 \text{ Hz.}$$

In this manner, P numbers and effective sampling frequencies of respective note names in a certain standard octave can be determined as shown in the following table. In this table, the standard octave is one octave from G4 to F#5.

TABLE 1

| note name | pitch (Hz) | effective sampling frequency (kHz) | P number |
|---|---|---|---|
| G4 | 392.0 | 25.088 | 1020 |
| G#4 | 415.3 | 26.580 | 963 |
| A4 | 440.0 | 28.160 | 909 |
| A#4 | 466.2 | 29.834 | 858 |
| B4 | 493.9 | 31.609 | 810 |
| C5 | 523.3 | 33.488 | 764 |
| C#5 | 554.4 | 35.479 | 722 |
| D5 | 587.3 | 37.589 | 681 |
| D#5 | 622.3 | 39.824 | 643 |
| E5 | 659.3 | 42.192 | 607 |
| F5 | 698.5 | 44.701 | 573 |
| F#5 | 740.0 | 47.359 | 541 |

In a counter 30 in FIG. 4, the pitch synchronizing signal PS1 is obtained by frequency-dividing, in accordance with the P number, the common sampling frequency fc established in response to the master clock pulse $\phi$. As will be apparent from the foregoing description, the P number is the number of periods of the common sampling frequency fc in one cycle of waveshape, i.e., the number of sample points and the effective sample point number per one cycle of a tone waveshape which can be generated by the tone generator 18 is 64. If, accordingly, the frequency dividing number for frequency-dividing the common sampling frequency fc is $$\text{Frequency number} = \text{P number} \div 64 \quad (3)$$

64 shots of pulses per cycle of the tone can be obtained as the frequency divided output whereby all of the 64 effective sample points can be established. By frequency-dividing the common sampling frequency fc with the frequency dividing number determined in this manner, from the above equations (1), (2) and (3), $$fc \div \text{frequency dividing number} = (fn \times \text{P number}) \div (\text{P number} \div 64) = fn \times 64 = fe \quad (4)$$

By changing the sample point address by this frequency dividing number, the effective sampling frequency fe can be established. The effective sampling frequency fe established in this manner is harmonized with the note name frequency fn so that pitch synchronization can be realized. The pitch synchronizing signal PS1 of each channel generated by the counter 30 is the frequency divided output signal as shown by the above equation (4), i.e., a signal having the effective sampling frequency fe.

The frequency dividing number determined by the above equation (3) is not necessarily an integer but often includes a decimal number. For example, in the case of the note name A, $$\text{frequency dividing number} = 909 \div 64 \approx 14.20$$

The frequency dividing operation in the counter 30 therefore is performed, as will be described later, using two integers which are proximate to the frequency dividing number determined by the equation (3) so that the same result as obtained by frequency-dividing with the frequency dividing number determined by the equation In FIG. 4, a P number memory 29 prestores P numbers of respective note names in the standard octave as shown in Table 1. Key codes KC of keys which have been assigned to the respective channels are supplied to the tone generator 18 through the bus 28. In the tone generator 18, key codes KC for the first through eighth channels are time division multiplexed at a timing as shown in the channel timing of the synchronizing signal PS1 in FIG. 3 and key codes KC of the ninth through sixteenth channels are time division multiplexed at a timing as shown in the channel timing of the synchronizing signal PS2 in FIG. 3. The time division multiplexed key codes KC of the first through eighth channels are applied to the P number memory 29. The P number memory 29 provides P numbers corresponding to the note names of the applied key codes KC of the first through eighth channels on a time shared basis.

The counter 30 comprises an adder 31 receiving the P number read out from the P number memory 29, a selector 32 receiving the output of this adder 31 at its "0" input, a shift register 33 of eight stages receiving the output of this selector 32, a gate 34 gating less significant bits (i.e., decimal section) of the output of this shift register 33 and applying them to another input of the adder 31 and an adder 35 receiving more significant bits (i.e., integer section) of the output of the shift register 33 and adding them with an all "1" signal consisting of seven bits which are all "1". The P number itself is a binary coded signal of twelve bits but the output of the adder 31 is a signal of thirteen bits including one extra bit as a bit for a carry signal.

An inverted key-on pulse $\overline{\text{KONP}}$ and a signal provided from a carry output CO of the adder 35 are applied to an AND gate 36 and the output of this AND gate 36 in turn is applied to a selection control input of the selector 32. When the output signal of the AND gate 36 is "0", a signal supplied from the adder 31 to the "0" input of the selector 32 is selected whereas when the output signal of the AND gate 36 is "1", a signal supplied to the "1" input of the selector 32 is selected. To the "1" input of the selector 32 is applied a signal of thirteen bits consisting of less significant bits (decimal section) of the output of the shift register 33 and the seven bit output (integer section) of the adder 35. The key-on pulse KONP is a signal which is turned to "1" only once at an initial stage of depression of a key and key-on pulses corresponding to the first through eighth channels are time division multiplexed. The inverted key-on pulse $\overline{\text{KONP}}$ is a signal obtained by inverting this key-on pulse KONP.

The portion of the selector 32, the shift register 33 and the adder 35 is a circuit for establishing the frequency dividing number as shown in the above equation (3) in accordance with the P number and frequency dividing the common sampling frequency fc in accordance with the integer section of this frequency dividing number. The adder 31 is provided for adjusting the value of the integer section in accordance with the decimal section of the frequency dividing number.

Since in the above equation (3), the divisor 64 is $2^6$, no particular division is necessary for obtaining the frequency dividing number but the frequency dividing number corresponding to a P number can be established simply by treating less significant six bits of the P number as the decimal section. Accordingly, the less significant six bits in the thirteen bits of the output signal of the adder 31, the selector 32 and the shift register 33 constitute weight of the decimal section and the more significant seven bits constitute weight of the integer section.

The addition of the all "1" signal in the adder 35 is equivalent to subtraction of 1. The adder 35, therefore, virtually performs subtraction of 1 from the integer value of the output of the shift register 33. This result of subtraction in the adder 35 is fed back with six bit data of the decimal section which has not been operated to "1" input of the selector 32 and is applied again to the adder 35 through the shift register 33. Since the shift register 33 is controlled by the master clock pulse $\phi$, the period at which the same signal is produced by the shift register 33 is a period of eight times of the master clock pulse $\phi$, i.e., the period of the common sampling frequency fc.

In the initial stage of depression of a key, the inverted key-on pulse $\overline{\text{KONP}}$ is turned to "0" only once at a channel timing to which the key has been assigned and at this time the P number of the key is selected through the "0" input of the selector 32. The integer section of this P number is supplied from the shift register 33 to the adder 35 and 1 is repeatedly subtracted from this integer section at the period of the common sampling frequency fc. When the result of the subtraction in the integer section is 1 or a larger value, a carry out signal "1" is always provided from a carryout output CO of the adder 35 and thereby enables the AND gate 36 so that the selector 32 continues to select the "1" input. Upon reduction of the output of the adder 35 to "0" by repeated subtraction, i.e., upon elapse of periods of fc which is the same number as the integer section of the P number, the carryout signal of the adder 35 is not produced so that the AND gate 36 is not enabled. At this time, the selector 32 selects the "0" input thereby selecting the output of the adder 31 which is a sum of the P number and the less significant six bits (decimal section data) of the output of the shift register 33. Thus, the P number which has been somewhat modified by the addition of the decimal section is supplied to the shift register 33 and now subtraction of 1 from the integer value of the modified P number is repeated. The gate 34 is disabled by the inverted key-on pulse $\overline{\text{KONP}}$ only in the initial stage of depression of the key and otherwise supplies decimal section data to the adder 31. By the addition of the decimal section data to the P number in the adder 31, the integer value of the frequency dividing number which is actually used for frequency-dividing sometimes becomes larger by 1 than the integer value of the frequency dividing number obtained on the basis of the P number. For example, P number of the note name A is 909 and its frequency dividing number is 14.20. Initially, frequency-dividing is performed in accordance with its integer value 14. Then the number according to which frequency-dividing is performed becomes $14.20+0.20=14.40$ and at last 15.00 so that frequency-dividing is performed in accordance with its integer 15. In this manner, frequency-dividing of the common sampling frequency fc is performed in accordance with a number which is the same as the integer value of a frequency dividing number obtained on the basis of the P number or is larger by 1 than this integer value whereby frequency-dividing operation according to a frequency dividing number obtained on the basis of the P number is achieved as a result of averaging. The signal of the carryout output CO of the adder 35 corresponds to the frequency divided output of this frequency-dividing operation and a signal obtained by inverting this signal by an inverter 37 is provided as the pitch synchronizing signal PS1.

For better understanding of the above operation, an example of change of the output of the selector 32 will be described taking the note name A for example. The timing of change is the period of the common sampling frequency fc. The output initially is the frequency dividing number 14.20 corresponding to the P number 909. Then the output becomes 13.20 which is a number obtained by subtracting integer 1 from the above number. The output subsequently decreases in its integer by 1 successively in the order of 12.20, 11.20, 10.20, . . . 2.20, 1.20. At the fourteenth period of fc, the numerical value applied to the "1" input of the selector 32 becomes 0.20, the carryout signal becomes "0" and the pitch synchronizing signal PS1 becomes "1" so that the selector 32 selects the "0". input. To the "0" input of the selector 32 has been applied a value 14.40 which is a result of adding a decimal value 0.20 supplied from the shift register 33 to the frequency dividing number 14.20 corresponding to the P number 909. The value 14.40 therefore is provided by the selector 32. The output of the selector 32 subsequently decreases by 1 successively in the order of 13.40, 12.40, 11.40, . . . 2.40, 1.40. At the fourteenth period of fc, the value applied to the "1" input of the selector 32 becomes 0.40 and the carryout signal of the adder 35 becomes "0" so that the pitch synchronizing signal PS1 is produced. At this time, the output of the adder 31 is 14.20+0.40=14.60 and this value is applied to the shift register 33 through the "0" input of the selector 32. Thus, in the case of the note name A, frequency dividing is performed using 14 or 15 as the frequency dividing number, the pitch synchronizing signal PS1 being turned to "1" each 14 or 15 cycles of the common sampling frequency fc (e.g., 400 kHz).

The pitch synchronizing signal PS2 corresponding to the ninth through sixteenth channels is generated in a similar manner.

[Description about the tone generator]

In the tone generator 18, a tone signal can be generated in accordance with a sampling timing synchronized with the pitch of the tone to be generated by utilizing the pitch synchronizing signals PS1 and PS2 of respective channels which are produced in the foregoing manner. The manner of generating a tone signal is of course not limited to this but a tone signal may be generated in accordance with a timing which is not synchronized with the pitch of the tone.

Address data which designates a sample point address (instantaneous phase angle) of a tone to be generated can be produced by independently counting the pitch synchronizing signals PS1 and PS2 for the respective channels. Since, however, the pitch synchronizing signals PS1 and PS2 correspond to the pitches of the above described standard octave (G4–F#5), in producing the address data, a rate of counting the pitch synchronizing signals PS1 and PS2 must be changed in accordance with the octave range of a tone to be generated. If, for example, a tone in the octave of G3–F#4 is to be generated, 0.5 is counted each time the pitch synchronizing signal PS1 or PS2 is produced. If a tone in the octave of G4–F#5 is to be generated, 1 is counted each time the pitch synchronizing signal PS1 or PS2 is produced. If a tone in the octave of G5–F#6 is to be generated, 2 is counted each time the pitch synchronizing signal PS1 or PS2 is produced. In this manner, the address data which changes in synchronism with the pitch and octave of a tone to be generated is generated for each channel and a digital tone signal is generated in response to this address data.

Any type of tone signal generation system may be employed in the tone generator 18. For example, one of known systems such as a system according to which tone waveshape sampled value data stored in a waveshape memory is successively read out in response to the address data (memory accessing system), a system according to which tone waveshape sampled value data is obtained by performing a certain frequency modulation operation using the address data as phase angle parameter data (FM system) and a system according to which tone waveshape sampled value data is obtained by performing a certain amplitude modulation operation using the address data as phase angle parameter data (AM system) may be employed. If the memory accessing system is employed, a tone waveshape stored in a waveshape memory may be a waveshape of one period but a waveshape of plural periods is preferable for obtaining an improved tone quality. As a system in which a waveshape of plural periods is stored in a waveshape memory and read out from the memory, various systems are known such as a system according to which, as disclosed in Japanese Preliminary Patent Publication No. 52-121313, a full waveshape from start of sounding of a tone to the end thereof is stored and this full waveshape is read out once, a system according to which, as disclosed in Japanese Preliminary Patent Publication No. 58-142396, a waveshape of plural periods of an attack portion and a waveshape of one or plural periods of a sustain portion are stored in a memory and the waveshape of the attack portion is read out once and thereafter the waveshape of the sustain portion is read out repeatedly and a system according to which, as disclosed in European Patent Publication No. 0150736, dispersely sampled waveshapes are stored in a memory and a waveshape to be read out is designated upon timewise changing it successively and the designated waveshape is read out repeatedly. Any of these known systems may be suitably employed.

[Preliminary description of the adaptive digital filter]

As the type of the operation using a digital filter, there are basically a finite impulse response (FIR) filter and an infinite impulse response (IIR) filter. In the adaptive digital filter devices 21 and 22 of the present embodiment, FIR filter is employed. General description about the FIR filter will first be made.

(a) Basic circuit construction of FIR filter

Figure 5:
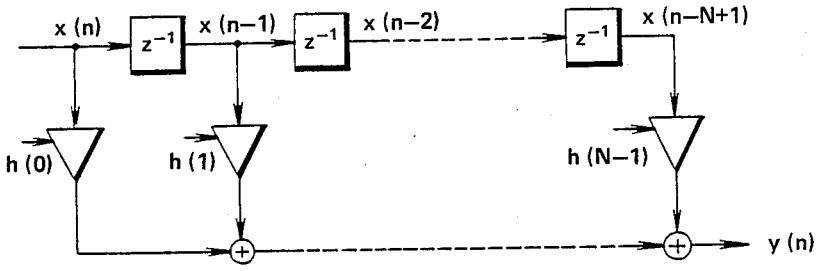
FIG. 5 is a block diagram showing a basic construction of an FIR filter.

FIG. 5 shows a basic circuit construction of an FIR filter. In the figure, x(n) represents digital tone waveshape sampled value data at any n-th sample point and constitutes an input signal to the FIR filter. $z^{-1}$ represents a unit time delay element which is used for establishing time delay for one sampling period. x(n−1) therefore represents digital tone waveshape sampled value data at the n−1-th sample point and x(n−N+1) represents digital tone waveshape sampled value data at the n−N+1-th sample point. n represents sustain time of impulse response and corresponds to the order of the FIR filter. h(0) through h(N−1) represent filter coefficients of N-th order. The triangle block to which these filter coefficients are applied is a multiplication element which multiplies the data x(n) x(n−N+1) of respective sample points delayed by the delay element with corresponding filter coefficients h(0)−h(N−1). The block with the + mark to which the output of the multiplication element is applied is an addition element which adds respective multiplication outputs together and provides an output signal y(n).

The z conversion, i.e., transfer function, of impulse response {h (n)} of such FIR filter is expressed by $$H(z) = \sum_{n=0}^{N-1} h(n)\, z^{-n} = h(0) + h(1)\, z^{-1} + \ldots h(N-1)\, z^{-(N-1)} \quad (5)$$

(b) Linear phase characteristic of FIR filter

One feature of such FIR filter is that its phase characteristic can be a linear phase. By making the phase characteristic a linear phase, phases of input and output waveshapes of the filter correspond to each other in complete linearity so that no distortion occurs in the output waveshape. Accordingly, this filter is suitable for filtering tone signals, voice signals and signals from audio devices. In the FIR filter of linear phase, the phase characteristic is required to become, as a function of angular frequency $\omega$, $$\theta(\omega) = -\alpha\omega \quad (6)$$

In this equation, $\alpha$ represents a constant called phase delay. Necessary and sufficient conditions for the FIR filter having such linear phase characteristic are that the impulse response is symmetrical as shown by the following equation (8) and that the phase delay $\alpha$ simply determined by the sustain time (the order of the filter) N as shown by the following equation (7):

$$\alpha = (N-1)/2 \quad (7)$$

$$h(n) = h(N=1-n) \quad (8)$$

where $0 \leqq n \leqq N-1$ (c) Symmetrical nature of the filter coefficients

The symmetrical nature of the impulse response as shown by the equation (8) signifies that the filter coefficients $h(0)-h(N-1)$ are symmetrical. In other words, by establishing the filter coefficients with symmetrical characteristic, the above described linear phase characteristic can be realized.

Figure 6:
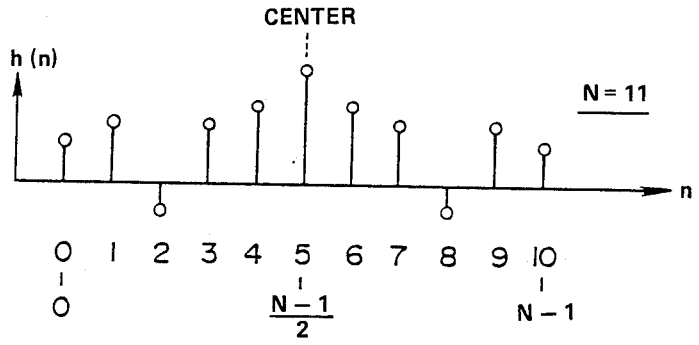
FIGS. 6 and 7 are graphical diagrams showing examples of symmetrical characteristic of impulse response in a linear phase FIR filter in cases where the order N is an odd number and an even number.
Figure 7:
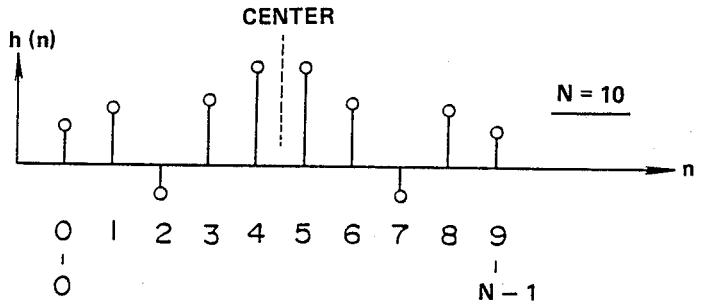

An example of symmetrical impulse response is shown in FIG. 6 in which the order N is an odd number and in FIG. 7 in which the order N is an even number. As will be apparent from these figures, the impulse response exhibits symmetrical characteristic centering at $n=(N-1)/2$. When N is an odd number, $(N-1)/2$-th order becomes the center and impulse responses on both sides thereof become symmetrical. When N is an even number, $(N-2)/2$-th order becomes the center and impulse responses on both sides thereof become symmetrical. Since orders at symmetrical positions are of the same value in the filter coefficient, filter coefficients for all orders N need not be prepared but half thereof will suffice. More specifically, when the order N is an odd number, it will be sufficient to prepare $\{(N-1)/2\}+1$ filter coefficients from the 0-th order to the $(N-1)/2$-th order and filter coefficients from the $\{(N-1)/2\}+1$-th order to the $N-1$-th order may be substituted by the filter coefficients from the 0-th order to the $\{(N-1)/2\}-1$-th order at symmetrical positions. That is, the same filter coefficient is utilized for both the 0-th order and the $N-1$-th order and the same filter coefficient is utilized for both the first order and the $N-2$-th order. When N is an even number, it is sufficient to prepare N/2 filter coefficients from the 0-th order to the $(N-2)/2$-th order and filter coefficients from the N/2-th order to the $N-1$-th order may be substituted by the filter coefficients form the 0-th order to the $(N-2)/2$-th order at symmetrical positions.

(d) Frequency response of the linear phase FIR filter

Figure 8:
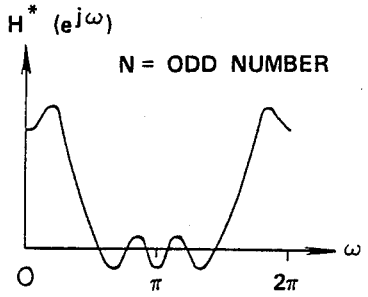
FIGS. 8 and 9 are graphical diagrams showing examples of frequency-response characteristic in the linear phase FIR filter in cases where the order N is an odd number and an even number.
Figure 9:
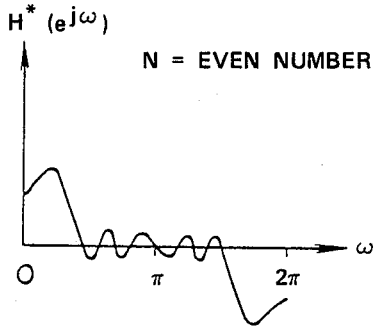

An example of frequency response characteristic $H^*(e^{j\omega})$ of the linear phase FIR filter whose impulse response exhibits the symmetrical characteristic is shown in FIGS. 8 and 9. When N is an odd number, the level at $\omega=\pi$ (where $\pi$ corresponds to $\frac{1}{2}$ of the sampling frequency fs) is not fixed to 0 but can be set at a desired value as shown in FIG. 8. When N is an even number, the level at $\omega=\pi$ always becomes 0 as shown in FIG. 9. As will be apparent from this, when the order N is an odd number, a high-pass characteristic can be realized by establishing of the filter coefficient whereas when the order N is an even number, the high-pass characteristic cannot be realized. When the order N is an even number, however, design of the filter is easier and it is suitable for design of a low-pass filter and a band-pass filter.

Accordingly, the order N of the filter should preferably be switched between an odd number and an even number depending upon a filter characteristic to be realized. In the present embodiment, the adaptive digital filter devices 21 and 22 are adapted to perform such switching between an odd number and an even number. When filtering of a band-pass filter characteristic or a low-pass filter characteristic is performed, the order N is set to an even number whereas when filtering of a high-pass filter characteristic is performed, the order N is set to an odd number.

(e) Other features of the FIR filter

The FIR filter has another feature that it has an excellent stability because no feed-back loop is provided in this filter.

In a filter such as the IIR filter which has a feed-back loop, problems including oscillation arise. Since no such problem arise in the FIR filter, design of the filter is easy.

The FIR filter is also advantageous in a case where the filter characteristic is timewise changed. In this case, a set of filter coefficients must normally be prepared individually for each of timewise varying filter characteristics. This requires a large number of sets of filter coefficients if fine timewise variation of the filter characteristic is to be realized. For overcoming this problem, it is conceivable to prepare two sets of filter coefficients which are timewise apart from each other, generate sets of filter coefficients densely as time elapses by performing interpolation between these two sets of filter coefficients and establish a filter characteristic which varies timewise by the filter coefficients generated by the interpolation. In realizing the timewise varying filter characteristic while performing interpolation of filter coefficients in real time, the FIR filter which has an excellent stability need not take the factor of instability into account and therefore is very advantageous.

Since the word length of a signal in a digital filter is limited, signal data must be necessarily rounded into the limited word length. Such rounding causes noise. In the FIR filter in which no feed-back loop is provided, an error due to such rounding is not accumulated so that the FIR filter is advantageous also for preventing noise.

The features of the FIR filter as outlined above are more fully described in, e.g., "Theory and Application of Digital Signal Processing" (Lawrence, R. Rabiner; Bernard, Gold. Prentice-Hall Inc.).

Nextly, preliminary brief description will be made about some features of the adaptive digital filter devices 21 and 22 in the present embodiment.

(f) Obtaining of filter coefficients

Figure 10:
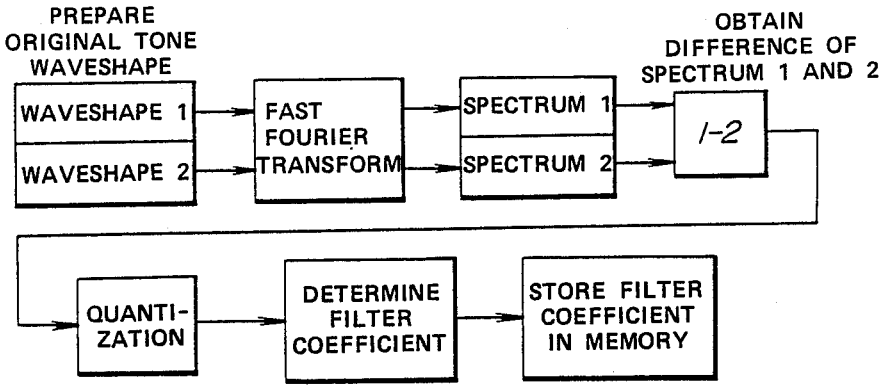
FIG. 10 is a flow chart showing an example of steps for obtaining filter coefficients.

Filter coefficients can be obtained by analyzing a real tone. An example of processing for obtaining filter coefficients will now be described with reference to FIG. 10. First, two kinds of tone waveshapes (i.e., original tone waveshapes) having different tone colors are prepared by sampling them from a tone of a natural musical instrument. For example, an original tone waveshape 1 is a waveshape of a piano tone played with a strong key touch and an original tone waveshape 2 is a waveshape of a piano tone played with a weak key touch. Then, a Fast Fourier Transform is performed to analyze Fourier components of the original tone waveshapes 1 and 2 whereby spectrum characteristics of these two waveshapes 1 and 2 are obtained. Then, difference between the spectrum characteristics of the two waveshapes is obtained. The difference spectrum characteristic is quantized and, on the basis of the quantized difference, processing for obtaining a filter coefficient is performed. The filter coefficient thus obtained is stored in a memory.

A filter coefficient for realizing timewise variation of the filter characteristic is stored in the dynamic control parameter memory 26 (FIG. 2) and a filter coefficient for realizing a constant filter characteristic which does not change timewise is stored in parameter memories in the ADFs 21 and 22 (FIG. 2).

The reason for obtaining filter coefficients on the basis of the difference spectrum characteristics between the two waveshapes is that while a tone signal corresponding to one original tone waveshape (e.g., the waveshape corresponding to the strong key touch) is obtained in the tone generator 18 (FIG. 2), a tone signal corresponding to the other original tone waveshape (e.g., the waveshape corresponding to the weak key touch) is to be obtained by applying filtering in accordance with the difference spectrum characteristic. In performing filtering according to the key touch, sets of filter coefficients corresponding to several orders of key touch strength may be prepared instead of preparing sets of filter coefficients corresponding to all orders of key touch strength and a filter coefficient corresponding to an unprepared key touch strength may be obtained similarly by interpolation.

Not only filter coefficients corresponding to the key touch but also filter coefficients corresponding to various factors including the tone pitch (or tone range) and tone color kind are prepared in a similar manner.

(g) Filter operation synchronized with the pitch

The filter operation timing for each sample point in the ADFs 21 and 22 (FIG. 2) is established by the pitch synchronizing signals PS1 and PS2. This signifies that the unit time delay in the filter operation ($z^{-1}$ in FIG. 5) is established by the pitch synchronizing signals PS1 and PS2. Alternatively stated, the sampling frequency fc in the filter operation is established by the pitch synchronizing signals PS1 and PS2. More specifically, since the frequency of the pitch synchronizing signals PS1 and PS2 corresponding to the respective note names G–F# is the same as the effective sampling frequency fe shown in the Table 1, the sampling frequency fs of the filter operation in the ADFs 21 and 22 differs depending upon the note name of an input tone signal. The sampling frequency fs in the filter operation corresponds to $\omega=2\pi$ in the frequency response characteristic shown in FIGS. 8 and 9. As will be apparent from this, as the sampling frequency fs changes with the note name, a frequency corresponding to $\omega=2\pi$ in the frequency response characteristic changes accordingly so that a filter characteristic obtained becomes the moving formant characteristic. Thus, the moving formant characteristic is very suitable for control of the tone color of a tone signal.

In a case where the sampling frequency in the filter operation is constant irrespective of the pitch of an input signal, a filter characteristic obtained becomes a fixed formant.

(h) Pitch synchronization/non-synchronization switching

As described above, the filter of the moving formant is suited to the tone color control but, depending upon a tone color or tone effect to be obtained, the filter of the fixed formant sometimes is preferable to that of the moving formant. The fixed formant is also preferable in a case where the pitch of a tone to be generated is caused to slide largely by manipulating the pitch bender 13 (FIG. 2). For these reasons, in the ADFs 21 and 22 in the present embodiment, the filter operation can be switched between a pitch-synchronized filtering and a pitch-non-synchronized filtering. Further, this switching between pitch synchronization and pitch non-synchronization is effected not uniformly through all channels but it can be effected independently with respect to each channel.

The filter of the fixed formant is preferable in operating the pitch bending operation for the following reason. The pitch control by the pitch bender 13 is capable of controlling not only a slight pitch difference but also a large pitch slide over several tone intervals and, in the latter case, the pitch control is sometimes made across the boundary of the octave of the note names G–F# shown in Table 1. In this case, if a filter operation synchronized with the pitch is performed, the sampling frequency fs undergoes an abrupt change with a result that the cut-off frequency undergoes an abrupt change (due to the moving formant) and an unnatural tone color change thereby is caused. If, for example, the tone which is being sounded slides from F#5 to G5 by the pitch bending operation, the sampling frequency changes abruptly from 47.359 kHz to 25.088 kHz (see Table 1) and, in the moving formant, the cut-off frequency changes abruptly by the same amount as difference between the two notes. For preventing occurrence of such inconvenience, the fixed formant (the filter operation not synchronized with the pitch) should preferably be employed during the pitch bending operation instead of employing the moving formant (the filter operation synchronized with the pitch). In the case of the filter operation not synchronized with the pitch, the sampling frequency of the filter operation in the ADFs 21 and 22 is 50 kHz in the example shown in FIG. 3.

(i) Dynamic/static switching of the filter order

As described above, in the dynamic mode, the dynamic control parameter is read out from the dynamic control parameter memory 26 (FIG. 2) under the control of the microcomputer 14 in real time during sounding of the tone and the read out data must be transferred to the insides of the ADFs 21 and 22 in real time. Data transfer time therefore is limited. If the order of filter coefficients is large, there is likelihood that filter coefficient parameter data for all orders cannot be transferred within the limited time. Accordingly, the filter order in the dynamic mode must be a limited one matching with the real time data transfer time.

In the static mode, no such problem arises since it is not necessary to change the filter coefficient during sounding of a tone. Besides, the larger the filter order, the finer filter characteristic can be realized so that the larger filter order is preferable. Accordingly, a sufficiently large filter order is used in the static mode.

For these reasons, in the present embodiment, the filter order is switched depending upon whether the filter operation mode is the dynamic mode or the static mode. By way of example, the filter order during the static mode is 32 (this is used in the even number characteristic and the filter order in the odd number characteristic is 31) and the filter order during the dynamic mode is 16 which is half the filter order of the static mode (15 in the odd number characteristic).

(j) Weighting control of the filter coefficients

Binary digital data of one filter coefficient consists of a filter coefficient data section of twelve bits and a weighting data section of three bits. The three-bit weighting data section designates one of six kinds of shift amounts of 0, +1, +2, +3, +4 and +5. The filter coefficient data section is shifted in response to the designated shift amount whereby weighting thereof is effected. By performing the weighting control which is capable of shifting the twelve-bit filter coefficient data section by five bits at the maximum, the dynamic range of the filter coefficient is substantially enlarged to seventeen bits. By such weighting control, the bit number of the filter coefficients stored in the memory can be reduced while a sufficient dynamic range is secured so that the memory capacity of the filter coefficient memory can be saved.

[General description of the adaptive digital filter]

Figure 11:
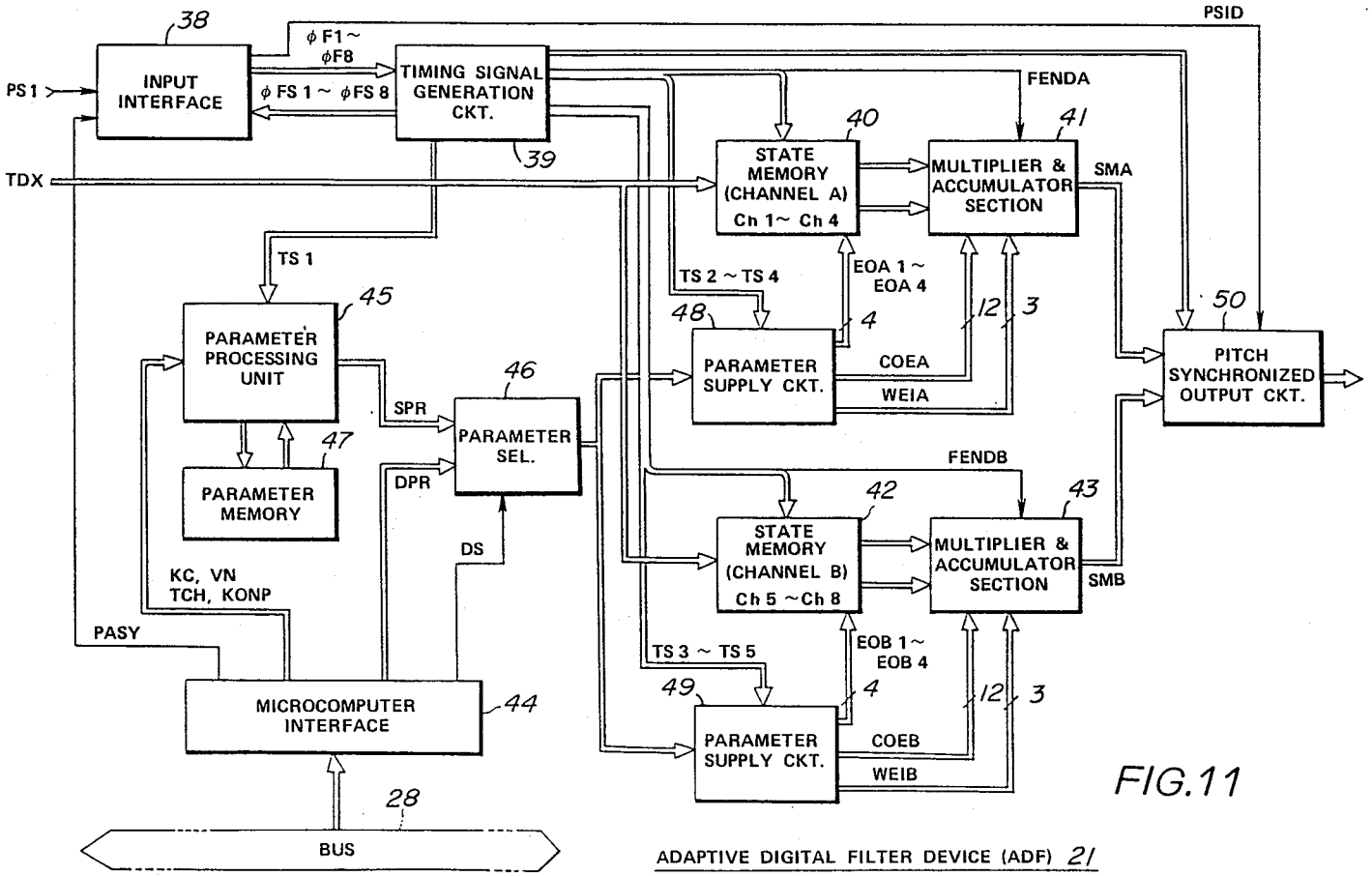
FIG. 11 is a block diagram showing an example of an adaptive digital filter device shown in FIG. 2.

FIG. 11 is a block diagram showing schematically an example of internal construction of the adaptive digital filter device (ADF) 21 corresponding to the first through eight channels. The other ADF 22 can be constructed in entirely the same manner.

Figure 12:
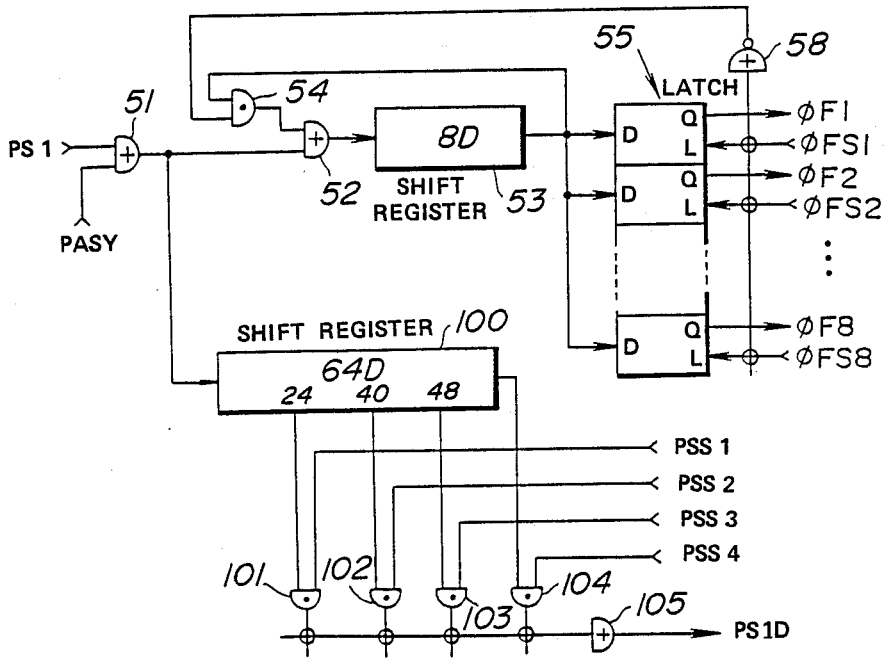
FIG. 12 is a block diagram showing an example of an input interface in FIG. 11.

An input interface 38 is provided for receiving the pitch synchronizing signal PS1 from the tone generator 18 (FIG. 2) and rectifying the pitch synchronizing signal PS1 for each channel to a form which is adapted to an internal operation timing of the ADF 21. A specific example of the input interface is shown in FIG. 12.

Figure 13:
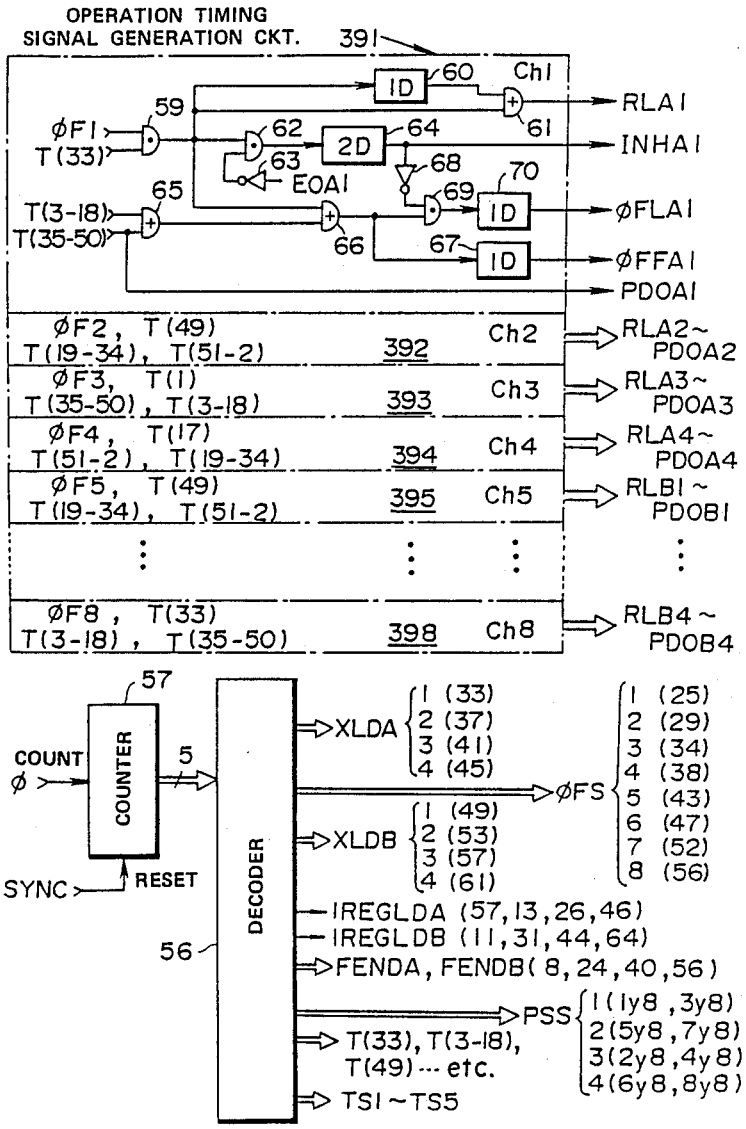
FIG. 13 is a block diagram showing an example of a timing signal generation circuit in FIG. 11.

A timing signal generation circuit 39 generates a timing signal for controlling various operations in the ADF 21 and also generates various operation timing signals necessary for the filter operation in response to a signal corresponding to the pitch synchronizing signal for each channel supplied from the input interface 38. A specific example of the timing signal generation circuit 39 is shown in FIG. 13. As will be described later, filter operations for the respective channels are performed on a time shared basis and this timing signal generation circuit 39 supplies timing signals for controlling the filter operations for the respective channels at correct timings.

Figure 14:
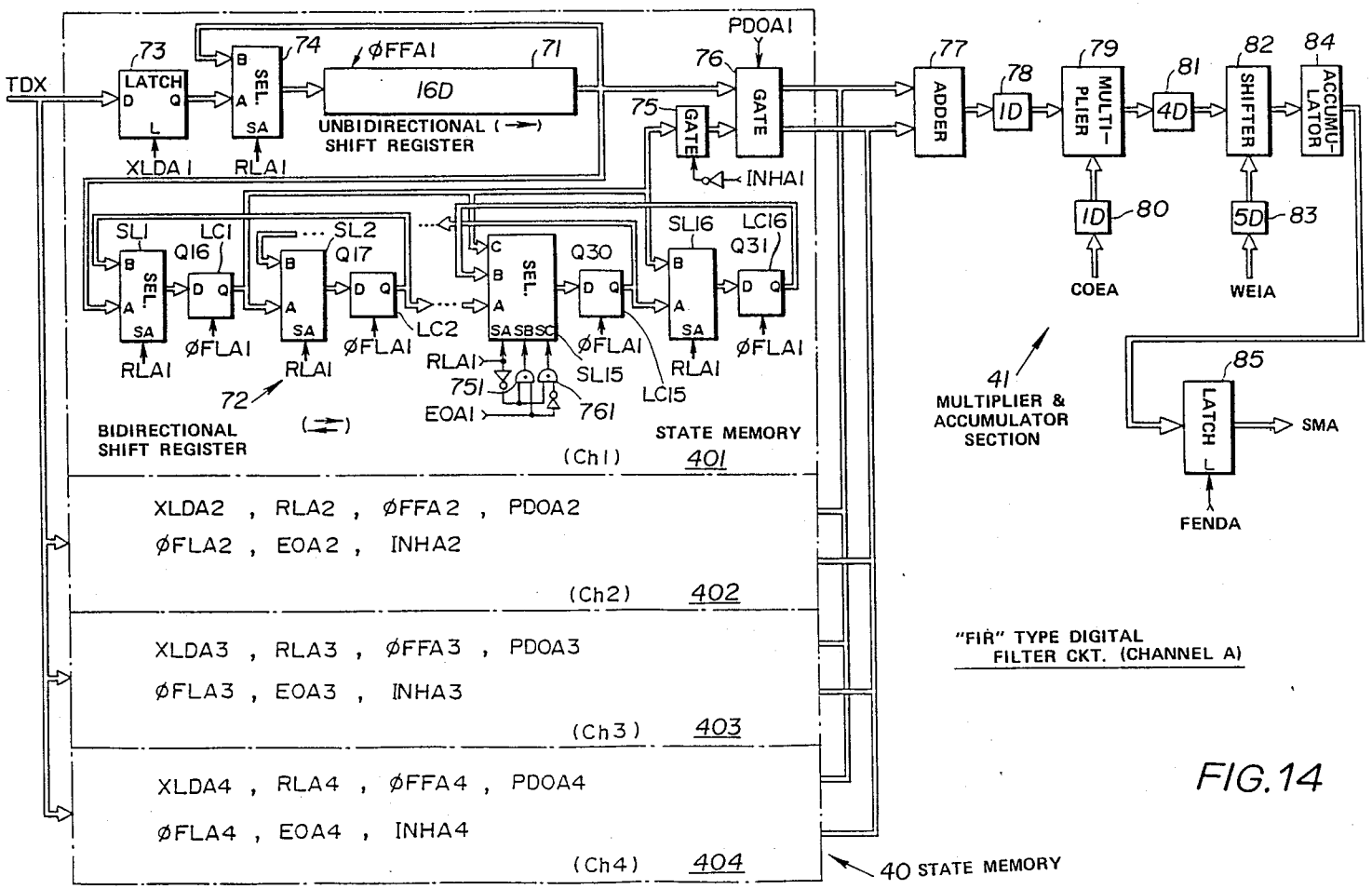
FIG. 14 is a block diagram showing an example each of a state memory, a multiplers and a accumulator section (i.e., in example of an FIR type digital filter circuit) in FIG. 11.

State memories 40 and 42 and multiplier and accumulator sections 41 and 43 are digital filter circuits executing a filter operation of an FIR filter. The digital filter circuit consisting of the state memory 40 and the multiplier and accumulator section 41 (hereinaftr called the digital filter circuit of A channel) performs a filter operation for the first through fourth channels (Ch1–Ch4) and the digital filter circuit consisting of the state memory 42 and the multiplier and accumulator section 43 (hereinafter referred to as the digital filter circuit of B channel) performs a filter operation for the fifth through eighth channels (Ch5–Ch8). In each of the digital filter circuits of A and B channels, a filter operation for four channels is performed on a time shared basis. It is for reasons of circuit design that the filter operation for the first through eighth channels is performed in two separate channels A and B. The state memories 40 and 42 have the digital tone signal sampled data TDX supplied from the tone generator 18 (FIG. 2) loaded in synchronism with the pitch synchronizing signal PS1 and delay the data by a number of stages corresponding to a predetermined filter order at a timing corresponding to the pitch synchronizing signal PS1. The state memories 40 and 42 correspond to an assembly of the unit delay element $z^{-1}$ in the FIR filter basic circuit in FIG. 5. The multiplier and accumulator sections 41 and 43 multiply the digital tone signal sampled data delayed by the state memories 40 and 42 with a filter coefficient of a order corresponding to the order of delay and correspond to the multiplication element and the addition element in the FIR filter basic circuit in FIG. 5. A specific example of the state memory 40 and the accumulator section 41 of A channel is shown in FIG. 14. Those of B channel can be constructed in entirely the same manner.

A microcomputer interface 44 receives various data through the data and address bus 28 under the control of the microcomputer 14 (FIG. 2) and supplies them to circuits in the ADF 21. Data received through this interface 44 includes the followings:

Key code KC: This data represents a key assigned to each channel.

Key-on pulse KONP: This data is turned to "1" only once in the initial stage of depression of a key assigned to each channel.

Touch code TCH: This data represents strength of key touch during depression of a key assigned to each channel.

Tone color code VN: This data represents the tone color kind selected for a key assigned to each channel.

The above data KC, KONP, TCH and VN are respectively provided from the interface 44 in a time division multiplexed state in accordance with a predetermined time division timing and supplied to a parameter processing unit (sometimes referred to as PPU) 45.

Pitch synchronization/non-synchronization signal PASY: This signal designates whether the digital filter operation in the ADF 21 is to be performed in synchronism with the pitch or not. This signal PASY can also be produced on a time shared basis with respect to each channel so that the pitch synchronization/non-synchronization control of the filter operation can be performed independently for each channel. This signal PASY is generated depending upon a selected tone color kind, or a state of operation of the pitch bender 13 (FIG. 2) or a state of operation of an exclusive or other suitable operator or other factor and is supplied to the interface 44 through the bus 28. The pitch synchronization/non-synchronization designation signal PASY provided from the interface 44 is supplied to the input interface 38 and used therein for controlling whether the input interface 38 should generate a signal in response to the pitch synchronizing signal PS1 or not.

Dynamic mode filter parameter DPR: This is a filter parameter (filter coefficient) read out from the dynamic control parameter memory 26 (FIG. 2) under the control of the microcomputer 14. As described previously, contents of this dynamic mode filter parameter change as time elapses during sounding of a tone. This dynamic mode filter parameter DPR consists, in the same manner as described above, of a filter coefficient section of twelve bits and a weighting data section of three bits and further includes data for discriminating whether the filter order is an even number or an odd number. As described previously, the order of a set of the dynamic mode filter parameters is 16 (or 15). Further, as will be apparent from the above, a set of actually prepared dynamic mode filter parameters has only to contain parameters for eight orders owing to the symmetrical characteristic of the filter coefficient in the linear phase characteristic.

Dynamic/static selection signal DS: This is a signal generated by operation of the dynamic/static selection switch 27 (FIG. 2). This signal is used for designating whether the filter operation is to be performed in the dynamic mode or the static mode.

The above data DPR and DS are supplied from the interface 44 to the parameter selector 46.

A parameter memory 47 stores filter parameters (filter coefficients) for the static mode.

The parameter processing unit 45 functions to read out filter parameters for the static mode from the parameter memory 47. More specifically, upon receiving the key-on pulse KONP, the unit 45 calculates the address in the parameter memory 47 to be accessed in response to the tone color code VN, the touch code TCH and the key code KC and reads out a filter parameter stored at this address from the memory 47. The read out static mode filter parameter SPR is supplied to the parameter selector 46. The data format of this static mode filter parameter is the same as the above described DPR. As described previously, the order of a set of static mode filter parameters is 32 (or 31). Further, as will be apparent from the above, a set of actually prepared static mode filter parameters has only to contain parameters for sixteen orders owing to the symmetrical characteristic of the filter coefficient in the linear phase characteristic.

The parameter selector 46 selects either one of the dynamic mode filter parameter DPR and the static mode filter parameter SPR in accordance with contents of the dynamic/static selection signal DS. The selected parameter is applied to parameter supply circuits 48 and 49 of A and B channels. The parameter supply circuit 48 of A channel receives and stores filter parameters DPR or SPR of the first through fourth channels and supplies it to the state memory 40 and the multiplier and accumulator section 41. The parameter supply circuit 49 performs the same operation with respect to filter parameters for the fifth through eighth channels.

The static mode filter parameter SPR is read out from the parameter memory 47 only once in the initial stage of key depression and subsequently is stored in the parameter supply circuits 48 and 49. Accordingly, the filter coefficient does not change during sounding of a tone in the static mode but maintains a constant filter characteristic. On the other hand, the dynamic mode filter parameter DPR is stored in the parameter supply circuits 48 and 49 until a parameter of new contents is supplied through the microcomputer interface 44 and contents stored in these circuits 48 and 49 are rewritten each time the contents of the parameter DPR are timewise changed.

In the filter parameters provided by the parameter supply circuits 48 and 49, even/odd discriminating data EOA1–EOA4 and EOB1–EOB4 for discriminating whether the order is an even number or an odd number are supplied to the state memories 40 and 42 whereas filter coefficient data sections COEA and COEB and weighting data sections WEIA and WEIB are supplied to the multiplier and accumulator sections 41 and 43. In the reference characters in the figure, the letters A and B at the end are used for distinguishing A channel from B channel. Data EOA1–EOA4 and EOB1–EOB4 of the respective channels are provided in parallel but data COEA, COEB, WEIA and WEIB of the respective channels are provided on a time shared basis.

Figure 15:
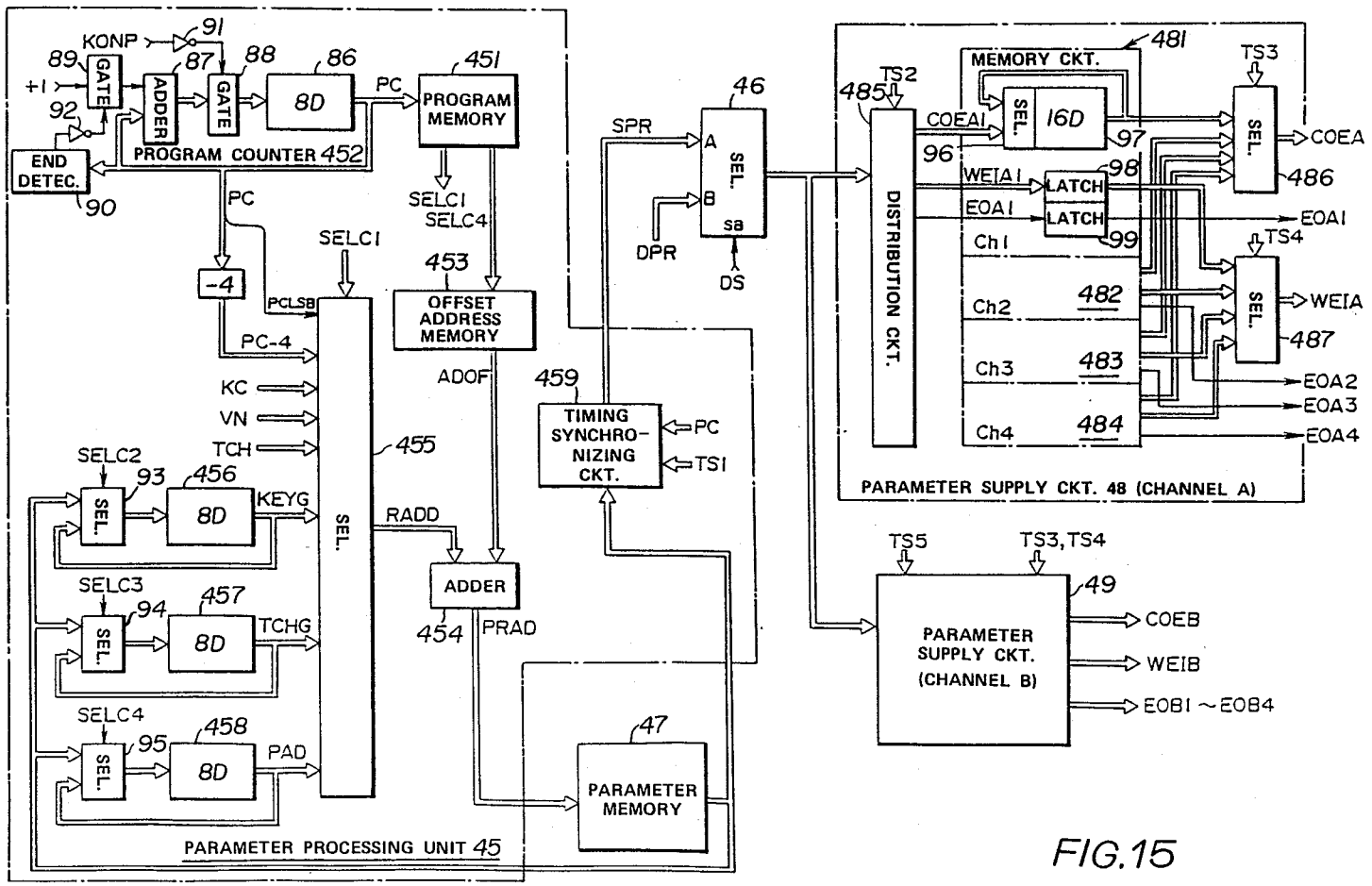
FIG. 15 is a block diagram showing an example each of a parameter processing unit and a parameter supply circuit.

Specific examples of the parameter processing unit 45, parameter selector 46, parameter memory 47 and parameter supply circuits 48 and 49 are shown in FIG. 15.

Figure 16:
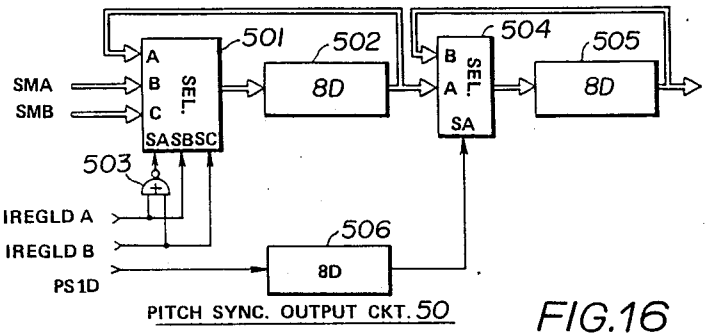
FIG. 16 is a block diagram showing an example of a pitch synchronized output circuit in FIG. 11.

A pitch synchronized output circuit 50 receives filtered tone signal sampled value data of the respective channels provided by the multiplier and accumulator sections 41 and 43 and resamples the data at a timing synchronized with the pitch of each data. A signal used for resampling control is a pitch synchronizing signal PS1D supplied from the input interface 38. This signal PS1D is a signal obtained by delaying the pitch synchronizing signal PS1 of each channel by a predetermined time. The delayed pitch synchronizing signal PS1D is used for performing pitch-synchronized resampling for synchronization with the delay of tone signals of the respective channels in the digital filter operation in the former stage. Since this processing for resampling the digital filter output signal in synchronism with the pitch of the signal causes the sampling frequency to be harmonized with the tone pitch, occurrence of aliasing noise can be prevented. In a case where the digital filter operation is performed in synchronism with the pitch, the digital filter output signal has a sampling frequency synchronized with the pitch so that the pitch synchronization can be achieved without provision of the pitch synchronized output circuit 50. In a case where the digital filter operation is performed not in synchronism with the pitch, however, the pitch synchronized output circuit 50 is necessary for achieving the pitch synchronization. A specific example of the pitch synchronized output circuit 50 is shown in FIG. 16.

Specific examples of component parts of the adaptive digital filter device 21 will now be described.

In the figures, circuits designated by a figure and the letter D such as "1D" and "8D" in blocks represent delay circuits or shift registers. The figure before the letter D represents the number of delay stages or stages. Among these delay circuit or shift register blocks, those in which application of a delay control clock pulse or a shift control clock pulse is not illustrated are delay-controlled or shift-controlled by the master clock pulse $\phi$ (FIG. 3).

[Input interface 38: FIG. 12]

In FIG. 12, the pitch synchronizing signal PS1 is applied to a shift register 53 through OR gates 51 and 52. As shown in FIG. 3, the pitch synchronizing signals PS1 for eight channels are time division multiplexed with eight time slots constituting one cycle so that a signal "1" is produced at one time slot corresponding to a channel to which a certain key has been assigned at a period synchronized with the pitch of the key. The output of the shift register 53 is fed back to the input side through an AND gate 54 and the OR gate 52 and the pitch synchronizing signals PS1 for eight channels are circulatingly held in the eight-stage shift register 53. Eight latch circuits 55 corresponding to the respective channels are provided in parallel and the pitch synchronizing signals produced from the shift register 53 are applied to data inputs D of the latch circuits 55 in parallel. To latch control inputs L of the latch circuits 55 are applied latch timing signals ϕFS1 (25), ϕFS2 (29), ϕFS8 (56). The figure after ϕFS represents the channel number and the figure in the parenthesis thereafter represents the time slot number in one operation cycle (i.e., 64 time slots shown in FIG. 3). At the time slot corresponding to the time slot number, the latch timing signal becomes a signal "1". For example, the signal ϕFS1 (25) is turned to "1" at the time slot 25 and this corresponds to the first channel. As will be apparent from FIG. 3, the time slot 25 corresponds to the time division timing of the first channel in the pitch synchronizing signal PS1. Accordingly, in the latch circuit 55 which is latch-controlled by this signal ϕFS1 (25), contents of the pitch synchronizing signal PS1 for the channel 1 (i.e., signal "1" at a timing synchronized with the pitch and a signal "0" at other timings) are latched. The same applies to the other channels 2 through 8 so that the pitch synchronizing signals for the respective channels are latched in parallel by the latch circuits 55 at predetermined timings.

The latch timing signals ϕFS1 (25)–ϕFS8 (56) corresponding to the respective channels are generated by a decoder 56 shown in FIG. 13. The decoder 56 decodes the output of a counter 57 and thereby produces timing signals of various types. The counter 57 is a counter of modulo 64 counting the master clock pulse ϕ and is reset regularly by the system synchronizing pulse SYNC (FIG. 3). Time slots at which the latch timing signals ϕFS1 (25)–ϕFS8 (56) corresponding to the respective channels 1–8 are generated will be apparent from the illustration in FIG. 13.

Reverting to FIG. 12, the timing signals ϕFS1 (25)–ϕFS8 (56) are multiplexed and inverted by a NOR gate 58. The output of the NOR gate 58 is applied to the AND gate 54 and the storage in the shift register 53 concerning the channel for which latching by the latch circuit 55 has been made thereby is cleared.

The signal "1" which has been latched by the latch circuit 55 in correspondence to the channel in which the pitch synchronizing signal PS1 has become "1" is held until a corresponding one of the latch timing signals ϕFS1 (25)–ϕFS8 (56) is generated in a next cycle. Thus, a signal "1" is held in the latch circuit 55 for a period of 64 time slots in correspondence to the channel in which the pitch synchronizing signal PS1 has become "1". The outputs of the latch circuits 55 corresponding to the respective channels are supplied as filter operation demand signals ϕF1–ϕF8 to the timing signal generation circuit shown in FIG. 13. As will be described later, when one of the filter operation demand signals ϕF1–ϕF8 has become "1", the filter operation for one sample point is carried out. Since the filter operation demand signals ϕF1–ϕF8 become "1" only when the pitch synchronizing signal PS1 has been generated, a digital filter operation synchronized with the pitch of a tone signal to be filtered after all is performed.

Figure 17:
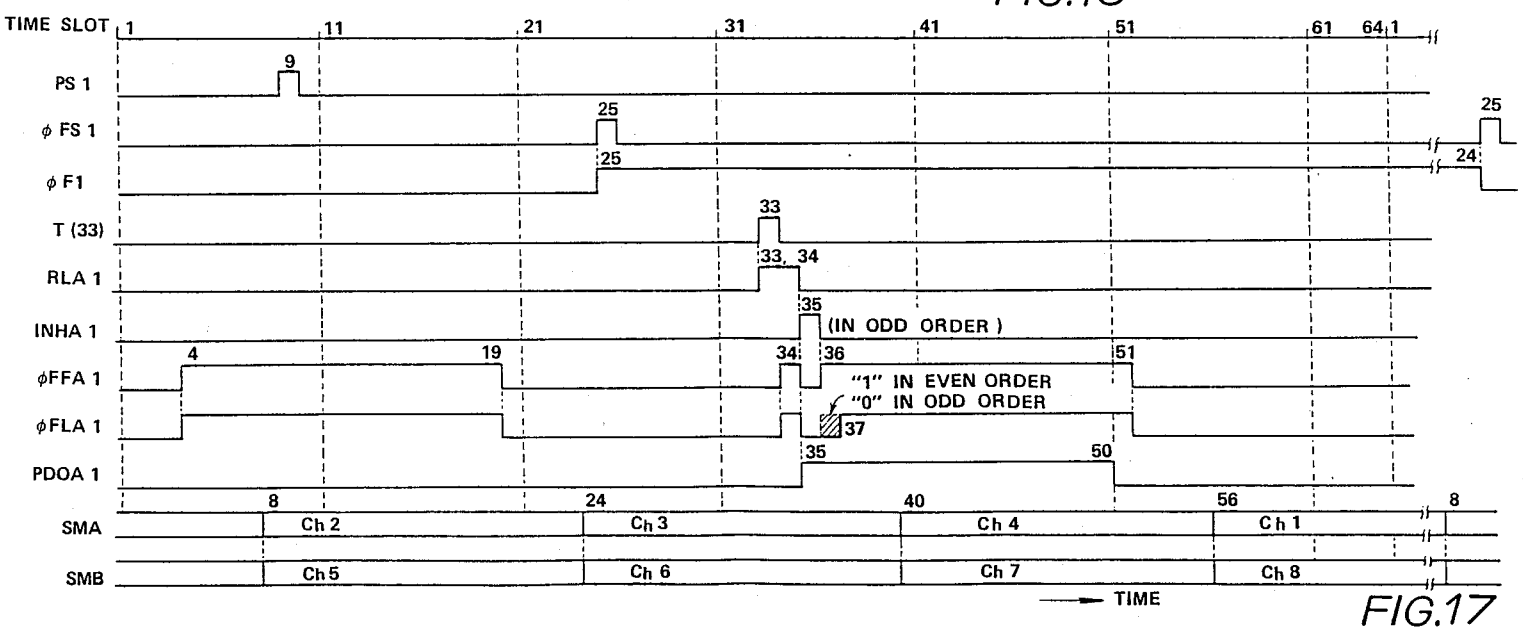
FIG. 17 is a time chart showing an example of generation of signals for controlling the filter operation timing.

Assuming, for example, that, as shown in FIG. 17, the pitch synchronizing signal PS1 has become "1" at time slot 9 (in this case, this signal "1" is the pitch synchronizing signal for the channel 1), this signal is circulatingly held in the shift register 53 and is latched by the latch circuit 55 when the timing signal ϕFS1 (25) has been generated at time slot 25. The filter operation demand signal ϕF1 corresponding to the channel 1 thereby rises to "1" at this time slot 25. This signal ϕF1 maintains a state "1" during the time width of 64 time slots until time slot 24 of a next cycle.

[Timing signal generation circuit 39: FIG. 13]

In FIG. 13, the timing signal generation circuit 39 comprises, in addition to the decoder 56 and counter 57, operation timing signal generation circuits 391–398 for the respective channels (Ch1–Ch8) which generate timing signals for controlling the filter operation in response to the filter operation demand signals ϕF1–ϕF8 for the respective channels provided by the input interface 38 in FIG. 12. In the figure, the circuit 391 for the channel 1 only is illustrated in detail but it should be understood that the circuits 392–398 for the other channels 2–8 are of the same construction and only difference is time relation between timing signals T(33), T(49) etc. applied to these circuits. The timing signals T(33), T(49), . . . are generated by the decoder 56. In the same manner as described previously, he figure in the parenthesis in reference characters designating the timing signals represents the time slot number in one operation cycle (64 time slots in FIG. 3) and signifies that the timing signal becomes "1" at the time slot corresponding to that time slot number. The same applies to the other timing signals generated by the decoder 56 so that the time slot at which the timing signal is generated (i.e., becomes "1") can be readily recognized by referring to the figure in the parenthesis. For example, as shown in FIG. 17, the timing signal T(33) becomes a signal "1" at time slot 33 and the signal T(3–18) becomes a signal "1" during a period from time slot 3 to time slot 18.

The operation timing signal generation circuit 391 will now be described. The filter operation demand signal ϕF1 and the timing signal T(33) are applied to an AND gate 59. Accordingly, when execution of the filter operation has been demanded, the output of the AND gate 59 becomes "1" at a timing of time slot 33. This output signal of the AND gate 59 and a signal obtained by delaying this by one time slot by a delay circuit 60 are supplied to an OR gate 61. The output of this OR gate 61 is used as a filter data sampling clock signal RLA1 for controlling unit delay in the digital filter circuit. This signal RLA1 becomes "1" at time slots 33 and 34 as shown in FIG. 17.

To an AND gate 62 are supplied the output of the AND gate 59 and a signal obtained by inverting the even/odd discriminating data EA01 for the channel 1 (this is provided by the parameter supply circuit 48 in FIG. 11) by an inverter 63. This data EOA1 is a signal "1" when the order of the filter characteristic to be realized is an even number and a signal "0" when the order is an odd number. The output of the AND gate 62 is delayed by two time slots by a delay circuit 64 and provided as an inhibit signal INHA1. When the filter order is an odd number, the output signal from the AND gate 62 becomes "1" at time slot 33 and the signal INHA1 becomes "1" at time slot 35 which is two time slots later (FIG. 17). When the filter order is an even number, this inhibit signal INHA1 is used for realizing the filter characteristic of a order of an odd number by inhibiting operation of the highest order in the odd number in the operation of the digital filter circuit.

The timing signals T(3–18) and T(35–50) are applied to an OR gate 65 and the output of the OR gate 65 and the output of the AND gate 59 are applied to an OR gate 66. The output of the OR gate 66 is delayed by one time slot by a delay circuit 67 and provided therefrom as a first shift clock signal $\phi$FFA1 (FIG. 17). The output of the OR gate 66 and a signal obtained by inverting the output of the delay circuit 64 by an inverter 68 are applied to an AND gate 69 and a signal obtained by delaying the output of the AND gate 69 by one time slot by a delay circuit 70 is provided as a second shift clock signal $\phi$FLA1 (FIG. 17). The signal $\phi$FLA1 is "1" at time slot 36 if the filter order is an even number and "0" if the filter order is an odd number. These shift clock signals $\phi$FFA1 and $\phi$FLA1 are used for sequentially shifting tone signal sampled value data corresponding to the respective delay stages in the state memory 40 (FIG. 11) for performing the filter operations for the respective orders on a time shared basis in the digital filter circuit.

A multiplication timing signal PDOA1 (FIG. 17) which becomes "1" during a period from time slot 35 to time slot 50 in response to the timing signal T(35–50) designates a period of time during which multiplication of tone signal sampled value data with filter coefficients is to be performed in the digital filter circuit.

The timing signals T(49), T(19–34), T(51–2), . . . used in the operation timing signal generation circuits 392–394 for the other channels 2–4 in A channel are shifted by sixteen time slots respectively from the timing signals T(33), T(3–18), T(35–50) for the channel 1. Accordingly, signals RLA2–PDOA2, . . . RLA4–PDOA4 which are similar to the signals RLA1–PDOA1 produced by the circuit 391 of the channel 1 are respectively produced by the circuits 392–394 at timings which are respectively shifted by sixteen time slots. In response to these timing signals, the digital filter circuit of A channel (particularly the multiplier and accumulator section 41) can perform the filter operation for four channels 1–4 on a time shared basis with time sections of sixteen time slots during one operation cycle (64 time slots).

In the operation timing signal generation circuits 395–398 for the respective channels 5–8 in B channel also, timing signals T(49), T(19–34), T(51–2), . . . which are shifted by sixteen time slots between the respective channels are used and signals RLB1–PDOB1, RLB4–PDOB4 similar to those described above are generated.

The signals RLA1–PDOA4 generated by the operation timing signal generation circuits 391–394 for A channel are supplied to the state memory 40 of A channel whereas the signals RLB1–PDOB4 generated by the circuits 395–398 for B channel are supplied to the state memory 42 of B channel (FIG. 11).

[State memory 40: FIG. 14]

In FIG. 14, the state memory 40 for A channel comprises state memories 401–404 for the respective channels 1–4 in A channel in parallel. The state memory 401 for the channel 1 only is illustrated in detail but the other state memories 402–404 for the other channels 2–4 are of the same construction though signals applied to these memories are different. The signals RLA1–PDOA1, . . . RLA4–PDOA4 generated by the operation timing signal generation circuits 391–394 (FIG. 13) for the channels 1–4 are applied respectively to the state memories 401–404 of corresponding channels.

Before describing the state memory 40 and the multiplier and accumulator section 41 in detail, the basic operation of the digital filter circuit comprising these circuits will be described with reference to the schematic diagrams of 18(*a*), 18(*b*), 19(*a*) and 19(*b*).

[Basic filter operation with a order of an even number: FIG. 18(*a*) and 18(*b*)]

FIGS. 18(*a*) and 18(*b*) are schematic diagrams for explaining the basic operation of the FIR type operation for realizing the filter characteristic of an even number order (32) in the above described digital filter circuit. FIG. 18(*a*) is a block diagram and FIG. 18(*b*) shows states of tone signal sampled values in stages Q0–Q15 and Q16–Q31 of shift registers SR1 and SR2 in FIG. 18(*a*) at respective operation timings.

The first shift register SR1 has sixteen stages and digital tone signal sampled value data $x_n$ to be filtered is applied thereto through a selector SEL1. For loading new sampled value data $x_n$ through the selector SEL1, the above described filter data sampling clock signal RLA (RLA1 in the case of the first channel) is used. For shift clock pulse of the shift register SR1, the above described first shift clock signal $\phi$FFA ($\phi$FFA1 in the case of the channel 1) is used. Sixteen sampled value data $x_n$–$x_{n-15}$ from sample point n to sample point n–15 are held in the stages Q0–Q15 of the first shift register SR1. The output of the last stage of the shift register SR1 is fed back to the first stage thereof when the sampling clock signal RLA is not supplied through the selector SEL1. This shift register SR1 is shifted only rightwardly.

The second shift register SR2 has also sixteen stages and the output of the first shift register SR1 is applied to the second shift register SR2 through a selector SEL2. For loading the output of the shift register SR1 to the shift register SR2 through the selector SEL2, the above described filter data sampling clock signal RLA is used. For shift clock pulse of the shift register SR2, the above described second shift clock signal $\phi$FLA ($\phi$FLA1 in the case of the channel 1) is used. Sixteen sampled value data $x_{n-16}$–$x_{n-31}$ from sample point n−16 to sample point n−31 are held in stages Q16–Q31 of the second shift register SR2. When the sampling clock signal RLA is not supplied through the selector SEL2, the last stage Q31 of the shift register SR2 is connected to the first stage Q16. This shift register SR2 is of a bidirectional shift type, being in a rightward shift mode when the sampling clock signal RLA is "1" and in a leftward shift mode when the sampling clock signal RLA is "0".

The outputs of the stages Q15 and Q16 of the shift registers SR1 and SR2 are added together by an adder ADD and the result of the addition is supplied to a multiplier MUL in which it is multiplied with the filter coefficient COEA. The result of the multiplication is supplied to an accumulator ACC in which results of multiplication with respect to all orders are accumulated. In this manner, the accumulator ACC provides a result of filter operation for one sample point.

Sampled value data for two sample points are added together by the adder ADD and further multiplied with the common filter coefficient COEA by the multiplier MUL by reason of the above described symmetrical characteristic of the filter coefficient. Since two sampled value data in symmetrical relationship to each other are multiplied with the filter coefficient of the same value, the multiplication with the filter coefficient is simultaneously made by a single multiplication after adding the two data instead of multiplying each data separately.

In FIG. 18(*b*), the operation timing on the vertical axis advances each time slot determined by the master clock pulse. The figure shown there designates expediently an order of operation and does not indicate the time slot number in one operation cycle (64 time slots). In the illustrated example, sampled value data for 32 sample points from $x_n$ to $x_{n-31}$ are loaded in the stages Q0–Q31 of the shift registers SR1 and SR2 at the operation timing 1.

In the illustrated example, the sampling clock signal RLA1 becomes "1" at the operation timing 2. The shift registers SR1 and SR2 thereby are shifted rightwardly by one stage in response to the shift clock signal $\phi$FFA and $\phi$FLA and assume the state as illustrated at the operation timing 2. The shift clock signals $\phi$FFA and $\phi$FLA at this time are generated at time slot 34 in the case of the channel 1 as shown in the columns of $\phi$FFA1 and $\phi$FLA1 in FIG. 17. As will be apparent from the figure, the shift clock signals $\phi$FFA and $\phi$FLA are not generated at a next one time slot and, accordingly, states of the stages Q0–Q31 do not change at the operation timing 3 of FIG. 18(*b*). However, the width of sixteen time slots from the operation timing 3 to the operation timing 18 corresponds to time slots 35–50 during which the multiplication timing signal PDOA1 (FIG. 17) in the case of the channel 1 so that the multiplication and accumulation are performed during this period of time.

More specifically, at the operation timing 3, sampled value data $x_{n-14}$ and $x_{n-15}$ loaded in the stages Q15 and Q16 are added together by the adder ADD, the result of the addition is multiplied with the filter coefficient of the sixteenth order and the result of the multiplication is held in the accumulator ACC.

During a period from the operation timing 4 to the operation timing 18, the first shift register SR1 is shifted rightwardly and the second shift register SR2 is shifted leftwardly each time slot and states of the stages Q0–Q31 sequentially change as shown in the figure. At the operation timing 4, therefore, $x_{n-13}$ and $x_{n-16}$ are added together, the result of the addition is multiplied with the filter coefficient of the fifteenth order and the result of the multiplication is accumulated in the accumulator ACC. At the next operation timing 5, a similar operation is performed with respect to $x_{n-12}$ and $x_{n-17}$. In this manner, similar filter coefficient operation is sequentially performed on a time shared basis with respect to two sampled value data in symmetrical positions. At the operation timing 18, a similar operation is performed with respect to $x_{n+1}$ and $x_{n-30}$ which are in last symmetrical positions whereby the filter operation for all orders is completed. At the next operation timing 19, shifting is performed again and sampled value data $x_{n-1}$–$x_{n-30}$ are provided in the respective stages Q0–Q31 in the order of delayed time as shown in the figure.

[Basic filter operation with the order of an odd number: FIGS. 19(*a*) and 19(*b*)]

FIGS. 19(*a*) and 19(*b*) are schematic diagrams for explaining the basic operation of the FIR type operation for realizing the filter characteristic of an odd number order (31). FIG. 19(*a*) is a block diagram and FIG. 19(*b*) shows states of tone signal sampled values in the stages Q0–Q15 and Q16–Q30 in the shift registers SR1 and SR2 in respective operation timings.

The blocks in FIG. 19(*a*) are the same as those shown in FIG. 18(*a*) except that the output of the stage Q16 is applied to the adder ADD through a gate GT. The gate GT is controlled by a signal obtained by inverting the inhibit signal INHA (INHA1 in the case of the first channel) and prohibits supply of the output signal of the stage Q16 to the adder ADD when the signal INHA is "1". The sixteenth stage 31 of the second shift register SR2 is not used but the fifteenth stage Q30 and the first stage Q16 are interconnected through the selector SEL2.

In FIG. 19(*b*), change of states in the first shift register SR1 is the same as the one in FIG. 18 (*b*). Change of states in the second shift register SR2 is somewhat different from FIG. 18(*b*) (the even number order). The shift clock signal $\phi$FLA of the second shift register SR2 is "1" at the operation timing 4 in the even number order mode but is "0" in the odd number order (see time slot 36 in the column of $\phi$FLA1 in FIG. 17 in the case of the channel 1). Accordingly, in the odd number order mode, as shown in FIG. 19(*b*), contents of the second shift register SR2 are not shifted at the operation timing 4 but are sequentially shifted leftwardly during a period from the operation timing 5 to the operation timing 19.

At the operation timing 3, tone signal sampled values $x_{n+1}$–$x_{n-29}$ corresponding to respective delay stages of thirty one orders are loaded in the stages Q0–Q30 of the shift registers SR1 and SR2, sampled value $x_{n-14}$ of the central order being loaded in the stage Q15. As shown by FIG. 6, for the order located at the center of symmetry of the odd number order mode, a filter coefficient proper to this order only is assigned. At the operation timing 3, therefore, the output of the stage Q16 is prohibited by the inhibit signal INHA and the output signal of the stage Q15 corresponding to the central order only is supplied to the adder ADD and multiplication with the proper filter coefficient corresponding to the central order is made in the multiplier MUL.

At the operation timing 4, the first shift register SR1 only is shifted rightwardly and the second shift register SR2 is not shifted. Accordingly, $x_{n-13}$ is loaded in the stage Q15 and $x_{n-15}$ is loaded in the stage Q16. The inhibit signal INHA becomes "0" and the gate GT is opened. Thus, sampled values $x_{n-13}$ and $x_{n-15}$ corresponding to adjacent orders on both sides of the central order are supplied to the adder ADD and added together therein and further are multiplied with a filter coefficient common to both of these data in the multiplier MUL.

During a period from the operation timing 5 to the operation timing 18, the shift register SR1 is sequentially shifted rightwardly and the shift register SR2 is sequentially shifted leftwardly and sampled values at symmetrical positions are loaded in the stages Q15 and Q16 as illustrated and the two sampled values are added together and thereafter multiplied with a common filter coefficient.

[Digital filter circuit: FIG. 14]

Referring to FIG. 14, the state memory 401 for the channel 1 will be described. An unbidirectional shift register 71 of sixteen stages corresponds to the first shift register SR1 in FIGS. 18 and 19 and is shift-controlled by a first shift clock signal $\phi$FFA1 corresponding to the channel 1. The digital tone signal sampled value data TDX provided by the tone generator 18 (FIG. 2) is applied to a latch circuit 73 and sampled value data for the channel 1 is loaded in the latch circuit 73 in response to a latch timing signal XLDA1. In synchronism with time division timings of the respective channels (see FIG. 3) in the tone signal sampled value data TDX, latch timing signals XLDA1–XLDA4 and XLDB1–XLDB4 for the channels 1–8 are generated from the decoder 56 (FIG. 13). As described previously, the figure in the parenthesis at the end of each signal designation represents the time slot number. Latch circuits similar to the latch circuit 73 are provided in the state memories for the respective channels and the tone signal sampled value data TDX for the respective channels 1–8 are separately latched by these latch circuits in response to the corresponding latch timing signals XLDA1–XLDA4 and XLDB1–KLDB4 and the data thereby are demultiplexed.

The tone signal sampled value data for the channel 1 latched by the latch circuit 73 is applied to A-input of a selector 74. The selector 74 selects the A-input when the filter data sampling clock signal RLA1 supplied from the operation timing signal generation circuit 391 in FIG. 13 is "1" and otherwise selects the output signal of the sixteenth stage of the shift register 71 which is applied to B-input of the selector 74. As described previously, this signal RLA1 is synchronized with the pitch of the tone so that new sampled data (A input) is selected by the selector 74 in synchronism with the pitch and this new sampled data is supplied to 17, the shift clock signal $\phi$FFA1 becomes "1" at a time slot 34 at which the signal RLA1 becomes "1" so that the shift register 71 has the new sampled data supplied from the selector 74 loaded in the first stage (Q0). At the next time slot 35, the shift register 71 stops its shift operation temporarily and is sequentially shifted rightwardly at subsequent time slots 36–51 in the same manner as described previously.

A bidirectional shift register 72 corresponds to the second shift register SR2 shown in FIGS. 18(*a*), 18(*b*), 19(*a*) and 19(*b*) Stages Q16–Q31 of this bidirectional shift register 72 consist of selectors SL1–SL16 and latch circuits LC1–LC16 as illustrated and are interconnected so as to enable the bidirectional shifting. To A-input of the selector SL1 of the initial stage Q16 is applied the output signal of the last stage (Q15) of the first shift register 71. To A-inputs of the selectors SL2–SL16 of the other stages Q17–Q31 are respectively applied outputs of the latch circuits LC1–LC15 of preceding stages. To B-inputs of the selectors SL1–SL16 of the respective stages are applied outputs of the latch circuits LC2–LC16 and LC1 of next stages. By this arrangement, the shift register 71 becomes the rightward shift mode when the A-inputs of the selectors SL1–SL16 have been selected and becomes the leftward shift mode when the B-inputs have been selected. As selection signals for the selectors SL1–SL16, the sampling clock signal RLA1 is used. When the sampling clock signal RLA1 is "1", the shift register 71 selects the A-input, i.e., becomes the rightward shift mode. However, for disabling the stage Q31 in the odd number order mode, the selector SL15 of the stage Q30 is somewhat differently constructed from the other stages. This selector SL15 has a C-input to which the output signal of the stage Q16 is applied. When the even/odd discriminating data EOA1 for the channel 1 is "1" (i.e., in the even number order mode), an AND gate 751 is enabled and this AND gate 751 produces a signal "1" when the signal RLA1 is "0" thereby causing the selector SL15 to select the B-input with a result that the output of the stage Q31 is supplied to the stage Q30 (i.e., shifted leftwardly). When the data EOA1 is "0" (i.e., in the odd number order mode), an AND gate 761 is enabled and the selector SL15 selects the C-input when the signal RLA1 is "0" and the output of the stage Q16 is supplied to the stage Q30 (i.e., shifted leftwardly skipping Q31).

Due to the above described construction, the state of change in the contents of the first and second shift registers 71 and 72 becomes entirely the same as the one shown in FIG. 18(*b*) and FIG. 19(*b*) in accordance with the even number order mode and the odd number order mode.

The output signal of the first stage Q16 of the second shift register 72 is supplied to a gate 76 through a gate 75. The gate 75 is controlled by a signal obtained by inverting the inhibit signal INHA1 and corresponds to the FIGS. 19(*a*) and 19(*b*). The gate 76 receives the output signal of the first shift register 71 (the output signal of the stage Q15) and the output signal of the second shift register 72 (the output signal of the stage Q16) supplied through the gate 75 and is opened by the multiplication timing signal PDOA1 (see FIG. 17).

The output of the gate 76 is applied to an adder 77 of the multiplier and accumulator section 41 where two tone signal sampled value data are added together. This adder 77 corresponds to the adder ADD in FIGS. 18 and 19. The output of the adder 77 is applied to a multiplier 79 after being delayed by one time slot by a delay circuit 78. The multiplier 79 multiplies the tone signal sampled value data supplied through the delay circuit 78 with the filter coefficient data COEA supplied through a delay circuit 80. The output of the multiplier 79 is delayed by four time slots by a delay circuit 81 and thereafter is supplied to a shifter 82. To a shift control input of the shifter 82 is supplied the weighting data WEIA through a delay circuit 83 which applies delay of five time slots to the data WEIA. These multiplier 79 and the shifter 82 correspond to the multiplier MUL in FIGS. 18 and 19. As described previously, the filter coefficient data COEA is data of the effective bits of the filter coefficient so that the multiplier 79 multiplies the tone signal sampled value data with the effective bits of the filter coefficient. By shifting the result of the multiplication in the shifter 82 by the bit number corresponding to the value of the weighting data WEIA, multiplication of the tone signal sampled value data with the real number of the filter coefficient is completed.

The output of the shifter 82 is supplied to an accumulator 84 in which results of multiplication for respective orders in one channel are accumulated. The output of the accumulator 84 is applied to a latch circuit 85 and latched thereby in response to an operation finish timing signal FENDA. This signal FENDA is generated by the decoder 56 in FIG. 13. As shown in FIG. 13, this signal FENDA becomes "1" at time slots 8, 24, 40 and 56. At time slot 56, the result of operation for the channel 1 is latched. At time slot 8, the result of operation for the channel 2 is latched. At time slot 24, the result of operation for the channel 3 is latched. At time slot 40, the result of operation for the channel 4 is latched. The decoder 56 likewise generates an operation finish timing signal FENDB for B channel.

The multiplier and accumulator section 41 is shared by four channels on a time shared basis. To the adder 77 is applied not only the output of the gate 76 of the state memory 401 for the channel 1 but are applied, in a multiplexed fashion, output signals of gates provided in the state memories 402–404 for the channels 2–4 and having the same function. To the output gates 76 of the state memories 401–404 are applied the multiplication timing signals PDOA1–PDOA4 with a width of sixteen time slots at timings which are shifted by sixteen time slots. Accordingly, signals of the channels 1–4 are applied to the adder 77 every sixteen time slots in a time division multiplexed state. As to the filter coefficient data COEA and the weighting data WEIA, data for the four channels are time division multiplexed every sixteen time slots at the same timing as above and, in sixteen time slots concerning one channel, data from the first order to the sixteenth order are time division multiplexed.

The state memory 42 and the multiplier and accumulator section 43 in B channel are of the same construction as those in FIG. 14 except for difference in timings of various signals.

Figure 20:
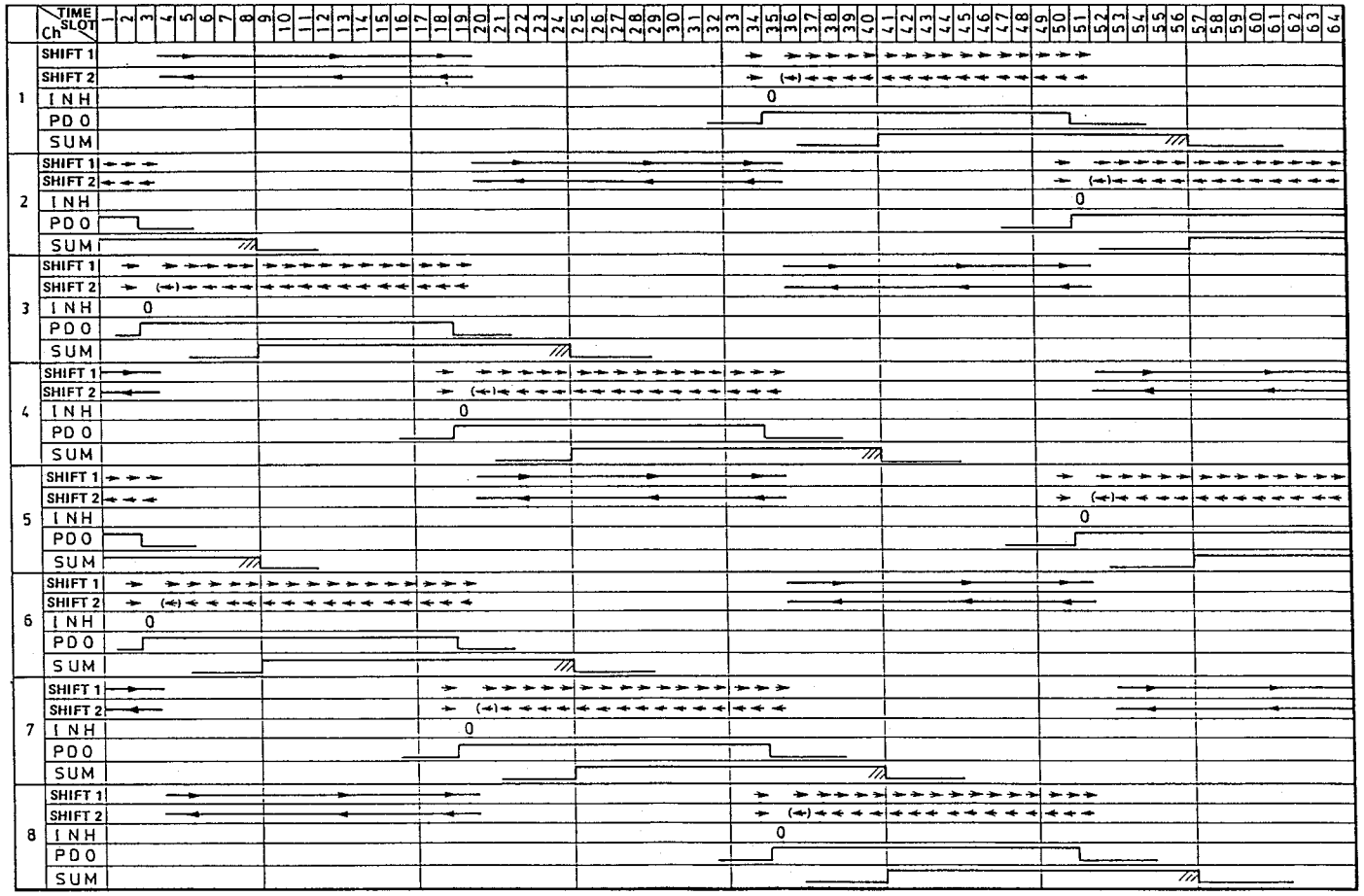
FIG. 20 is a diagram showing the filter operation timing for eight channels in digital filter circuits of A and B channels shown in FIG. 14.

Timings of the filter operation for the channels 1–8 in the digital filter circuits of A and B channels shown in FIG. 14 (i.e., the state memories 40 and 42 and the multiplier and accumulator sections 41 and 43) are shown in FIG. 20. In FIG. 20, columns of shift 1 show shift timings of the first shift register (71 in the case of the channel 1) and columns of shift 2 show shift timings of the second shift register (72 in the case of the channel 2). The directions of arrows indicate the shift directions (either rightward shift or leftward shift). The shift timings of the respective channels correspond to timings of generation of the first and second shift clock signals $\phi$FFA1–$\phi$FFB4 and $\phi$FLA1–$\phi$FLB4 generated by the operation timing signal generation circuits 391–398 (FIG. 13). The shift operation includes a shift operation for filter operation and a dummy shift operation for refreshing stored data. In the channel 1, for example, shifting during a period from time slot 4 to time slot 19 is the dummy shift operation. The symbol (←) in the columns of shift 2 signifies that the leftward shifting is performed in the even number order mode and no shifting is performed in the odd number order mode.

In FIG. 20, the column of INH represents timings of generation of inhibit signals INHA1–INHB4. In the odd number order mode, the inhibit signals INHA1–INHB4 become "1" at time slots marked by a circle. The column of PDO represents timings at which tone signal sampled value data is applied from the state memories 40 and 42 for the respective channels to the multiplier and accumulator sections 41 and 43. These timings correspond to timings of generation of the multiplication timing signals PDOA1–PDOB4 of the respective channels. The column of SUM represents output timings of the accumulator 84. The delay of six time slots between timings of PDO and timings of SUM is due to delay of five time slots by the delay circuits 78 and 81 and delay of one time slot by the accumulator 84. The operation finish timing signal FENDA is produced at the last time slot of the output timings of the accumulator 84 and the output of the accumulator 84 is latched by the latch circuit 85.

Figure 21:
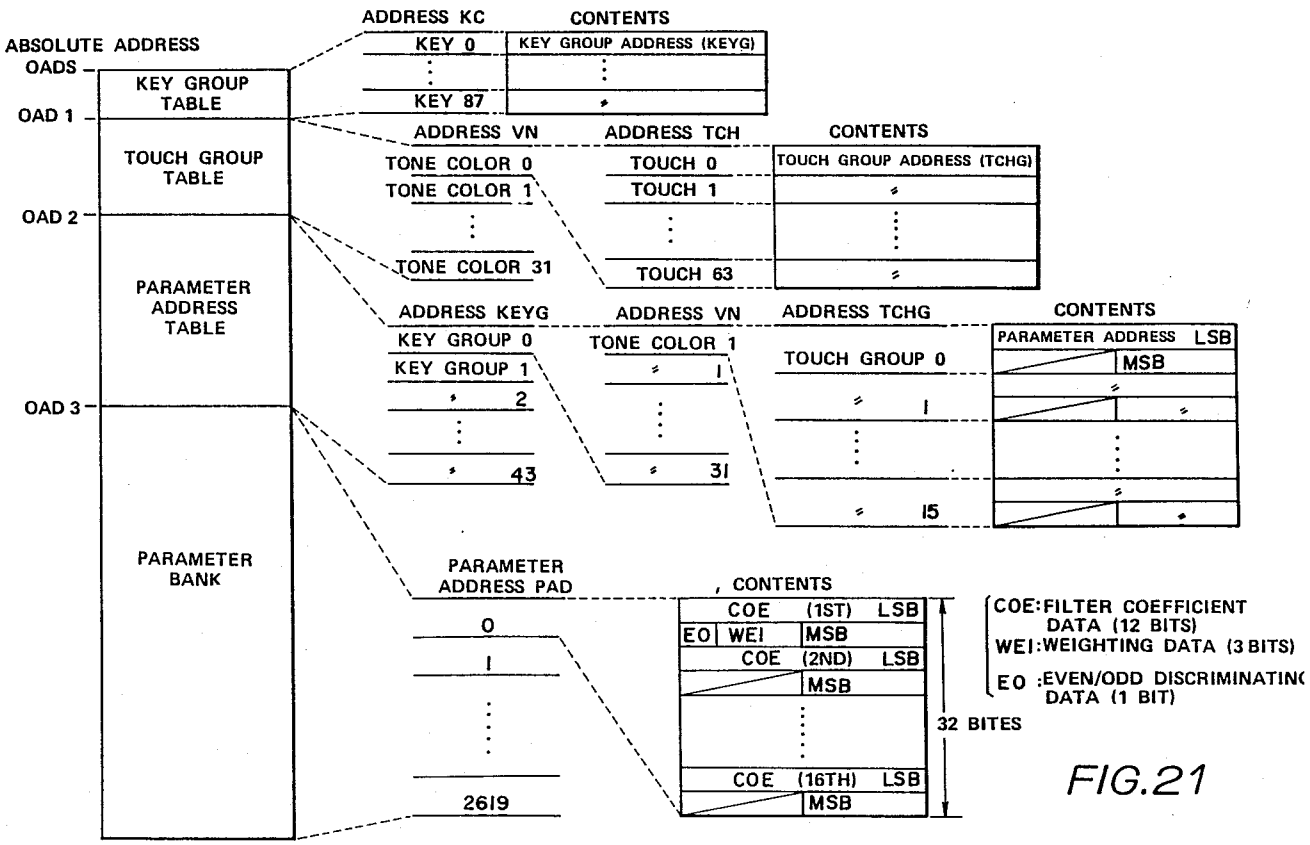
FIG. 21 is a diagram showing an example of a memory format in the parameter memory shown in FIGS. 11 and 15.

[Parameter memory 47: FIG. 21]

FIG. 21 shows a memory map of the parameter memory 47 which consists of a key group table, a touch group table, a parameter address table and a parameter bank. Actual filter parameters are stored in the parameter bank and address data of parameters to be read out from the parameter bank is stored in the parameter address table. The key group table stores data for grouping each key. For example, the number of keys is 88 and the number of groups is 44 and the key group table stores relative address data (also called key group address) concerning respective keys at addresses for these keys. Accordingly, the key group table is accessed by the key code KC. This key group table occupies a memory area starting from a predetermined absolute address (also called offset address OADS) in the parameter memory 47.

The touch group table stores data for grouping strength of key touch for respective stages of key touch strength with respect to each tone color. For example, there are thirty-two tone colors and this touch group table includes thirty-two areas for the respective tone colors corresponding to values 0–31 of the tone color code VN. Further, there are for example sixty-four stages in the touch strength which can be expressed by the touch code TCH and each of the thirty-two areas for the respective tone colors has sixty-four address positions corresponding to touch 0 through touch 63. Relative address data (also called touch group address) concerning the touch group to which a given touch strength belongs is stored at an address position corresponding to this touch strength. For example, the number of the touch groups is sixteen. The touch group table therefore is accessed by the tone color code VN and the touch code TCH. This touch group table occupies a memory area starting from a predetermined absolute address (also called offset address OAD1) in the parameter memory 47. The absolute address data for accessing this touch group table is formed by producing relative address data of eleven bits (address with the offset address OAD1 being 0) by connecting five-bit tone color code VN to the MSB of the six-bit touch code TCH and adding this relative address data to the offset address OAD1.

The parameter address table stores, for each key group and for each tone color, relative address data (called parameter address) of addresses storing filter parameters for the respective touch groups. This parameter address table includes forty-four key group areas corresponding to the key groups 0–43 and these key group areas are accessed by key group addresses read out from the key group table. Each of the key group areas includes thirty-two areas for respective tone colors corresponding to the tone colors 0–31 and these areas for the tone colors are accessed by the tone color code VN. Each of the areas for the tone colors includes sixteen address positions corresponding to the touch groups 0–15 and each address position is accessed by the touch group address read out from the touch group table. Memory position for two bites is allotted to one address position and the parameter address data is stored in twelve bits at this memory position. This parameter address table occupies a memory area starting from a predetermined absolute address (called offset address OAD2) in the parameter memory 47. The absolute address data for accessing this parameter address table is formed by establishing the LSB to "0" or "1" (since one address position occupies two bites, i.e., two absolute addresses), positioning the touch group address data of four bits above the LSB, positioning the tone color code VN of five bits above the touch group address data, and further positioning the key group code of six bits above the tone color code and thereby constituting relative address data of sixteen bits ( address with the offset address OAD2 being 0) and adding this data to the offset address OAD2.

The parameter bank stores, for example, filter parameters of 2620 types and includes 2620 parameter memory areas corresponding to parameter addresses 0–2619. One parameter memory area includes memory positions of thirty-two bites (thirty-two absolute address positions) and stores parameters corresponding to a set of filter coefficients for sixteen orders. A filter coefficient for one order is stored in a memory position of two bites which consists, as described previously, of filter coefficient data (COE) of twelve bits, weighting data (WEI) of three bits and even/odd discriminating data (EO) of one bit. Since, however, the weighting data (WEI) and the even/odd discriminating data (EO) are common through all orders in one set of parameters, these data are stored only at the memory position of the first order parameter and not stored at the memory positions of the other orders. The weighting data (WEI), however, may be stored independently for each order. This parameter bank is accessed by the parameter address read out from the parameter address table. The parameter bank occupies a memory area starting from a predetermined absolute address (called offset address OAD3) in the parameter memory 47. The absolute address data for accessing this parameter bank is formed by positioning parameter address data of twelve bits on more significant twelve bits of relative address data (address with the offset address OAD3 being 0) of seventeen bits to make the relative address data and adding this relative address data to the offset address OAD3. By successively changing less significant five bits of this absolute address data in thirty-two steps, a set of filter parameters for sixteen orders in one parameter memory area designated by the parameter address are successively read out.

A storeyed parameter memory structure as shown in FIG. 21 is advantageous for saving the memory capacity. If filter parameters are prepared individually for all combinations (22528 combinations) of forty-four key groups, thirty-two tone colors and sixteen touch groups, a memory capacity of 22528×32 bites is required. By employing the parameter memory structure as shown in FIG. 21, a memory capacity required is only 4028×32 bites which is a sum of 1408 (=44×32)×32 bites of the parameter address table and 2620×32 bites of the parameter bank. Since there are cases where common filter parameters can be used for different combinations of the key group, tone color and touch group, 2620 types of parameters are commonly used for the 22528 combinations in the example of FIG. 21 whereby the memory capacity is saved.

[Parameter processing unit 45, parameter selector 46, parameter memory 47 and parameter supply circuits 48 and 49: FIG. 15]

The parameter processing unit 45 controls accessing of the above described parameter memory 47 for the static mode. A program memory 451 stores a program for implementing the control for accessing the parameter memory 47. A program counter 452 generates a program step signal PC for accessing the program memory 451. The counter 452 comprises an eight-stage shift register 86, an adder 87, gates 88 and 89 and an end detection circuit 90 and performs a counting operation for the eight channels on a time shared basis. The key-on pulse KONP is inverted by an inverter 91 and the inverted signal is applied to a control input of the gate 88. This key-on pulse KONP becomes "1" in the initial stage of key depression and key-on pulses for the respective channels are time division multiplexed. The adder 87 adds "1" supplied from the gate 89 to the output of the shift register 86. The result of the addition is supplied to the shift register 86 via the gate 88. The end detection circuit 90 detects whether the value of the output of the shift register 86 has reached the last step of the program or not. If the value has not reached the last step yet, the circuit 90 produces a signal "0" and supplies a signal "1" to a control input of the gate 89 through an inverter 92 thereby causing a signal "1" commanding one count up to be supplied to the adder 87. If the value has reached the last step, the circuit 90 produces a signal "1" and supplies a signal "0" to the gate 89 through the inverter 92 thereby closing the gate and preventing the counting.

Due to the above described construction, contents of the program counter 452, i.e., the step signal PC, is reset to "0" when the key-on pulse KONP has been generated and subsequently the counter 452 counts up by one every time the shift register has completed one cycle (every eight time slots) until the last step has been reached in which the counting is stopped. By way of example, the program step number is thirty-seven and the step signal PC provided by the counter 452 sequentially changes from "0" to "36" (the last step). The step signal PC is the output of the shift register 86 and the step signals for the eight channels are time division multiplexed.

The program memory 451 produces the selection control signals SELC1–SELC4 and address data for accessing an offset address memory 453 in accordance with the step of the applied step signal PC. The offset address memory 453 stores values of the offset address OADS–OAD3. The offset address data ADOF (one of OADS–OAD3) read out from the offset address memory 453 is applied to an adder 454. The adder 454 adds relative address data RADD supplied from a selector 454 to the offset address data ADOF together and supplies its output as address data PRAD to the address input of the parameter memory 47.

A key group address register 456, a touch group address register 457 and a parameter address register 458 consist respectively of shift registers of eight stages and store respectively key group address data KEYG, touch group address data TCHG and parameter address data PAD channel by channel and on a time shared basis. The registers 456–458 respectively have selectors 93–95 provided on the input sides thereof and data read out from the parameter memory 47 is applied to one input of each of the registers 93–95. The selection control signals SELC2–SELC4 for the selectors 93–95 are provided by the program memory 451 and used for performing the control as to whether read out data of the parameter memory 47 is loaded in the registers 456–458 or the data once loaded in the registers 456–458 is circulatingly held. As will be apparent from the foregoing, the selection control signals SELC2–SELC4 are generated so that when the key group address data has been read out from the parameter memory 47, this data is loaded in the key group address register 456, when the touch group address data has been read out, this data is loaded in the touch group address register 457 and when the parameter address data has been read out, this data is loaded in the parameter address register 458.

The address data KEYG, TCHG and PAD stored in the registers 456–458 are applied to the selector 455.

The selector 455 receives also the key code KC, tone color code VN and touch code TCH and further the least significant bit PCLSB of the step signal PC produced by the program counter 452 and data PC−4 which is derived by subtracting "4" ("100" in binary number) from the step signal PC. The selector 455 selects the input data in a predetermined combination in response to the selection control signal SELC1 supplied from the program memory 451 and positions the selected data at a bit position corresponding to a predetermined weight in the relative address data RADD thereby forming and delivering out the relative address data RADD.

Processings of thirty-seven steps carried out in this parameter processing unit 45 are as follows:

When PC=0: readout from the key group table

The key code KC is selected and the offset address OADS in the key group table is read out as the offset address data ADOF in response to the selection control signal SELC1. The output data of the parameter memory 47 is loaded in the key group address register 456 in response to the selection control signal SELC2. A key group address corresponding to the key code KC is thereby read out from the key group table of the parameter memory 47 and this key group address is stored in the register 456.

When PC=1: readout from the touch group table

The tone color code VN and the touch code TCH are selected in response to the signal SELC1 and relative address data RADD is formed by positioning the touch code TCH at the least significant bit and the tone color code VN at more significant bits. The offset address OAD1 is read out from the touch group table as the offset address data ADOF. The output data of the parameter memory 47 is loaded in the touch group address register 457 in response to the signal SELC3. The touch group address corresponding to the tone color code VN and the touch code TCH is thereby read out from the touch group table of the parameter memory 47 and this touch group address is stored in the register 457.

When PC=2, 3: readout of the parameter address table

The key group address data KEYG, tone color code VN, touch group address data TCHG and the least significant bit PCLSB of the step signal PC are selected in response to the signal SELC1 and these data are positioned in the order of PCLSB, TCHG, VN and KEYG from the least significant bit to form the relative address data RADD. The offset address OAD2 is read out as the data ADOF from the parameter address table. The output data of the parameter memory 47 is loaded in the parameter address register 458 in response to the signal SELC4. A pertinent parameter address thereby is read out from the parameter memory 47 and stored in the register 458. As described previously, one parameter address data consists of twelve bits and is stored at a memory position of two bites (see FIG. 21). When the bit PCLSB is "0" (step of PC=2), parameter address data of less significant eight bits is read out and when PCLSB is "1" (step of PC=3), parameter address data of more significant four bits are read out. The selector 95 divides out the bit positions of this parameter address data so that the parameter address data is arranged in parallel into the twelve bit data and causes this data to be stored in the register 458.

When PC=4–35: readout from the parameter bank

The parameter address data PAD and the subtracted step signal PC−4 are selected in response to the signal SELC1 and the selected data are positioned in the order of PC−4 and PAD from the least significant bit to form the relative address data RADD. The offset address OAD3 is read out as the data ADOF from the parameter bank. The signal PC−4 changes its value from "0" to "31" in the thirty-two steps of PC=4 through PC=35. Accordingly, a set of filter parameters consisting of thirty-two bites designated by the parameter address (see FIG. 21) are sequentially read out bite by bite from the parameter bank of the parameter memory 47.

When PC=36: stopping of the program counter 452 and completion of the readout sequence of filter parameters The filter parameter read out from the parameter memory 47 is applied to a timing synchronizing circuit 459. This circuit 459 receives the program step signal PC and a timing signal group TS1 supplied from the decoder 56 (FIG. 13) of the timing signal generation circuit 39 and, responsive to these signals, produces filter parameters of respective orders in synchronism with predetermined timings. The output of this timing synchronizing circuit 459 is supplied as the static mode filter parameter SPR to an A input of the parameter selector 46. To a B input of the parameter selector 46 is supplied the dynamic mode filter parameter DPR from the microcomputer interface 44 (FIG. 11). To a selection control input SB of the selector 46 is supplied the dynamic/static selection signal DS from the microcomputer interface 44 so that the selector 46 selects the parameter DPR in the B input in the dynamic mode and the parameter SPR in the A input in the static mode.

The output of the selector 46 is applied to the parameter supply circuits 48 and 49 of A and B channels. The circuit 48 of A channel only is illustrated but the circuit 49 of B channel is of the same construction. In the parameter supply circuit 48, a distribution circuit 485 receives data concerning the channels 1–4 of A channel among data provided serially from the selector 46 and arranges these data in parallel by channel and also in parallel in the order of the filter coefficient data (COEA1 in the channel 1), weighting data (WEIA1 in the channel 1) and even/odd discriminating data (EOA1 in the channel 1) and distributes these data to memory circuits 481–484 corresponding to the respective channels. For controlling such distribution, a suitable timing signal TS2 is generated by the decoder 56 of the timing signal generation circuit 39 (FIG. 13) and supplied to the distribution circuit 485.

A specific example of the memory circuits 481–484 is illustrated with respect to the channel 1 only but the same applies to the other channels. The filter coefficient data COEA1 of twelve bits is applied to the shift register 97 of sixteen stages through the selector 96. This filter coefficient COEA1 contains time division multiplexed data for sixteen orders at sixteen time slots and this data of sixteen orders is loaded in the respective stages of the shift register 97. The contents of the shift register 97 are circulatingly held through the selector 96. The weighting data WEIA1 of three bits is applied to the latch circuit 98. The even/odd discriminating data EOA1 of one bit is applied to the latch circuit 99. The control of the selector 96 and the latch circuits 98 and 99 is performed by a suitable control signal (not shown) at a suitable timing. More specifically, in the static mode, the selector 96 causes the filter coefficient data COEA1 for sixteen orders to be loaded in the shift register 97 and the latch circuits 98 and 99 latch the weighting data WEIA1 and the even/odd discriminating data EOA1 in synchronism with a timing at which parameter data for sixteen orders read out from the parameter memory 47 in response to the initial stage of key depression is applied to the memory circuit 481 through the timing synchronizing circuit 459, the selector 46 and the distribution circuit 485. Subsequently, the contents stored in the shift register 97 and the latch circuits 98 and 99 are held until a new depressed key is assigned to this channel. In the dynamic mode, filter coefficient data COEA1 for eight orders among the dynamic mode filter parameter data DPR is loaded in the shift register 97, the weighting data WEIA1 is latched in the latch circuit 98 and the even/odd discriminating data EOA1 is latched by the latch circuit 99 in synchronism with a timing at which the dynamic mode filter parameter data DPR is supplied from the microcomputer 44 (FIG. 11) through the selector 46 and the distribution circuit 485. Subsequently, the contents stored in the shift register 97 and the latch circuits 98 and 99 are held until new dynamic mode filter parameter DPR is supplied. In the dynamic mode, filter coefficient data for eight orders in the dynamic mode filter parameter data DPR is stored in eight stages corresponding to the ninth to sixteenth orders among sixteen stages of the shift register 97 and the remaining eight stages corresponding to the first to eighth orders are left blank.

The filter coefficient data provided by each shift register 97 of the memory circuits 481–484 is supplied to a selector 486 in which data for each channel is sequentially selected and time division multiplexed in response to a timing signal TS3. Thus, filter coefficient data for the channel 1–4 are time division multiplexed and is supplied as the filter coefficient data COEA of A channel to the multiplier and accumulator section 41 of A channel (FIG. 14).

The weighting data produced by each latch circuit 98 of the memory circuit 481–484 is supplied to the selector 487 and data for each channel is sequentially selected and time division multiplexed in response to a timing signal TS4. The time division multiplexed weighting data WEIA for the channels 1–4 are supplied to the multiplier and accumulator section 41 (FIG. 14) of A channel.

The even/odd discriminating data EOA1–EOA4 for the channels 1–4 latched by the latch circuit 99 of the respective memory circuits 481–484 are supplied in parallel to the state memories 401–404 (FIG. 14) of corresponding channels.

[Pitch synchronized output circuit 50: FIG. 16]

In FIG. 16, filtered tone signal sampled value data SMA for the channels 1–4 provided by the multiplier and accumulator section 41 of A channel (FIGS. 11 and 14) are supplied in a time division multiplexed state to a B input of a selector 501. A timing at which filtered outputs of the channels 1–4 are loaded in the latch circuit 85 in FIG. 14 is an accumulation last time slot (the shaded portion) in the column of SUM in FIG. 20. Channel timings of the filtered sampled value data for the channels 1–4 are as shown in FIG. 17. To a C input of the selector 501 is supplied in a time division multiplexed fashion the filtered tone signal sampled value data SMB for the channels 5–8 provided by the multiplier and accumulator section 43 (FIG. 11) of B channel. Channel timing of this data SMB is as shown in FIG. 17.

To an A input of the selector 501 is supplied the output of the shift register 502 of eight stages and the output of the selector 501 is applied to the shift register 502. These shift registers 501 and 502 are provided for time division multiplexing the filtered sampled value data for the channels 1–8 in accordance with a high speed time division timing on one time slot basis as shown in the channel timing of PS1 in FIG. 3. The decoder 56 in FIG. 13 produces a timing signal 1REGLDA which becomes "1" at time slots 57, 13, 26 and 46 and a timing signal 1REGLDB which becomes "1" at time slots 11, 31, 44 and 64. These timing signals are supplied to a B selection control input SB and a C selection control input SC of the selector 501 of FIG. 16. By this arrangement, data for the channel 1 among the data SMA supplied to the B input is selected at time slot 57 (corresponding to the timing of the channel 1 among the channel timings of PS1 shown in FIG. 3), data for the channel 2 is selected at time slot 13 (corresponding to the timing of the channel 2 of PS1 in FIG. 3), data of the channel 3 is selected at time slot 26 (the timing of the channel 3 of PS1 in FIG. 3) and data for the channel 4 is selected at time slot 46 (the timing of the channel 4 of PS1 in FIG. 3). Among the data SMB supplied to the C input, data for the channel 5 is selected at time slot 11 (the timing of the channel 5 of PS1 in FIG. 3), data for the channel 6 is selected at time slot 31 (the timing of the channel 6 of PS1 in FIG. 3), data for the channel 7 is selected at time slot 44 (the timing of the channel 7 of PS1 in FIG. 3) and data for the channel 8 is selected at time slot 64 (the timing of the channel 8 of PS1 in FIG. 3).

Signals obtained by inverting the timing signals 1REGLDA and 1REGLDB by a NOR gate 503 are supplied to an A selection control input SA of the selector 501. The filtered sampled value data for the respective channels loaded in the shift register 502 at the above described timings is circulatingly held in the shift register 502 at other timings.

The output of the shift register 502 is supplied to an A input of the selector 504. The output of the selector 504 is applied to a shift register 505 of eight stages. The output of the shift register 505 is fed back to its input through a B input of the selector 504. The selector 504 and the shift register 505 are provided for resampling the output tone signal of the digital filter in synchronism with its pitch. To an A selection control input SA of the selector 504 is applied a delayed pitch synchronizing signal PS1D provided by the input interface 38 (FIG. 12) and delayed by a delay circuit 506 of eight time slots.

In FIG. 12, the pitch synchronizing signal PS1 is applied to a shift register 100 of 64 stages through the OR gate 51. A pitch synchronizing signal delayed by this shift register 100 by twenty-four time slots is applied to an AND gate 101, one delayed by forty time slots is applied to an AND gate 102, one delayed by forty-eight time slots is applied to an AND gate 103 and one delayed by sixty-four time slots is applied to an AND gate 104. The AND gates 101–104 receive, at the other input thereof, the timing signals PSS1–PSS4 generated by the decoder 56 in FIG. 13. The outputs of the AND gates 101–104 are supplied to an OR gate 105 and the delayed pitch synchronizing signal PS1D is derived therefrom. Timings of generation of the signals PSS1–PSS4 are as shown in the parenthesis in FIG. 13. For example, the reference characters "1y8" signifies that a signal "1" is generated at the first time slot with a period of eight time slots. Accordingly, in the case of the timing signal PSS1 which is "1y8, 3y8", a signal "1" is generated at the first and third time slots with a period of eight time slots. As will be apparent from representations in the parenthesis of the signals PSS1–PSS4 in FIG. 13 and the channel timing of PS1 in FIG. 3, the signal PSS1 becomes "1" at timings of the channels 1 and 3 in PS1, the signal PSS2 becomes "1" at timings of the channels 2 and 6 in PS1, the signal PSS3 becomes "1" at timings of the channels 3 and 7 in PS1 and the signal PSS4 becomes "1" at timings of the channels 4 and 8 in PS1.

Consequently, the delayed pitch synchronizing signal PS1D is delayed by twenty-four time slots in the case of the pitch synchronizing signals PS1 in the channels 1 and 5, by forty time slots in the case of PS1 in the channels 2 and 6, by forty-eight time slots in the case of PS1 in the channels 3 and 7 and by sixty-four time slots in the case of PS1 in the channels 4 and 8. The difference in the delay time is provided for matching the delay time with difference in the operation timing in the channels 1–4 and 5–8 in the adaptive digital filter device 21 ( FIG. 11).

Reverting to FIG. 16, the delayed pitch synchronizing signal PS1D is further delayed by eight time slots by a delay circuit 506 and thereafter is supplied to an input SA of the selector 504. When the signal PS1D of a certain channel is "1", the selector 504 receives filtered sampled value data of that channel from the shift register 502 and applies it to the shift register 505. At other time, contents of the shift register 505 are circulatingly held through the B input of the selector 504. In the foregoing manner, in the circuit including the selector 504 and the shift register 505, the filtered sampled value data for the respective channels are resampled in synchronism with the pitch of the tone to be generated in that channel.

[Pitch synchronization/non-synchronization switching in the filter operation]

The pitch synchronization /non-synchronization designation signal PASY supplied from the microcomputer interface 44 (FIG. 11) to the OR gate 51 in FIG. 12 is always "0" when the filter operation is performed in the pitch synchronized state and the input interface 38 generates the filter operation demand signals $\phi$F1–$\phi$F8 and the pitch synchronizing signal PS1D in response to the pitch synchronizing signal PS1. The digital filter operation is therefore performed when the pitch synchronizing signal PS1 has been generated, i.e., with a sampling period synchronized with the pitch of the tone signal to be filtered. The filter characteristic obtained thereby becomes the moving formant characteristic.

In a case where the filter operation is performed without being synchronized with the pitch, the pitch synchronization/non-synchronization designation signal PASY is always made "1". The output of the OR gate 51 in FIG. 12 therefore always becomes "1" regardless of presence or absence of the pitch synchronizing signal ( PS1. Accordingly, the input interface 38 generates the filter operation demand signals $\phi$F1–$\phi$F8 and the signal PS1D at a constant period during each filter operation cycle (64 time slots). The sampling frequency in the digital filter operation therefore becomes constant (e.g., 50 kHz) regardless of the pitch so that the filter characteristic obtained becomes the fixed formant characteristic.

[Example of filter characteristic]

An example of filter characteristic which can be realized by the above described embodiment is shown in FIGS. 22 through 27.

Figure 22:
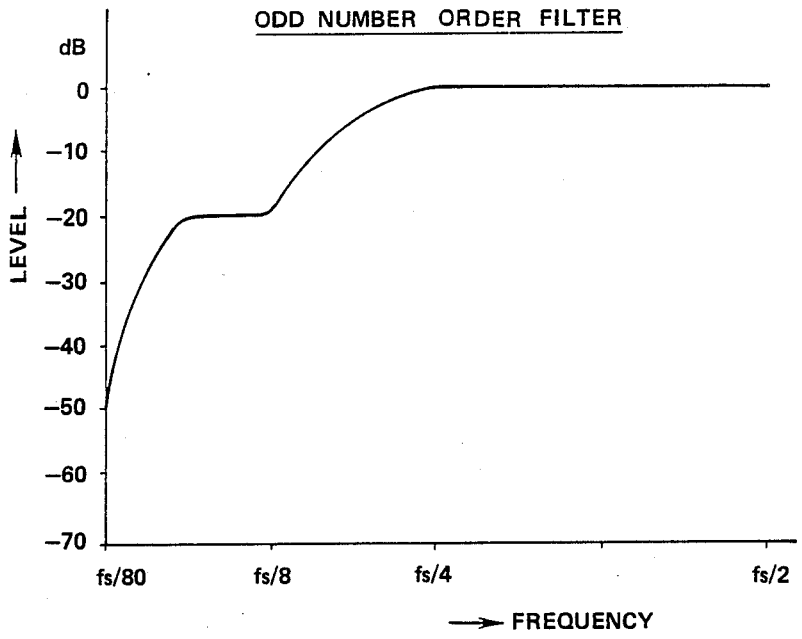
FIGS. 22 and 23 are diagrams showing an example each of a filter characteristic realized by the embodiment of the invention shown in FIGS. 2 through 21 with respect to an odd number order and an even number order respectively.

FIG. 22 shows an example of a filter characteristic which can be obtained when the order of the filter is an odd number (thirty first order). This characteristic represents a high-pass filter characteristic. In the figure, fs/2 represents ½ of the sampling frequency fs and fs/2 is a frequency synchronized with the pitch of the tone in the pitch synchronized mode whereas it is a constant frequency in the pitch non-synchronized mode.

Figure 23:
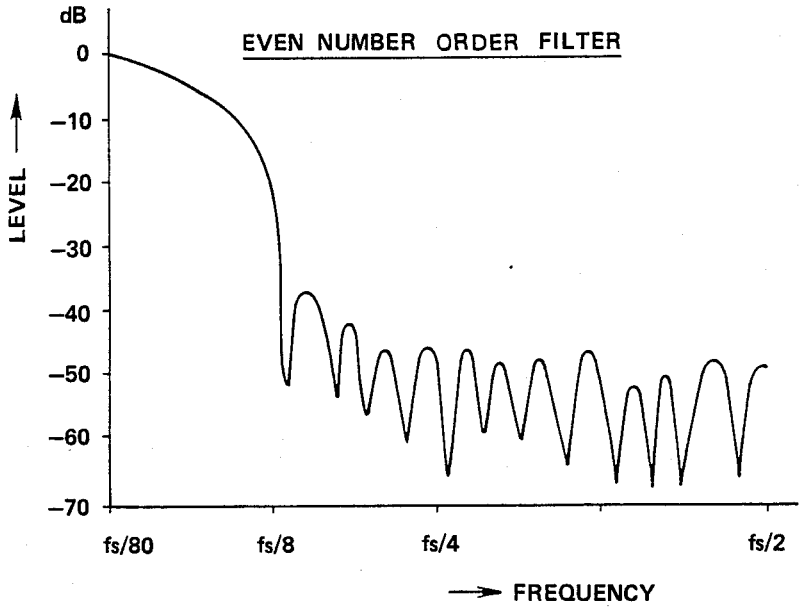

FIG. 23 shows an example of a filter characteristic obtained when the order of the filter is an even number (thirty second order). This filter characteristic realizes a low-pass filter characteristic.

Figure 24:
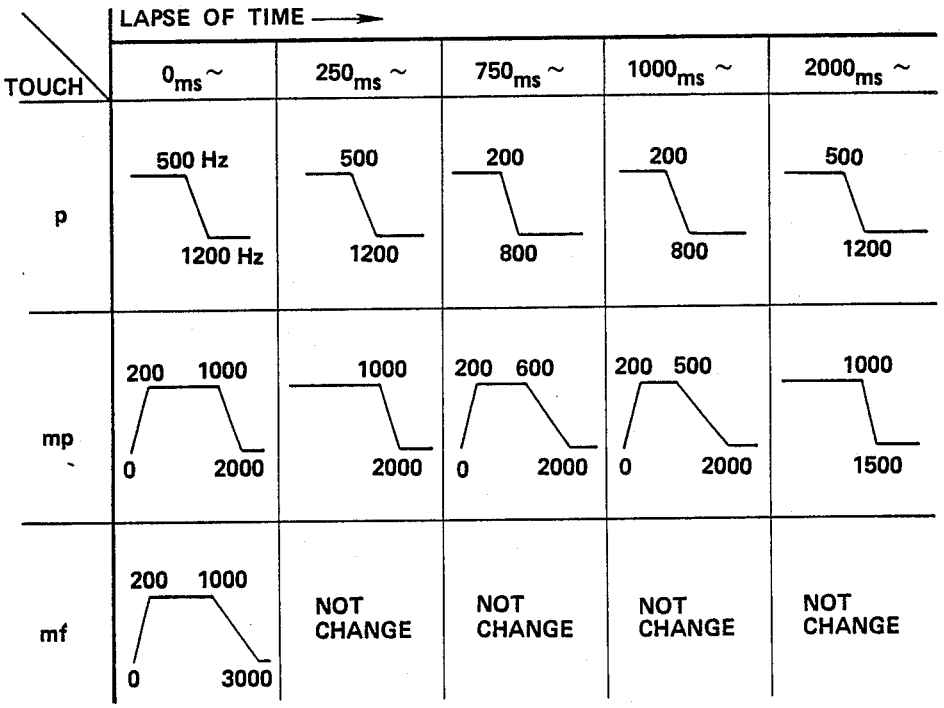
FIG. 24 is a diagram showing an example of a filter characteristic which undergoes timewise change realized in a dynamic mode in the same embodiment with respect to several touch strengths.

FIG. 24 shows an example of a filter characteristic which changes with lapse of time in the dynamic mode. In this case, it is assumed that the tone source waveshape signal generated by the tone generator 18 corresponds to f (forte), i.e., the strongest key touch, and timewise change of the filter characteristic in a case where tone signals for a touch of p (piano), a touch of mp (mezzo-piano) and a touch of mf (mezzo-forte) are obtained by filtering this tone source waveshape signal is shown. The column of time shows timings for switching to respective filter characteristics by time from the start of sounding of the tone. Figures in the filter characteristic diagram represent frequencies at points of change and the unit is Hz. The tone pitch of the tone to be generated is assumed to be F2.

Figure 25:
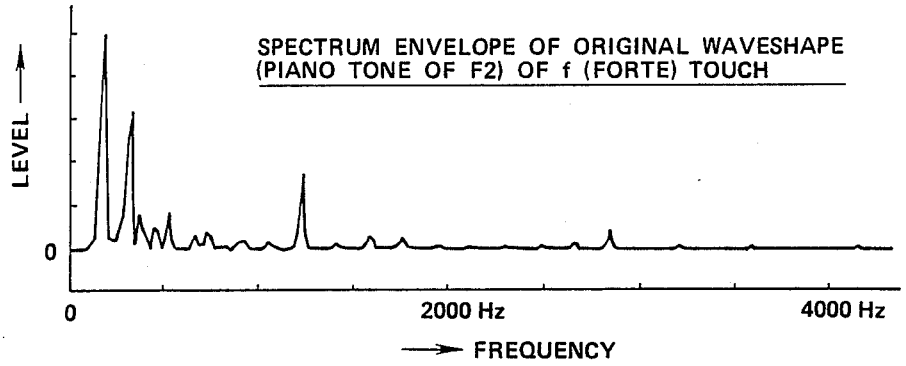
FIGS. 25 and 26 are diagrams showing an example of a spectrum envelope of an original waveshape of F2 of a piano with respect to a forte touch playing time and a piano touch playing time respectively.
Figure 26:
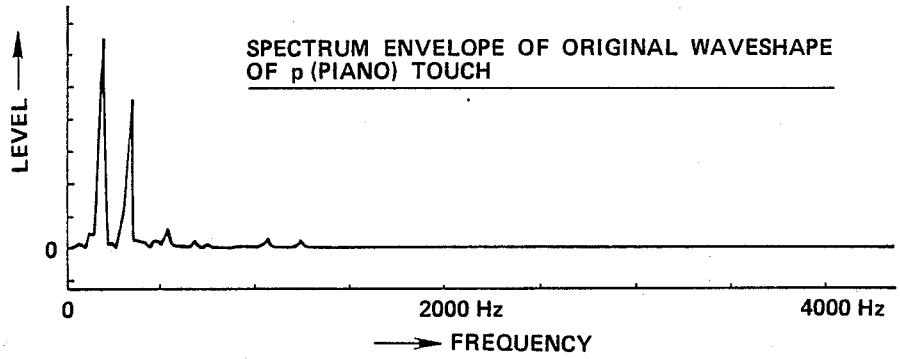
Figure 27:
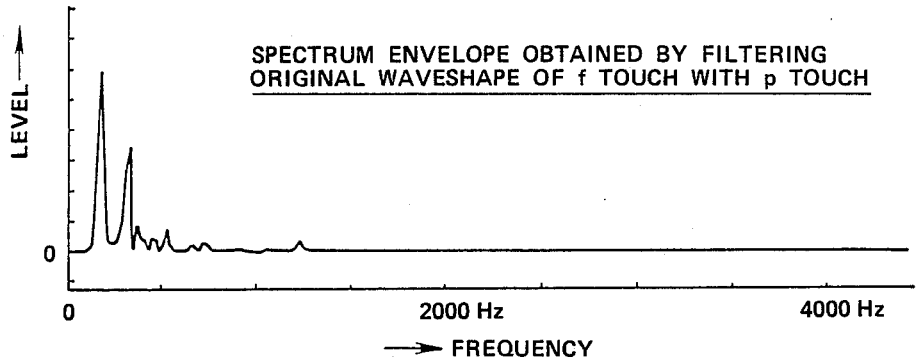
FIG. 27 is a diagram showing an example of a spectrum envelope of a tone signal obtained when an original waveshape of a forte touch has been filtered with a filter characteristic of a piano touch in the above embodiment.

FIG. 25 shows a spectrum envelope of the original waveshape of a piano tone of F2 played with the touch of f (forte) and FIG. 26 shows a spectrum envelope of the original waveshape of a piano tone of F2 played with the touch of p (piano). A spectrum envelope of a tone signal obtained by filtering the original waveshape of FIG. 25 with the filter characteristic at a time point of 0 ms in the column of p (piano) in FIG. 24 is shown in FIG. 27. It will be understood that this envelope in FIG. 27 resembles the spectrum envelope of the original waveshape of the p touch shown in FIG. 26.

[Modified embodiments]

The pitch synchronized output circuit 50 in FIG. 16 performs the pitch synchronizing processing on a time shared basis using the shift registers 502 and 505. The circuit 50 is not limited to this but, alternatively, memory circuits may be provided in parallel for the respective channels and the pitch synchronizing processing may be performed in parallel with one another.

In the above embodiment, the FIR filter in which filter coefficients exhibit the symmetrical characteristic is utilized as the digital filter. Alternatively, an FIR filter in which filter coefficients are not symmetrical may be employed. Further, not only FIR, but also other types of filters including IIR (infinite impulse filter) may be used.

The memory format of the parameter memory shown in FIG. 21 is not limited to the illustrated form but various modifications are possible. For example, the storied structure shown in the figure need not necessarily be employed.

Accessing of the parameter memory is not limited to the manner used in the above described embodiment but various modifications are possible. For example, in the above embodiment, the key group table is first accessed and then the touch group table is accessed. This order of accessing may however be reversed. In FIG. 15, the microprogramming system of prestoring the reading steps in the program memory 451 is employed and the parameter memory is accessed by these reading steps. Alternatively, the reading control may be made in accordance with a complete hard-wired circuit or a complete software program without using such microprogram system.

In the above described embodiment, the invention is applied to polyphonic type electronic musical instruments but the invention is of course applicable also to monophonic type electronic musical instruments. Further, the invention is applicable not only to an electronic musical instrument used exclusively for generation of musical tones but also to any device having a tone signal generation or processing function.

In the above described embodiment, it is assumed that the digital tone signal sampled value data itself which is applied from the tone generator to the adaptive digital filter device is in a state in which it has been sampled in synchronism with the pitch. The digital tone signal sampled value data need not necessarily be sampled in this manner. For example, a digital tone signal which has been sampled at a fixed sampling period not synchronized with the pitch may be applied to the digital filter device and subjected to the filter operation synchronized with the pitch while resampling this applied digital tone signal by the pitch synchronizing signal.

In the above described embodiment, the pitch synchronizing signal generation circuit is included in the tone generator and the pitch synchronizing signal generated therein is applied to the adaptive digital filter device. Alternatively, for example, in applying a digital tone signal having, a sampling period synchronized with the pitch to the digital filter, the pitch synchronizing signal may be generated by detecting change in the sampled value data of this digital tone signal and the filter operation may be controlled by the pitch synchronizing signal generated in this manner.

[Other embodiments]

FIGS. 28 through 32 show other embodiments according to other aspects of the invention. Specific examples of these embodiments are also shown in the above described embodiment of FIGS. 2 through 27. For better understanding of several important technical concepts concerning the tone signal processing device according to the invention, embodiments constructed by extracting important points and arranging them in a simplified manner are shown in FIGS. 28 through 32.

Figure 28:
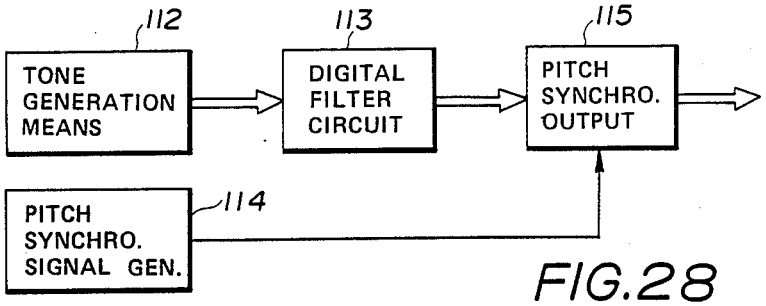
FIGS. 28 through 32 are block diagrams respectively showing schematically other embodiments of the tone signal processing device according to the invention.

The tone signal processing device according to one aspect of the invention shown in FIG. 28 comprises tone generation means 112 for generating digital tone signals in plural channels on a time shared basis, a digital filter circuit for receiving the digital tone signals of plural channels generated by the tone generation means 112 and performing a filter operation channel by channel on a time shared basis, pitch synchronizing signal generation means 114 for generating pitch synchronizing signals synchronized with pitches of the tone signals of the respective channels and pitch synchronization output means 115 for sampling and outputting the tone signals of the respective channels provided by the digital filter circuit 113 in response to the pitch synchronizing signals generated in correspondence to the respective channels.

The pitch synchronization output means 115 is provided on the output side of the digital filter circuit 113 and the pitch synchronizing processing, i.e., resampling processing by the pitch synchronizing signal, is performed for a filter output signal. Accordingly, the operation rate in the digital filter circuit 113 has only to correspond to a time division rate of the tone signal generated by the tone generation means 112 and need not correspond to a time division rate of the tone signal generated by the tone generation means 112. For this reason, the operation speed of the digital filter circuit 113 need not be such a high one so that the burden imposed on the circuit is alleviated.

In the embodiment shown in FIGS. 2 through 27, switching between the pitch synchronized mode and the pitch non-synchronized mode is possible in the digital filter devices 21 and 22 and the filter operation is performed in synchronism with the pitches of the tones during the pitch synchronized mode. This is not essential in the construction shown in FIG. 28 but the construction of FIG. 28 may have only the pitch non-synchronized mode (i.e., the filter operation is performed always with the period of 50 kHz thereby realizing a fixed formant). What is important in the construction of FIG. 28 is that the pitch synchronization output circuit 115 is provided on the output side of the digital filter circuit.

Figure 29A:
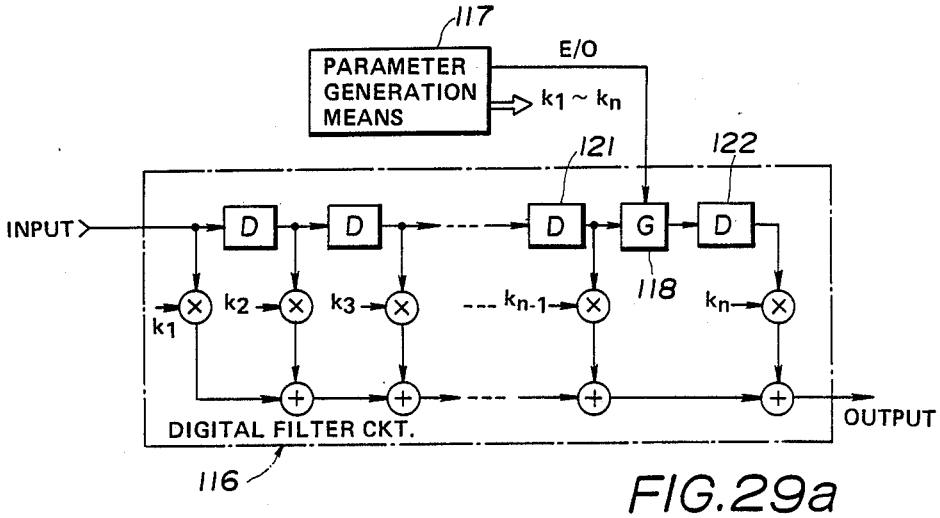
Figure 29B:
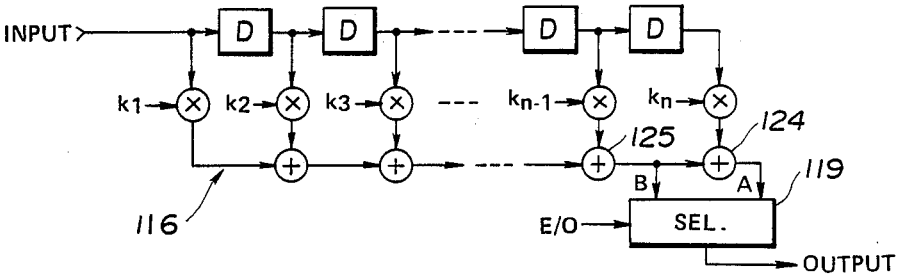
Figure 29C:
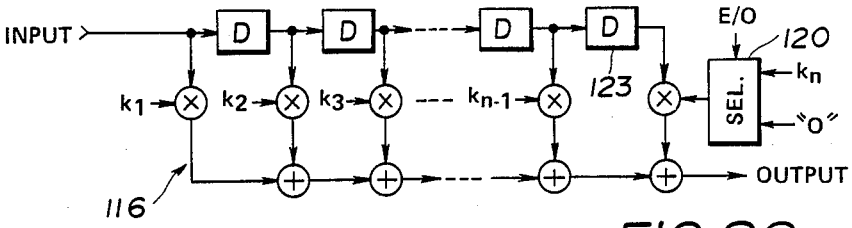

The tone signal processing device according to another aspect of the invention shown in FIGS. 29*a*–29*c* comprises a digital filter circuit 116 to which digital sampled value data of a tone signal, parameter generation means 117 for generating an even/odd parameter which establishes order of a filter operation to either an even number or an odd number and switching means 118, 119 and 120 for switching order of delay in the sampled value data used in the filter operation in the digital filter circuit 116 between a predetermined even number order and a predetermined odd number order in response to the even/odd parameter.

FIGS. 29*a*–29*c* respectively illustrate different examples of the switching means 118–120. In FIGS. 29*b* and 29*c*, illustration of the parameter generation means 17 is omitted. D represents a unit delay element, a circle with a symbol × represents a multiplication element and a circle with a symbol + represents an addition element, respectively. The digital filter circuit 116 has a hardware construction capable of performing a filter operation of n-th order (e.g., n being an even number). The parameter generation means 17 generates filter coefficients k1–kn and even/odd parameters E/O for realizing a predetermined tone color in accordance with tone color determining factors including constant tone color selection information, key touch and tone range. The filter coefficients k1–kn corresponding to the respective orders 1 through n are supplied to the digital filter circuit 116 where they are used for multiplying the tone signal which has been delayed by delay time corresponding to these orders.

The digital filter circuit 116 selectively operates either as a filter of an even number order or one of an odd number order in accordance with the delay order switching operation by the switching means 118–120 in response to the even/odd parameter E/O. By this arrangement, the operation of the digital filter circuit can be switched either to the filter of an even number order or that of an odd number order depending upon a tone color to be realized so that a desired filter characteristic suited to that tone color can be realized. For example, the operation is established to the filter of the odd number order when a tone color suitable for a control by a high-pass filter characteristic is to be realized whereas it is established to the filter of the even number order when a tone color suitable for control by a band-pass or low-pass filter characteristic is to be realized.

In the case of FIG. 29*a*, a gate 118 which constitutes the switching means is provided between a delay element 121 corresponding to the n−1-th order and a delay element 122 corresponding to the n-th order. The gate 118 is opened when the even/odd parameter E/O is a value indicating an even number order and it is closed when the even/odd parameter E/O is a value indicating an odd number order when the gate 118 is opened, the digital filter 116 operates as a filter of the n-th order, i.e., an even number order whereas when the gate 118 is closed, the filter 116 operates as a filter of the n−1-th order, i.e., an odd number order.

In the case of FIG. 29*b*, an output A of an addition element 124 summing results of the filter operation for n orders and an output B of an addition element 125 summing results of the filter operation for n−1 orders are applied to a selector 119 which constitutes the switching means and either A or B is selected in accordance with the value of the even/odd parameter E/O. When A has been selected, the filter becomes one of the been selected, the filter becomes one of the n−1-th order, i.e., an odd number order.

In the case of FIG. 29*c*, either the filter coefficient kn of the n-th order or "0" is selected in accordance with the even/odd parameter E/O and the selection output is used for multiplying the output tone signal of a delay element 123 corresponding to the n-th. When kn has been selected, the filter becomes one of the n-th order, i.e., an even number order and when "0" has been selected, it becomes one of the n−1-th order, i.e., an odd number order.

Figure 30A:
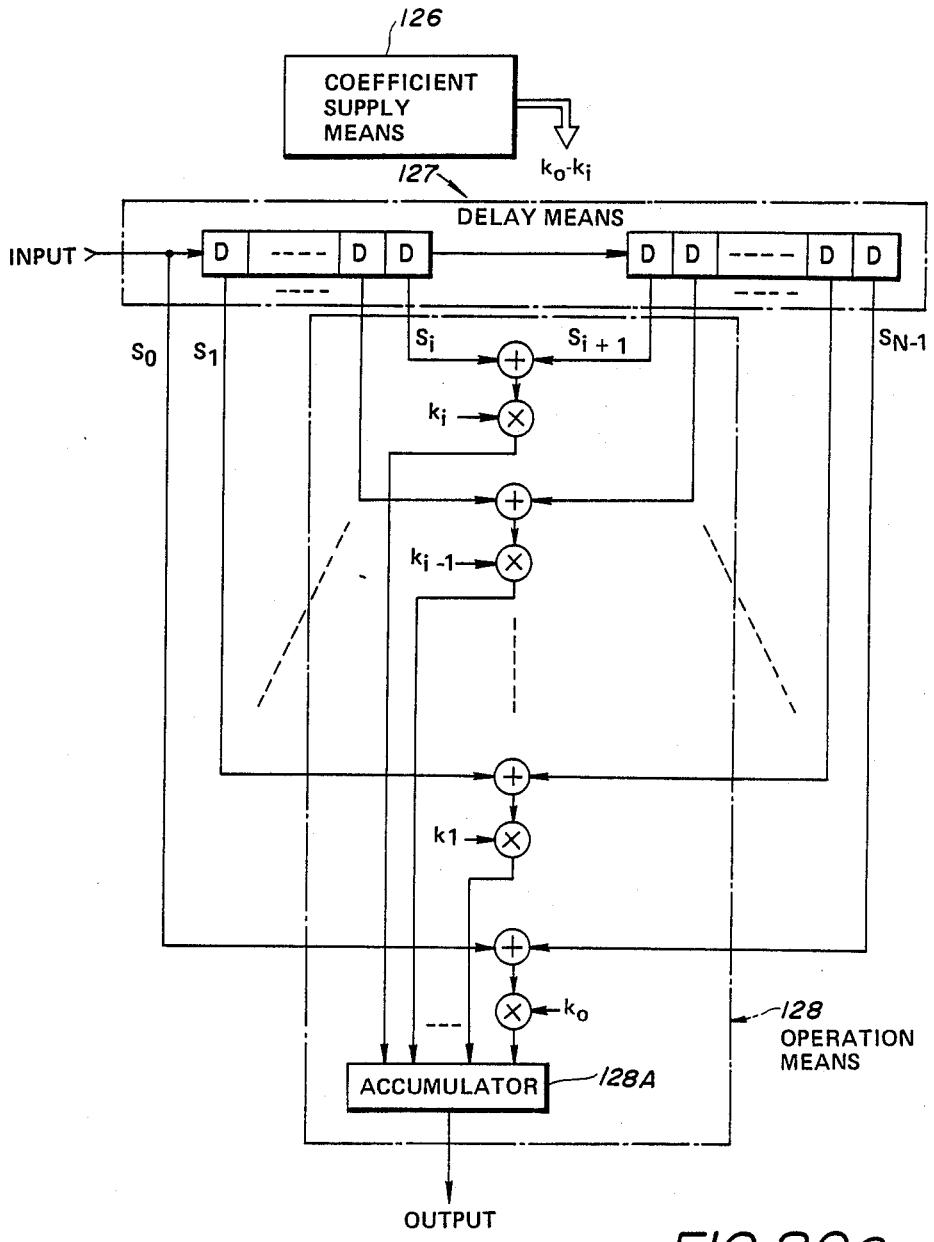
Figure 30B:
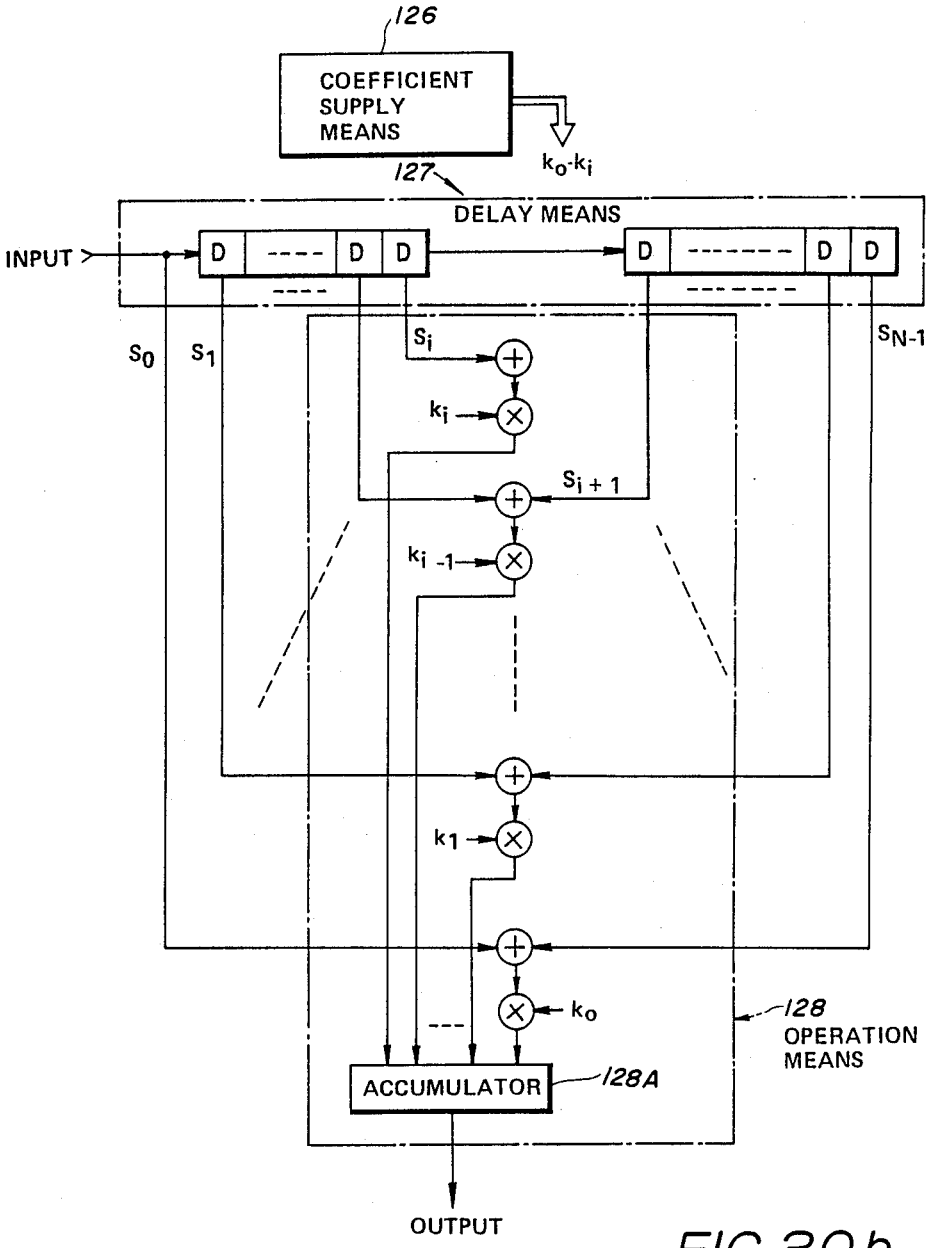
Figure 30C:
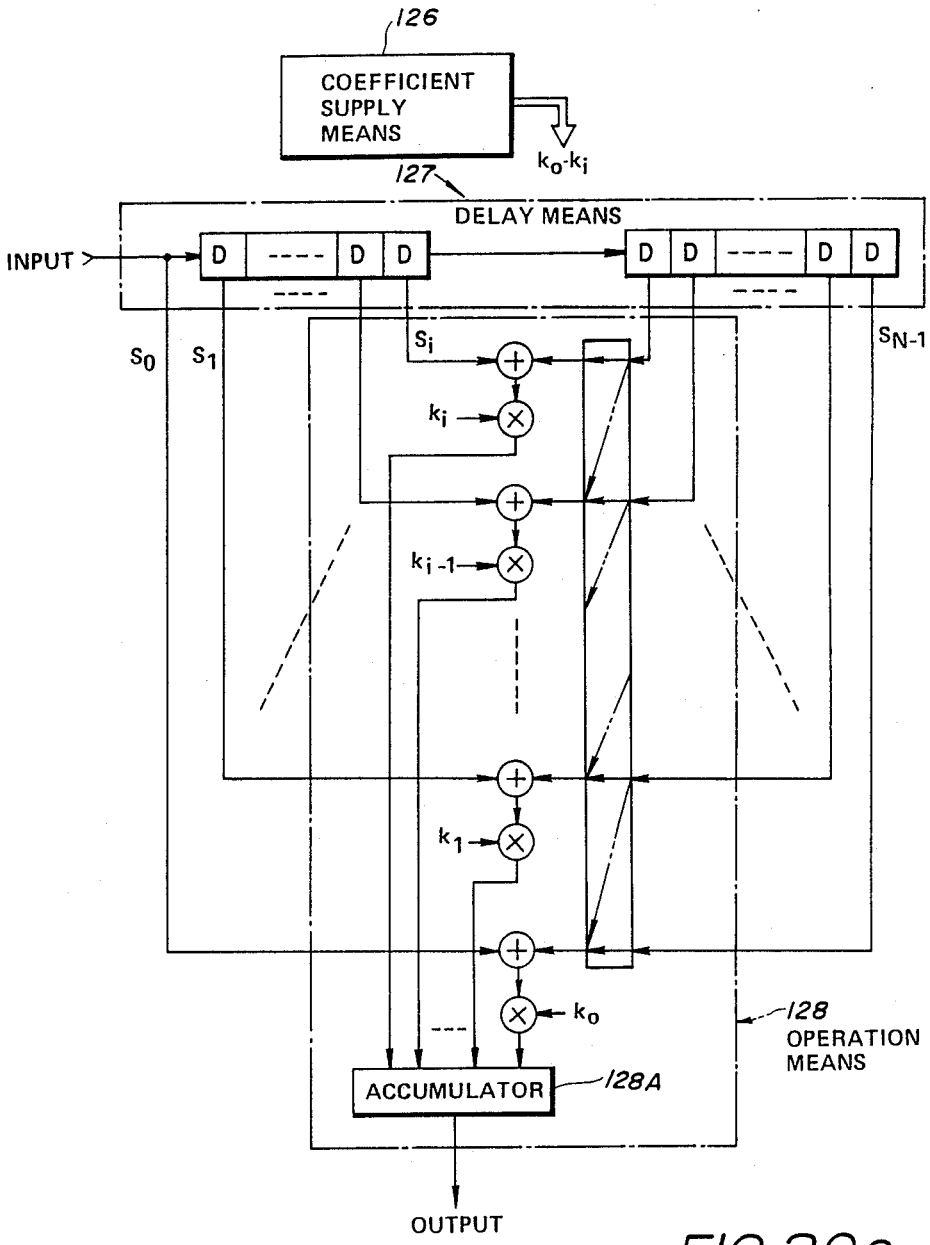

The tone signal processing device according to another aspect of the invention shown in FIGS. 30*a*– 30*c* comprises coefficient supply means 126 for supplying, for filter operation of N-th order, filter coefficients for N/2 orders when N is an even number and filter coefficients for (N+1)/2 orders when N is an odd number, delay means 127 for successively delaying digital tone signal sampled value data and thereby providing sampled value data of N-th order, and operation means 128 for performing a predetermined filter operation including multiplying respective two sampled value data positioned at symmetrical positions with respect to the center of N orders among the sampled value data of N orders in the delay means 127 with a common one of the filter coefficients and multiplying respective sampled value data of plural sets of the two sampled value data (N/2 sets when N is an even number and (N−1) sets when n is an odd number) with said filter coefficients while multiplying the sampled value data positioned at the center of the symmetry with a sole filter coefficient when N is an odd number.

In the same manner as described above, D represents a unit delay element, a circle with a symbol × a multiplication element and a circle with a symbol + an addition element, respectively. FIG. 30*a* shows a basic construction where N is an even number, FIG. 30*b* shows a basic construction where N is an odd number and FIG. 30*c* shows a basic construction where N can be switched between an even number and an odd number. In FIG. 30*c*, 128G denotes a switching gate which transmits sampled data from a delay means 127 as shown by a solid line when N is an even number to convert the filter to one of the same construction as the one shown in FIG. 30*a* and transmits the sampled data as shown by a chain and dot line to convert the filter to one of the same construction as the one shown in FIG. 30*b*.

The input digital tone signal sampled value data is successively delayed by the delay means 127 and sampled value data $S_0$–$S_{N-1}$ for N orders (i.e., $S_0$ with delay time 0 and $S_1$–$S_{N-1}$ having been subjected to delay of 1 to N−1 stages) are thereby supplied. Filter coefficients k0−ki for N/2 orders or (N+1)/2 orders are supplied by the coefficient supply means 126 depending upon whether N is an even number or an odd number. In the operation means 128, respective two sampled value data positioned at symmetrical positions with respect to the center of N orders in the sampled value data $S_0$–$S_{N-1}$ of N orders are multiplied with a common filter coefficient. In the case of the filter operation of finite impulse response (FIR) type, a total sum by an accumulator 128A of results of multiplication of sampled value data and filter coefficients for all orders becomes a final filter output.

When N is an even number, the filter coefficients k0–ki for N/2 orders are supplied from the coefficient supply means 126 and in this case i=(N−2)/2. The data of midway between the (N−2)/2-th order and the N/2 order becomes the center of symmetry and data of the 0-th to the i-th orders and data of the i+1-th to the N−1-th orders on either side of the central data are positioned at symmetrical positions. There are N/2 pairs of two sampled value data, i.e., $S_0$ and $S_{N-1}$, $S_1$ and $S_{N-2}$, . . . , Si and $S_{i+1}$ positioned at symmetrical positions. Accordingly, two sampled value data positioned at symmetrical positions are respectively multiplied with a common filter coefficient (one of k0–ki) which is common to the sampled value data of each pair in such a manner that, for example, tone signal sampled value data $S_0$ of the 0-th order and tone signal sampled value data $S_{N-1}$ of the N−1-th order are multiplied with a common filter coefficient k0 and tone signal sampled value data Si of the i-th order and tone signal sampled value data $S_{i+1}$ of the i+1-th order are multiplied with a common filter coefficient ki. By this arrangement, filter coefficients k0–ki, $k_{i+1}$–$k_{N-1}$ corresponding to the respective orders 0 to N−1 in the digital filter of N orders (N=an even number) are established in a symmetrical characteristic in effect. Besides, filter coefficients which must be actually prepared has only to be half of the number of orders required. An example of impulse response in the case where the filter coefficients of even number orders are established in a symmetrical characteristic is shown in FIG. 7.

When N is an odd number, filter coefficients k0–ki for (N+1)/2 orders are supplied by the coefficient supply means 126 and in this case i=(N−1)/2. The sampled value data at i=(N−1)/2-th order becomes the central data and sampled value data of 0-th to i−1-th orders and sampled value data of i+1-th to N 1-th orders on either side of the central data are positioned at symmetrical positions. There are (N−1)/2 pairs of sampled value data $S_0$ and $S_{N-1}$, $S_1$ and $S_{N-1}$ . . . $Si_{-1}$ and $Si_{+1}$ which are respectively positioned at symmetrical positions. Accordingly, two sampled value data positioned at the symmetrical positions are multiplied with a filter coefficient (one of k0–$ki_{-1}$) which is common to sampled value data of each pair in such a manner that, for example, tone signal sampled value data $S_0$ of the 0-th order and tone signal sampled value data $S_{N-1}$ of the N−1-th order are multiplied with a common coefficient k0 and tone signal sampled value data $S_{i-1}$ of the i–i-th order andtone signal sampled value data $S_{i+1}$ of the i+1-th order are multiplied with a common coefficient $ki_{-1}$. However, tone signal sampled value data Si of the i=(N−1)/2-th order which is positioned at the central position of symmetry is multiplied with a sole filter coefficient ki. By this arrangement, filter coefficients $k0-ki_{-1}$, ki, $ki_{+1}-k_{N-1}$ corresponding to respective orders 0 to N−1 of the digital filter of the N-th order (N=an odd number) are established in a symmetrical characteristic in effect. Filter coefficients which must be actually prepared has only to be half plus one of the number of orders required. An example of impulse response in the case where the filter coefficients of odd number orders are established in a symmetrical characteristic is shown in FIG. 6.

In FIGS. 30*a*–30*c*, in multiplying two sampled value data positioned at symmetrical positions with a common filter coefficient, the multiplication of the filter coefficient is made after the two data are added together. This arrangement is advantageous in that the number of the multipliers can be reduced to about half of the necessary number of orders. Alternatively, respective data may be multiplied separately.

Figure 31:
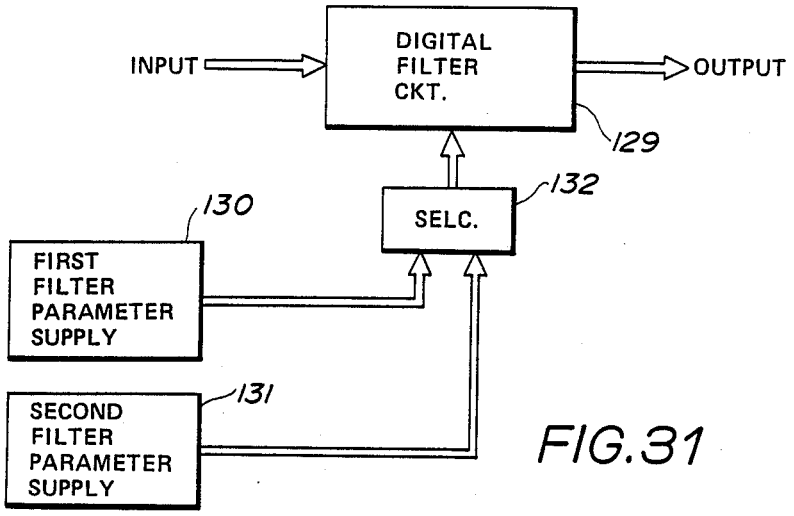

The tone signal processing device according to another aspect of the invention shown in FIG. 31 comprises a digital filter circuit 129 to which digital sampled value data of a tone signal is applied, first filter parameter supply means 130 for supplying a set of first filter parameters which do not undergo timewise change, second filter parameter supply means 131 for supplying a set of second filter parameters which undergo timewise change and selection means 132 for selecting either the first filter parameters or the and second filter parameters and supplying the selected filter parameters to the digital filter means.

In a case where a tone color which does not undergo timewise change during sounding of the tone is to be selected, the selection means 132 selects the first filter parameters supplied by the first filter parameter supply means 130. By the first filter parameters, the digital filter 129 is established to a characteristic which realizes a predetermined tone color which does not undergo timewise change during sounding of the tone. When a tone color which undergoes timewise change during sounding of the tone is to be selected, the selection means 132 selects the second filter parameters supplied by the second filter parameter supply means 131. By timewise change of the second filter parameters, the characteristic of the digital filter circuit 129 undergoes timewise change whereby the timewise change in the tone color is realized.

Figure 32:
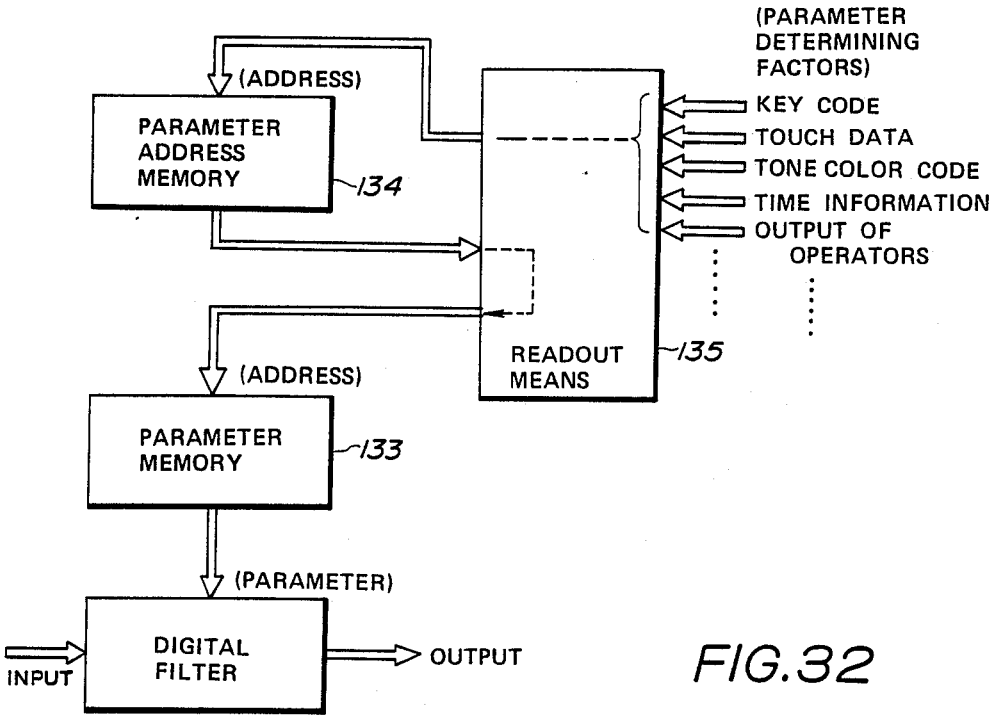
Figure 33:
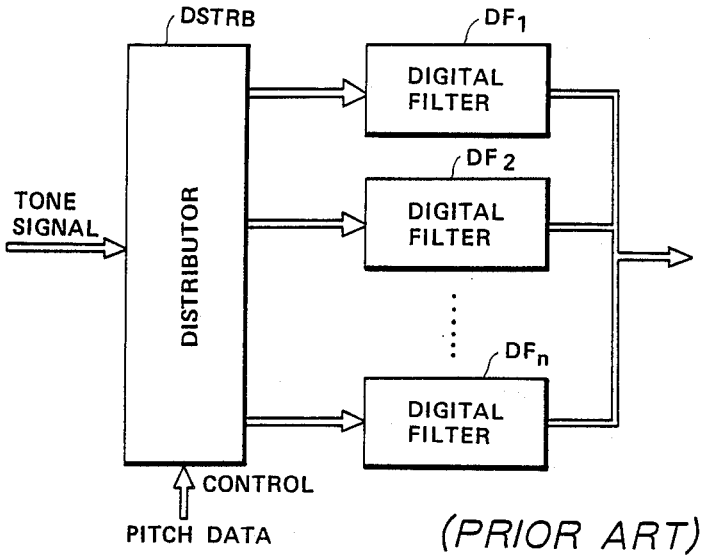
(PRIOR ART) FIG.33
FIGS. 33 and 34 are respectively block diagrams showing an example of the prior art.
Figure 34:
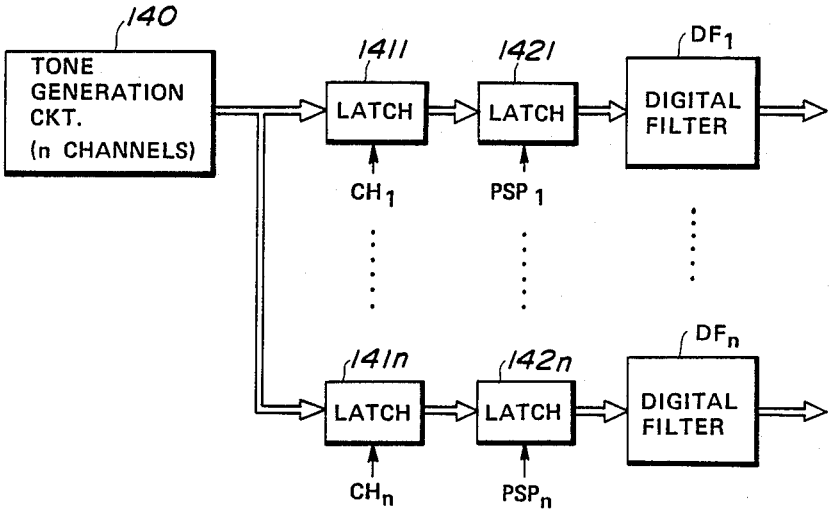
(PRIOR ART) FIG.34

The filter parameter supply device according to another aspect of the invention shown in FIG. 32 comprises parameter memory means 133 for storing plural sets of filter parameters, parameter address memory means 134 for storing addresses in the parameter memory means 133 for filter parameters to be read out from the parameter memory means 133 in accordance with a combination of parameter determining factors and readout means 135 for reading out address data from the parameter address memory means 134 in accordance with the combination of the parameter determining factors and reading out a set of filter parameters from the parameter memory means 133 in accordance with the read out address data. As data representing the parameter determining factors, such factors as, for example, a key code representing a depressed key, touch data representing the key touch, a tone color code representing a selected constant tone color and information according to lapse of time. In a case where lapse of time is included in the parameter determining factors and a filter parameter which changes with lapse of time during sounding of a tone is read out, a parameter processing unit 45 in FIG. 15 which is a specific example of the readout means 135 may be suitably designed so that it will operate even during sounding of the tone. Further, an output corresponding to an amount of operation of a suitable manual operator such as a brilliance operator may also be used as the parameter determining factor.

In the embodiments of FIGS. 28 through 32, it is not essential to perform the digital filter operation with a sampling period synchronized with the pitch of the tone as in the embodiment shown in FIG. 1.

What is claimed is:

1. An electronic musical instrument comprising:

tone signal generating means for generating digital tone signals;

pitch designating means for designating the pitch of atone to be generated;

pitch synchronizing signal generation mans, responsive to said pitch designating means, for generating a pitch synchronizing signal synchronized with the pitch of a digital tone signal to be filtered; and digital filter means for receiving said digital tone signals and performing a digital filtering operation on said digital tone signals with a sampling period synchronized with aid pitch synchronizing signal generated by said pitch synchronizing signal generation means.

2. An electronic musical instrument as defined in claim 1 which further comprises designating means for designating either one of pitch synchronization/non-synchronization, and wherein said digital filter means performs the digital filtering operation on said digital tone signal with a predetermined period, irrespective of said pitch of said digital tone signal and in place of aid sampling period synchronized with said pitch synchronizing signal, when the non-synchronization is designated by said designation means.

3. An electronic musical instrument as defined in claim 1 wherein said digital filter means comprises:

delay means for successively delaying the digital sampled value data of the digital tone signal in synchronism with the pitch synchronizing signal to provide sampled value data having plural integer delay orders associated therewith;

means for supplying plurally filter coefficients having plural integer orders associated therewith; and operation means for multiplying the sampled value data of each of said plural delay orders with a filter coefficient of corresponding order.

4. An electronic musical instrument as defined in claim 1 wherein said tone signal generating means provides said digital tone signal sin plural channels and wherein said pitch synchronizing signal generation means generates on a time shared basis plural pitch synchronizing signals, said plural pitch synchronizing signals corresponding to the tone signals of the plural channels, and wherein said digital filter means performs the digital filtering operation on a time shared basis with respect to the tone signals of the plural channels applied on a time shared basis.

5. An electronic musical instrument as defined in claim 4 which further comprises filter coefficient supply means for supplying filter coefficients corresponding to the plural channels on a time shared basis and operation means common to the plural channels for performing the digital filtering operation wherein said digital filter means receives the filter coefficients supplied on a time shared basis and performs the digital filtering operation on a time shared basis using the operation means common to the plural channels.

6. An electronic musical instrument as defined in claim 1 wherein said tone signal generating means provides said digital tone signals in plural channels and wherein said pitch synchronizing signal generation means generates on a time shared basis plural pitch synchronizing signals, said plural pitch synchronizing signals corresponding to the tone signals of the plural channels, and wherein said digital filter means comprises means for generating a filter operation demand signal with respect to each channel in response to each of the pitch synchronizing signals at a time division channel timing which is different from the pitch synchronizing signal, and means for performing the digital filtering operation in accordance with the filter operation demand signal.

7. An electronic musical instrument as defined in claim 1 in which said digital filter means further comprises:

shift register means of plural stages[for successively shifting sampled value data or the digital tone signal;

multiplier means for receiving an output signal of a predetermined stage of said shift register means; and means for supplying filter coefficients to said multiplier means on a time shared basis;

wherein said shift register means performs shifting in synchronism with time division timings of the filter coefficients and also in synchronism with the pitch synchronizing signal 8. An electronic musical instrument as defined in claim 2 wherein:

tone signal generating means provides said digital tone signals in plural channels and wherein said digital filter means performs the digital filtering operation with respect to tone signals of the plural channels;

said means for designating one of pitch synchronization/non-synchronization generates a pitch synchronization/non-synchronization signal representative of such designation for each channel; and said digital filter means, based on said synchronization/non-synchronization signal, performs a digital filtering operation, synchronized with the pitch or not synchronized with the pitch respectively, independently for each channel.

9. An electronic musical instrument as defined in claim 2 which further comprises pitch control means for controlling the pitch of a tone signal and wherein the pitch synchronization/non-synchronization designation means designates a digital filtering operation not synchronized with the pitch when the pitch is controlled by said pitch control means and designates a digital filtering operation synchronized with the pitch when the pitch is not controlled.

10. An electronic musical instrument as defined in claim 1 wherein said digital filter means comprises an infinite impulse response filter.

11. An electronic musical instrument as defined in claim 1 wherein said digital filtering operation has an integer order associated therewith and which further comprises:

parameter generation means for generating an even-/odd parameter which establishes the order of the digital filtering operation to either an even number or an odd number; and switching means for switching the order of delay in said digital filter means between a predetermined even number order and a predetermined odd number order in response to the even/odd parameter.

12. An electronic musical instrument as defined in claim 1 wherein said digital filter means comprises:

coefficient supply means for supplying, for a digital filtering operation of N-th order, filter coefficients for N/2 orders when N is an even number and filter coefficients for $(N+1)/2$ orders when N is an odd number;

delay means for successively delaying digital tone signal sampled value data and thereby providing sampled value data of N-th order; and operation means for performing a predetermined digital filtering operation including multiplying respective sampled value data positioned at symmetrical positions with respect to the center of the N orders of sampled value data in the delay means with a common one of the filter coefficients, said multiplying being performed for plural sets of two of said respective symmetric sampled value data (N/2 sets when N is an even number and $(N-\frac{1}{2})$ sets when N is an odd number) with said filter coefficients, and multiplying the sampled value data positioned at the center of the N orders of sampled value data with a sole filter coefficient when N is an odd number.

13. An electronic musical instrument as defined in claim 1 which further comprises:

first filter parameter supply means for supplying a set of first filter parameters which do not vary with time;

second filter parameter supply means for supplying a set of second filter parameter, which vary with time; and selection means for selecting either the first filter parameters or the second filter parameters and supplying the selected filter parameters to said digital filter means.

14. An electronic musical instrument as defined in claim 1 which further comprises:

parameter memory means for storing plural sets of filter parameters;

means for providing parameter determining information, parameter address memory means for storing addresses in said parameter memory means for filter parameters to be read out from said parameter memory means in accordance with the parameter determining information; and readout means for reading out address data from said parameter address memory means in accordance with the parameter determining information and reading out a set of filter parameters from said parameter memory means in accordance with the read out address data;

the read out filter parameters being supplied to said digital filter means.

15. An electronic musical instrument of the type having plural tone generation channels, comprising:

pitch designation means for designating the pitch of a tone to be generated;

assigner means for assigning generation of a tone signal having the designated pitch to any of said plural channels;

tone generation means for generating a digital tone signal channel by channel in accordance with the assignment by said assigner means;

pitch synchronizing signal generation means for generating, for each of the channels, a pitch synchronizing signal synchronized with the pitch of a tone signal assigned to each channel; and .

digital filter means for performing a digital filtering operation, channel by channel, with respect to tone signals of respective channels generated by said tone generation means with a sampling period which is independent for each channel and is in accordance with the pitch synchronizing signal corresponding to each channel.

16. An electronic musical instrument comprising:

tone generation means for generating digital tone signals in plural channels on a time shared basis;

digital filter means for receiving the digital tone signals of plural channels generated by said tone generation means and performing a digital filtering operation channel by channel on a time shared basis;

pitch synchronizing signal generation means for generating pitch synchronizing signals synchronized with the pitches of the tone signals of the respective channels and; and pitch synchronization output means for sampling and outputting the tone signals of the respective channels provided by said digital filter means in response to the pitch synchronizing signals generated in correspondence to the respective channels.

17. An electronic musical instrument comprising:

tone signal generating means for generating digital tone signals comprising digital sampled value data;

pitch designating means for designating the pitch of a tone to be generated;

digital filter means, responsive to the pitch designating means, for receiving the digital sampled value data of a tone signal and for performing a digital filtering operation on said digital parameter generation means for generating an even-/odd parameter which establishes the order of a digital filtering operation to either an even number or an odd number;

delay means for delaying the digital sampled value data to a predetermined order of delay; and switching means for switching the order of delay in the sampled value data used in the digital filtering operation in said digital filter means between a predetermined even number order and a predetermined odd number order in response to the even-/odd parameter.

18. An electronic musical instrument as defined in claim 17 wherein said parameter generation means generates filter coefficients together with said even/odd

19. An electronic musical instrument as defined in claim 17 wherein said digital filter means has a filter characteristic and an integer order associated therewith and further comprising means for establishing the filter characteristic of said digital filter means as a low-pass, band-pass or high-pass characteristic and wherein said parameter generation means generates an even/odd parameter which establishes the order to an even number when the filter characteristic of said digital filter means is established to a band-pass or low-pass characteristic and generates and even/odd parameter which establishes the order to an odd number when the filter characteristic is established to a high-pass characteristic.

20. An electronic musical instrument as defined in claim 17 wherein said digital filter means comprises an infinite impulse response filter.

21. An electronic musical instrument comprising:

tone signal generation means for generating digital tone signals formed of sampled value data;

pitch designating means for designating the pitch of a tone to be generated;

coefficient supply means for supplying, for a digital filtering operation of N-th order, filter coefficients for N/2 orders when N is an even number and filter coefficients for (N+1)/2 orders when N is an odd number;

delay means for successively delaying digital tone signal sampled value data and thereby providing sampled value data of N-th order; and operation means for performing a predetermined digital filtering operation including multiplying respective sampled value data positioned at symmetrical positions with respect to the center of the N orders of sampled value data in said delay means with a common one of the filter coefficients, said multiplying being performed for plural sets of two of said respective symmetric sampled value data (N/2 sets when N is an even number and $(N-\frac{1}{2})$ sets when N is an odd number) with said filter coefficients, and multiplying the sampled value data positioned at the center of the N orders of sampled value data with a sole filter coefficient when N is an odd number.

22. An electronic musical instrument as define din claim 21 wherein each filter coefficient supplied by said coefficient supply means comprises filter coefficient data and weighting data for weighting the filter coefficient data and wherein the multiplication in said operation means is effected by multiplying sampled value data of each order with the corresponding filter coefficient data and shifting the data which is the result of this multiplication in accordance with the weighting data.

23. An electronic musical instrument as defined in claim 21 wherein said operation means comprises an adder for adding the two sampled value data positioned at the symmetrical positions and a multiplier for multiplying an output of this adder with a common one of the filter coefficients.

24. An electronic musical instrument as defined in claim 21 wherein the digital filtering operation ion said operation means is provided by an infinite impulse response filter.

25. An electronic musical instrument comprising;

tone signal generation means for generating digital tone signals, said digital tone signals comprising digital sampled value data;

digital filter means for receiving digital sampled value data of a tone signal and performing a digital filtering operation thereon, comprising:

first filter parameter supply means for supplying a set of first filter parameters which do not vary with time;

second filter parameter supply means for supplying a set of second filter parameters which vary with time; and selection means for selecting either the first filter parameters or the second filter parameters and supplying the selected filter parameters to said digital filter means.

26. An electronic musical instrument as defined in claim 25 wherein the filter parameters comprise a plurality of filter coefficients having a varying integer order associated therewith and wherein the order of the filter coefficients constituting a set of the second filter parameters is smaller than the order of the filter coefficients constituting a set of the first filter parameters.

27. An electronic musical instrument is defined in claim 26 wherein said first and second filter parameter supply means respectively deliver out filter coefficients of respective orders constituting a set of the filter parameters serially and on a time shared basis.

28. An electronic musical instrument as defined in claim 26 wherein each filter parameter comprises filter coefficient data and weighting data and said digital filter means performs multiplication of the sampled value data with the filter coefficients by multiplying the sampled value data of respective orders with the corresponding filter coefficient data and shifting of the data which is the result of this multiplication in accordance with the weighting data.

29. An electronic musical instrument comprising:

tone generation means for generating the signals;

pitch designating means for designating the pitch of a tone to be generated;

digital filter means for digitally filtering said tone signals in a manner responsive to said pitch designating means, comprising:

parameter memory means for storing plural sets of filter parameters for use in filtering tone signals generated by the tone generation means;

parameter address memory means for storing addresses in said parameter memory means for filter parameters to be read out from said parameter memory means in accordance with a combination of parameter determining factors; and readout means for reading out address data from said parameter address memory means in accordance with the combination of the parameter determining factors and reading out a set of filter parameters from said parameter memory means in accordance with the read out address data.

* * * * *

UNITED STATES PATENT AND TRADEMARK OFFICE
CERTIFICATE OF CORRECTION

PATENT NO. : 4,841,828

DATED : June 27, 1989

INVENTOR(S) : Hideo Suzuki

It is certified that error appears in the above-identified patent and that said Letters Patent is hereby corrected as shown below:

On the title page, "29 Claims, No Drawings" should be --29 Claims, 23 Drawing sheets--.

In the abstract, at line 1, change "snychronized" to --synchronized--.

In column 4, at line 16, change "with simple' to --with a simple--.

In column 7, at line 6-, change "k0- $k_{-1}$" to --k0-$ki_{-1}$--.

In column 9, at line 62, change "key touch a tone" to --key touch, a tone--.

In column 11, at line 20, change "a multipliers and a" to --a multiplier an and--.

In column 13, at line 7, change "th bus' to --the bus--.

In column 14, at line 19, change "filter operation signal" to --filter operation (signal--.

In column 16, at line 64, after "equation" insert --(3) can be obtained as an averaging result.--.

In column 21, Equation 8, change "h(n)=h(N=1-n)" to --h(n)=h(N-1-n)--.

In column 29, at line 9, change "ØFS2(29),ØFS8" to --ØFS2(29), .....ØFS8--.

UNITED STATES PATENT AND TRADEMARK OFFICE

CERTIFICATE OF CORRECTION

PATENT NO. : 4,841,828

DATED : June 27, 1989

INVENTOR(S) : Hideo Suzuki

It is certified that error appears in the above-identified patent and that said Letters Patent is hereby corrected as shown below:

In column 30, at line 24, change "previously, he" to --previously, the--.

In column 31, at line 47, change "PDOB1, RLB4-P" to --PDOB1, ... RLB4-P--.

Figure 18A:
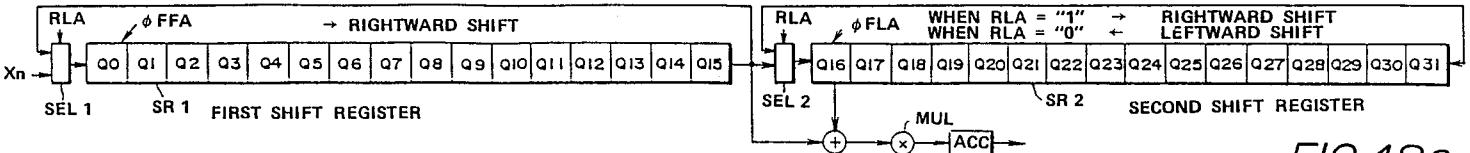
FIGS. 18*a* and 18*b* are schematic diagrams for explaining the basic operation of the FIR type filter operation in a case where a filter characteristic consisting of even number orders (32 orders) in the digital filter circuit shown in FIG. 14.
Figure 18B:
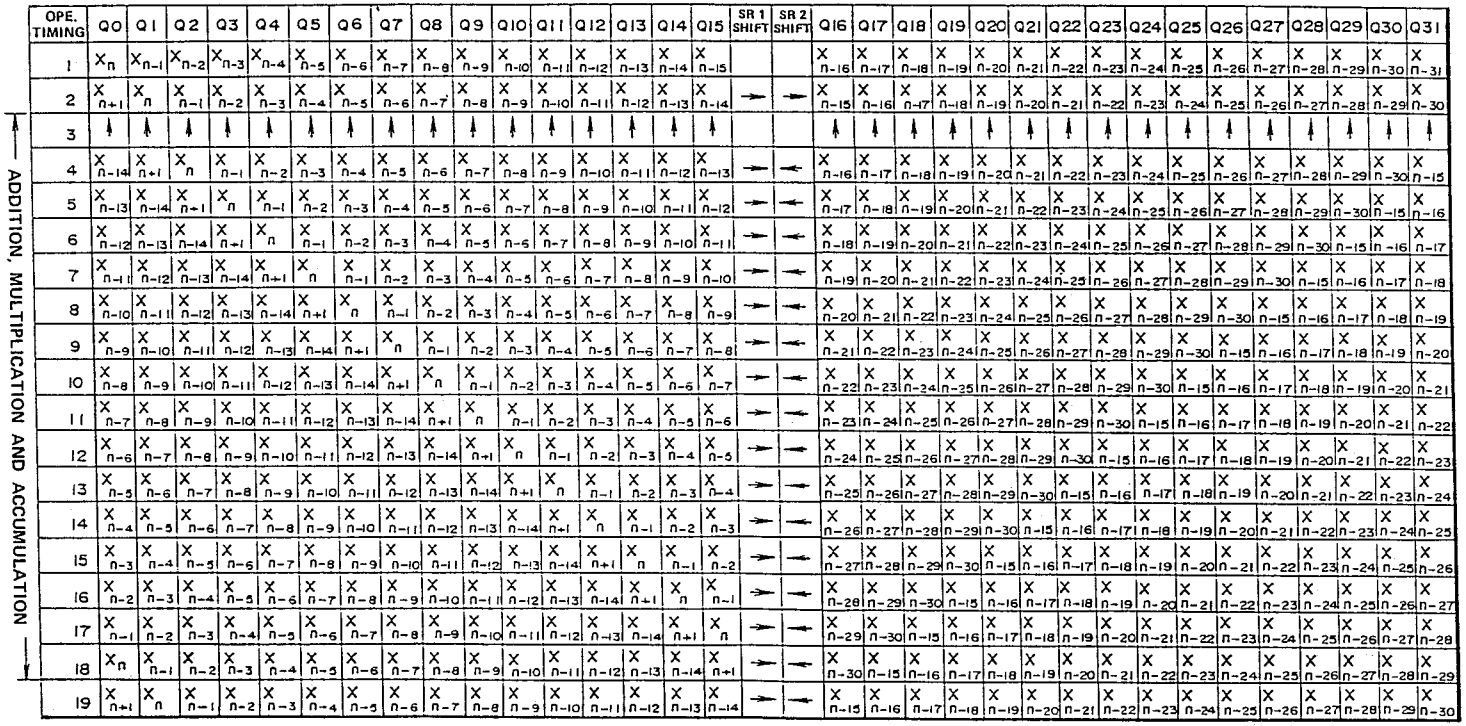

In column 32, at line 8, change "FIG. 18(a)" to --FIGS. 18(a)--; and at line 10, change "FIR type operation" to --FIR type filter operation--.

In column 33, at line 58, change "$X_{n-1}-X_{n-30}$" to --$X_{n+1}-X_{n-30}$--; and at line 65, change "FIR type operation" to --FIR type filter operation--.

In column 35, at line 30, change "supplied to 17, the" to --supplied to the shift register 71. As will be apparent from Fig, 17, the--.

In column 36, line 19, change "the FIGS." to --the Gate GT in FIGS.--.

In column 45, at line 61, change "(PS1." to --PS1.--.

In column 47, at line 35, delete the "," after "having".

UNITED STATES PATENT AND TRADEMARK OFFICE

CERTIFICATE OF CORRECTION

PATENT NO. : 4,841,828

DATED : June 27, 1989

INVENTOR(S) : Hideo Suzuki

It is certified that error appears in the above-identified patent and that said Letters Patent is hereby corrected as shown below:

In column 48, at lines 42 and 49, change reference numeral "17" to --117--.

In column 49, at line 14, change "order when" to --order. When--; and at line 27, change "one of the n-1-th order," to --one of the n-th order, i.e., an even number order and when B has been selected, the filter becomes one of the n-1-th order,--.

In column 50, at line 59, change "N 1-th orders" to --N-1-th orders--; and at line 62, change "$S_1$ and $S_{N-1}$" to --$S_1$ and $S_{N-2}$--.

In column 51, at line 4, change "andtone" to --and tone--.

In claim 1, at line 24 of column 52, change "atone" to --a tone--; at line 25, of column 52, change "mans" to --means--; and at line 32 of column 52, change "aid" to --said--.

In claim 2, at line 42 of column 52, change "signal in place of aid" to --signal and in place of said--.

In claim 3, at column 52, line 53, change "plurally" to --plural--.

In claim 4, at column 52, line 60, change "signal sin" to --signals in--.

UNITED STATES PATENT AND TRADEMARK OFFICE

CERTIFICATE OF CORRECTION

PATENT NO. : 4,841,828

DATED : June 27, 1989

INVENTOR(S) : Hideo Suzuki

It is certified that error appears in the above-identified patent and that said Letters Patent is hereby corrected as shown below:

In claim 7, at column 53, line 29, change "stages [for" to --stages for--.

In claim 17, at column 55, line 45, change "on said digital" to --on said digital sampled value data;--

In claim 18, at column 55, line 60, change "even/odd" to --even/odd parameter.--.

In claim 24, at column 56, line 53, change "ion said" to --in said--.

In claim 29, at column 58, line 4, change "the signals" to --tone signals--.

Signed and Sealed this

Nineteenth Day of May, 1992

*Attest:*

DOUGLAS B. COMER

*Attesting Officer*

*Acting Commissioner of Patents and Trademarks*